US005691094A

United States Patent [19]

Kato

[11] Patent Number: 5,691,094

[45] Date of Patent: Nov. 25, 1997

[54] METHOD FOR PREPARATION OF PRINTING PLATE BY ELECTROPHOTOGRAPHIC PROCESS AND APPARATUS FOR USE THEREIN

[75] Inventor: Eiichi Kato, Shizuoka, Japan

[73] Assignee: Fuji Photo Film Co., Ltd., Kanagawa, Japan

[21] Appl. No.: 565,232

[22] Filed: Nov. 30, 1995

[30] Foreign Application Priority Data

Dec. 1, 1994 [JP] Japan ..... 6-321192

[51] Int. Cl.[6] ..... G03G 13/26

[52] U.S. Cl. ..... 430/49

[58] Field of Search ..... 430/49

[56] References Cited

U.S. PATENT DOCUMENTS 5,561,014 10/1996 Kato ..... 430/49

*Primary Examiner*—Mark Chapman

*Attorney, Agent, or Firm*—Sughrue,Mion,Zinn,Macpeak & Seas, PLLC

[57] ABSTRACT

A method for preparation of a printing plate by an electrophotographic process comprising providing a peelable transfer layer mainly containing a resin (A) capable of being removed upon a chemical reaction treatment on an electrophotographic light-sensitive element, forming a toner image on the transfer layer by an electrophotographic process, transferring the toner image together with the transfer layer onto a primary receptor, transferring the toner image together with the transfer layer from the primary receptor onto a receiving material having a surface capable of providing a hydrophilic surface suitable for lithographic printing at the time of printing, and removing the transfer layer on the receiving material in a non-image area by the chemical reaction treatment.

28 Claims, 4 Drawing Sheets

METHOD FOR PREPARATION OF PRINTING PLATE BY ELECTROPHOTOGRAPHIC PROCESS AND APPARATUS FOR USE THEREIN

FIELD OF THE INVENTION

The present invention relates to a method for preparation of a printing plate by an electrophotographic process, and more particularly to a method for preparation of a lithographic printing plate by an electrophotographic process including formation, transfer and removal of a transfer layer wherein the transfer layer is easily transferred and removed and good image qualities are maintained during a plate making process thereby providing a printing plate which produces prints of good image qualities.

BACKGROUND OF THE INVENTION

Owing to the recent technical advancements of image processing by a computer, storage of a large amount of data and data communication, input of information, revision, edition, layout, and pagination are consistently computerized, and electronic editorial system enabling instantaneous output on a remote terminal plotter through a high speed communication network or a communications satellite has been practically used.

Light-sensitive materials having high photo-sensitivity which may provide direct type printing plate precursors directly preparing printing plates based on the output from a terminal plotter include electrophotographic light-sensitive materials.

In order to form a lithographic printing plate using an electrophotographic light-sensitive material, a method wherein after the formation of toner image by an electrophotographic process, non-image areas are subjected to oil-desensitization with an oil-desensitizing solution to obtain a lithographic printing plate, and a method wherein after the formation of toner image, a photoconductive layer is removed in non-image areas to obtain a lithographic printing plate are known.

However, in these method, since the light-sensitive layer is subjected to treatment for rendering it hydrophilic to form hydrophilic non-image areas or removed by dissolving out it in the non-image areas to expose an underlying hydrophilic surface of support, there are various restrictions on the light-sensitive material, particularly a photoconductive compound and a binder resin employed in the photoconductive layer. Further, printing plates obtained have several problems on their image qualities or printing durability.

In order to solve these problems there is proposed a method comprising providing a transfer layer composed of a thermoplastic resin capable of being removed upon a chemical reaction treatment on a surface of an electrophotographic light-sensitive element, forming a toner image on the transfer layer by a conventional electrophotographic process, transferring the toner image together with the transfer layer onto a receiving material capable of forming a hydrophilic surface suitable for a lithographic printing, and removing the transfer layer to leave the toner image on the receiving material whereby a lithographic printing plate is prepared as described in WO 93/16418.

Since the method for preparation of printing plate using a transfer layer is different from the method for forming hydrophilic non-image areas by modification of the surface of light-sensitive layer or dissolution of the light-sensitive layer, and comprises the formation of toner image not on the light-sensitive layer but on the transfer layer, the transfer of toner image together with the transfer layer onto another support having a hydrophilic surface and the removal of the transfer layer by a chemical reaction treatment, printing plates having good image qualities are obtained without various restrictions on the photoconductive layer employed as described above.

However, in the above-described method, transferability of the transfer layer while applying heat and pressure is yet insufficient and thus, there are observed lack of fine images on the receiving material and the residue of toner image and transfer layer on the surface of light-sensitive element in some cases. In particular, a support having a hydrophilic surface to be used as the receiving material is restricted in order to obtain good transferability of transfer layer. Specifically, in case of employing a receiving material comprising a substrate having a surface of relatively poor smoothness, for example, plain paper, adhesion of the transfer layer to the receiving material is insufficient and as a result, transferability decreases. Further, the transfer layer must fulfill electrophotographic characteristics (Ep characteristics) in addition to the transferability and a dissolution property which is important in the step of preparing a printing plate, because on the transfer layer provided on a light-sensitive element are formed toner images by a conventional electrophotographic process.

It is not easy to select a transfer layer which satisfies all of the transferability, dissolution property and electrophotographic characteristics. Accordingly, a resin to be employed in the transfer layer is imposed various restrictions on its basic structure such as polymer component and molecular weight.

The electrophotographic characteristics, particularly, chargeability and dark decay (DQR) of transfer layer are greatly influenced by properties of resin used. In the event of poor electrophotographic characteristics, problems on image reproduction, for example, decrease in the maximum density of duplicated image and lack of fine lines and letters may tend to occur. Such a tendency becomes large when a thickness of the transfer layer is more than 5 μm. To reduce the thickness of transfer layer, however, may result in degradation of transferability. Therefore, it is very difficult to satisfy both of the electrophotographic characteristics and the transferability.

Moreover, according to the hitherto known method for preparation of a lithographic printing plate using a transfer layer, a toner image is transferred directly onto a receiving material without passing through a primary receptor. Thus, it is necessary to select very severe transfer conditions depending on the kind of receiving material to be used, and it is difficult to conduct complete transfer of toner image in some instances.

The complete transfer may be achieved by means of increase in a thickness of transfer layer, increase in temperature or pressure for transfer, or decrease in a speed of transfer. However, such a means causes other problems in that life of an electrophotographic light-sensitive element is remarkably shortened during repeated use thereof, in that a capacity of electric power necessary for an apparatus increases and in that a cost for the preparation of printing plate increases.

SUMMARY OF THE INVENTION

An object of the present invention is to provide a method for preparation of a lithographic printing plate using a transfer layer in which excellent transferability of the transfer layer is accomplished and good images are obtained.

Another object of the present invention is to provide a method for preparation of a printing plate using a transfer layer which provides complete transfer of transfer layer and toner image irrespective of the kind of a receiving material.

A still another object of the present invention is to provide a method for preparation of a printing plate using a transfer layer in which good transferability is maintained even when a thickness of transfer layer is reduced.

A further object of the present invention is to provide a method for preparation of a printing plate using a transfer layer in which a latitude of transfer is enlarged and a desensitizing treatment is conducted under a mild condition.

A still further object of the present invention is to provide an apparatus for preparation of a printing plate precursor which is suitable for use in the method for preparation of a printing plate described above.

Other objects of the present invention will become apparent from the following description.

It has been found that the above described objects of the present invention are accomplished by a method for preparation of a printing plate by an electrophotographic process comprising providing a peelable transfer layer mainly containing a resin (A) capable of being removed upon a chemical reaction treatment on an electrophotographic light-sensitive element, forming a toner image on the transfer layer by an electrophotographic process, transferring the toner image together with the transfer layer onto a primary receptor, transferring the toner image together with the transfer layer from the primary receptor onto a receiving material having a surface capable of providing a hydrophilic surface suitable for lithographic printing at the time of printing, and removing the transfer layer on the receiving material in a non-image area by the chemical reaction treatment.

BRIEF DESCRIPTION OF THE ACCOMPANYING DRAWINGS

EXPLANATION OF THE SYMBOLS

Figure 1:
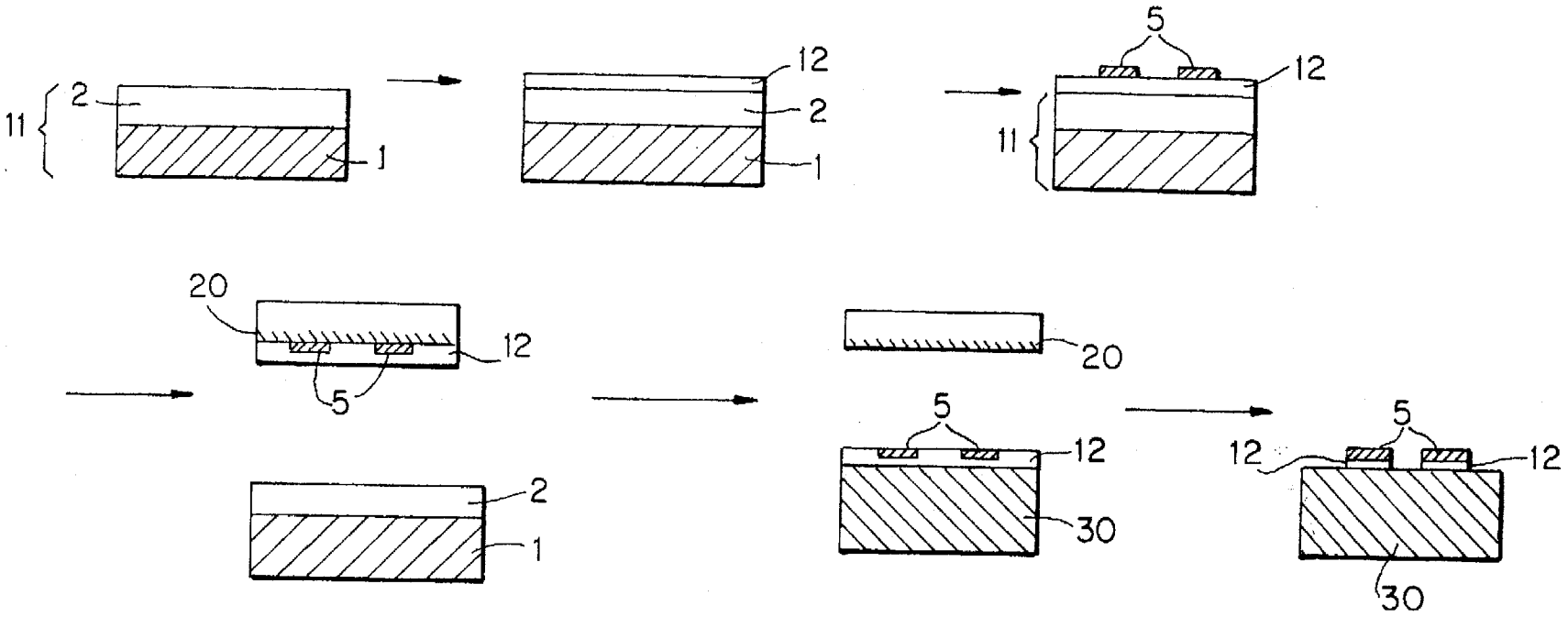
FIG. 1 is a schematic view for explanation of the method according to the present invention.

1 Support of light-sensitive element
2 Light-sensitive layer
5 Toner image
10 Device for applying compound (S)
11 Light-sensitive element
12 Transfer layer
13 Device for providing transfer layer
14 Liquid developing unit set
14L Liquid developing unit
14R Rinsing means
14T Electrodeposition unit
15 Suction/exhaust unit
**15*a*** Suction part
**15*b*** Exhaust part
16 Heating means
17 Temperature controller
18 Corona charger
19 Exposure device
20 Primary receptor
24 Release paper
**25*a*** Heating means
**25*b*** Heating roller
**25*c*** Cooling roller
30 Receiving material
31 Backup roller for transfer
32 Backup roller for release
110 Applying part of compound (S)
111 Transfer roll
112 Metering roll
113 Compound (S)
120 Providing part of transfer layer
130 Transferring part to receiving material

DETAILED DESCRIPTION OF THE INVENTION

The method for preparation of a printing plate by an electrophotographic process according to the present invention will be diagrammatically described with reference to FIG. 1 of the accompanying drawings.

As shown in FIG. 1, the method for preparing a printing plate comprises providing a transfer layer 12 on an electrophotographic light-sensitive element 11 having at least a support 1 and a light-sensitive layer 2, forming a toner image 5 on the transfer layer 12 by a conventional electrophotographic process, transferring the toner image 5 together with the transfer layer 12 onto a primary receptor 20, further transferring the toner image 5 together with the transfer layer 12 onto a receiving material 30 which is a support for an offset printing plate to prepare a printing plate precursor, and then removing-the transfer layer 12 transferred onto the receiving material 30 only in the non-image area by a chemical reaction treatment to prepare an offset printing plate.

The method of the present invention is characterized by transferring once a toner image formed on a transfer layer which had been provided on the surface of an electrophotographic light-sensitive element by a conventional electrophotographic process together with transfer layer onto a primary receptor (intermediate medium) and then transferring the toner image together with the transfer layer onto a receiving material (hereinafter also referred to as a final receiving material sometimes).

Since the transfer is performed through the primary receptor, transferability of transfer layer and toner image is improved based on an action of the intermediate medium as an elastomer (cushioning function). Specifically, the transferability is improved because a cushion effect due to the thickness of transfer layer per se is borne by the primary receptor. As a result, a condition for performing complete transfer can be determined even when various kinds of receiving materials are employed and the thickness of transfer layer can be reduced.

Therefore, the toner image formed on a light-sensitive material is able to be transferred onto a final receiving material accompanying little or no degradation of image to produce a duplicated image of high accuracy and high quality. Further, the condition for transfer can be moderated.

The present invention also provides an apparatus for preparation of a printing plate precursor by an electrophotographic process comprising a means for providing a peelable transfer layer mainly containing a resin (A) capable of being released upon a chemical reaction treatment on an electrophotographic light-sensitive element, a means for forming a toner image on the transfer layer by an electrophotographic process, a means for transferring the toner image together with the transfer layer onto a primary receptor, and a means for transferring the toner image together with the transfer layer from the primary receptor onto a receiving material having a surface capable of providing a hydrophilic surface suitable for lithographic printing at the time of printing.

Now, the electrophotographic light-sensitive element which can be used in the present invention will be described in detail below.

Any conventionally known electrophotographic light-sensitive element can be employed. What is important is that the surface of light-sensitive element has the releasability at the time for the formation of transfer layer so as to easily release the transfer layer to be formed thereon together with a toner image.

More specifically, an electrophotographic light-sensitive element wherein an adhesive strength of the surface thereof measured according to JIS Z 0237–1980 "Testing methods of pressure sensitive adhesive tapes and sheets" is not more than 100 gram·force (g·f) is preferably employed.

The measurement of adhesive strength is conducted according to JIS Z 0237–1980 8.3.1. 180 *Degrees Peeling Method* with the following modifications:

(i) As a test plate, an electrophotographic light-sensitive element on which a transfer layer is to be formed is used.

(ii) As a test piece, a pressure sensitive adhesive tape of 6 mm in width prepared according to JIS C2338–1984 is used.

(iii) A peeling rate is 120 mm/min using a constant rate of traverse type tensile testing machine.

Specifically, the test piece is laid its adhesive face downward on the test plate and a roller is reciprocate one stroke at a rate of approximately 300 mm/min upon the test piece for pressure sticking. Within 20 to 40 minutes after the sticking with pressure, a part of the stuck portion is peeled approximately 25 mm in length and then peeled continuously at the rate of 120 mm/min using the constant rate of traverse type tensile testing machine. The strength is read at an interval of approximately 20 mm in length of peeling, and eventually read 4 times. The test is conducted on three test pieces. The mean value is determined from 12 measured values for three test pieces and the resulting mean value is converted in terms of 10 mm in width.

The measurement of adhesive strength of the surface of primary receptor or receiving material may also be conducted in the same manner as described above using the primary receptor or receiving material to be measured as the test plate.

The adhesive strength of the surface of electrophotographic light-sensitive element is more preferably not more than 50 g·f, and particularly preferably not more than 30 g·f.

Using such an electrophotographic light-sensitive element having the controlled adhesive strength, a transfer layer formed on the light-sensitive element is easily and entirely transferred together with a toner image onto a primary receptor.

While an electrophotographic light-sensitive element which has already the surface exhibiting the desired releasability can be employed in the present invention, it is also possible to cause a compound (S) containing at least a fluorine atom and/or a silicon atom to adsorb or adhere onto the surface of electrophotographic light-sensitive element for imparting the releasability thereto before the formation of transfer layer. Thus, conventional electrophotographic light-sensitive elements can be utilized without taking releasability of the surface thereof into consideration.

Further, when the releasability of the surface of electrophotographic light-sensitive element tends to decrease during repeated use of the light-sensitive element having the surface releasability according to the present invention, the method for adsorbing or adhering a compound (S) can be applied. By the method, the releasability of light-sensitive element is easily maintained.

The impartation of releasability onto the surface of electrophotographic light-sensitive element is preferably carried out in an apparatus for preparation of a printing plate precursor, and specifically a means for causing the compound (S) to adsorb or adhere onto the surface of electrophotographic light-sensitive element is further provided in the apparatus for preparation of a printing plate precursor as described above.

In order to obtain an electrophotographic light-sensitive element having a surface of the releasability, there are a method of selecting an electrophotographic light-sensitive element previously having such a surface of the releasability (first method), a method of imparting the releasability to a surface of electrophotographic light-sensitive element conventionally employed by causing a compound (S) for imparting releasability to adsorb or adhere onto the surface of electrophotographic light-sensitive element (second method), and a method wherein the impartation of releasability to the surface of an electrophotographic light-sensitive element and the formation of transfer layer is conducted simultaneously by an electrocoating method using a dispersion containing grains of resin (A) and a compound (S) for imparting releasability (third method).

Suitable examples of the light-sensitive elements previously having the surface of releasability used in the first method include those employing a photoconductive substance which is obtained by modifying a surface of amorphous silicon to exhibit the releasability.

For the purpose of modifying the surface of electrophotographic light-sensitive element mainly containing amorphous silicon to have the releasability, there is a method of treating a surface of amorphous silicon with a coupling agent containing a fluorine atom and/or a silicon atom (for example, a silane coupling agent or a titanium coupling agent) as described, for example, in JP-A-55-89844, JP-A-4-231318, JP-A-60-170860, JP-A-59-102244 and JP-A-60-17750 (the term "JP-A" as used herein means an "unexamined published Japanese patent application"). Also, a method of adsorbing and fixing the compound (S) according to the present invention, particularly a releasing agent containing a component having a fluorine atom and/or a silicon atom as a substituent in the form of a block (for example, a polyether-, carboxylic acid-, amino group- or carbinol-modified polydialkylsilicone) as described in detail below can be employed.

Further, another example of the light-sensitive elements previously having the surface of releasability is an electrophotographic light-sensitive element containing a polymer having a polymer component containing a fluorine atom and/or a silicon atom in the region near to the surface thereof.

The term "region near to the surface of electrophotographic light-sensitive element" used herein means the uppermost layer of the light-sensitive element and includes an overcoat layer provided on a photoconductive layer and the uppermost photoconductive layer. Specifically, an overcoat layer is provided on the light-sensitive element having a photosensitive layer as the uppermost layer which contains the above-described polymer to impart the releasability, or the above-described polymer is incorporated into the uppermost layer of a photoconductive layer (including a single photoconductive layer and a laminated photoconductive layer) to modify the surface thereof so as to exhibit the releasability.

In order to impart the releasability to the overcoat layer or the uppermost photoconductive layer, a polymer containing a silicon atom and/or a fluorine atom is used as a binder resin of the layer. It is preferred to use a small amount of a block copolymer containing a polymer segment comprising a silicon atom and/or fluorine atom-containing polymer component described in detail below (hereinafter referred to as a surface-localized type copolymer sometimes) in combination with other binder resins. Further, such polymers containing a silicon atom and/or a fluorine atom are employed in the form of grains.

In the case of providing an overcoat layer, it is preferred to use the above-described surface-localized type block copolymer together with other binder resins of the layer for maintaining sufficient adhesion between the overcoat layer and the photoconductive layer. The surface-localized type copolymer is ordinarily used in a proportion of from 0.1 to 20 parts by weight per 100 parts by weight of the total composition of the overcoat layer.

Specific examples of the overcoat layer include a protective layer which is a surface layer provided on the light-sensitive element for protection known as one means for ensuring durability of the surface of a light-sensitive element for a plain paper copier (PPC) using a dry toner against repeated use. For instance, techniques relating to a protective layer using a silicon type block copolymer are described, for example, in JP-A-61-95358, JP-A-55-83049, JP-A-62-87971, JP-A-61-189559, JP-A-62-75461, JP-A-62-139556, JP-A-62-139557, and JP-A-62-208055. Techniques relating to a protective layer using a fluorine type block copolymer are described, for example, in JP-A-61-116362, JP-A-61- 117563, JP-A-61-270768, and JP-A-62-14657. Techniques relating to a protecting layer using grains of a resin containing a fluorine-containing polymer component in combination with a binder resin are described in JP-A-63-249152 and JP-A-63-221355.

On the other hand, the method of modifying the surface of the uppermost photoconductive layer so as to exhibit the releasability is effectively applied to a so-called disperse type light-sensitive element which contains at least a photoconductive substance and a binder resin.

Specifically, a layer constituting the uppermost layer of a photoconductive layer is made to contain either one or both of a block copolymer resin comprising a polymer segment containing a fluorine atom and/or silicon atom-containing polymer component as a block and resin grains containing a fluorine atom and/or silicon atom-containing polymer component, whereby the resin material migrates to the surface of the layer and is concentrated and localized there to have the surface imparted with the releasability. The copolymers and resin grains which can be used include those described in European Patent Application No. 534,479Al.

In order to further ensure surface localization, a block copolymer comprising at least one fluorine atom and/or fluorine atom-containing polymer segment and at least one polymer segment containing a photo- and/or heat-curable group-containing component as blocks can be used as a binder resin for the overcoat layer or the photoconductive layer. Examples of such polymer segments containing a photo- and/or heat-curable group-containing component are described in European Patent Application No. 534,479Al. Alternatively, a photo- and/or heat-curable resin may be used in combination with the fluorine atom and/or silicon atom-containing resin in the present invention.

The polymer comprising a polymer component containing a fluorine atom and/or a silicon atom effectively used for modifying the surface of the electrophotographic light-sensitive element according to the present invention include a resin (hereinafter referred to as resin (P) sometimes) and resin grains (hereinafter referred to as resin grains (PL) sometimes).

Where the polymer containing a fluorine atom and/or silicon atom-containing polymer component used in the present invention is a random copolymer, the content of the fluorine atom and/or silicon atom-containing polymer component is preferably at least 60% by weight, and more preferably at least 80% by weight based on the total polymer component.

In a preferred embodiment, the above-described polymer is a block copolymer comprising at least one polymer segment ($\alpha$) containing at least 50% by weight of a fluorine atom and/or silicon atom-containing polymer component and at least one polymer segment ($\beta$) containing 0 to 20% by weight of a fluorine atom and/or silicon atom-containing polymer component, the polymer segments ($\alpha$) and ($\beta$) being bonded in the form of blocks. More preferably, the polymer segment ($\beta$) of the block copolymer contains at least one polymer component containing at least one photo- and/or heat-curable functional group.

It is preferred that the polymer segment ($\beta$) does not contain any fluorine atom and/or silicon atom-containing polymer component.

As compared with the random copolymer, the block copolymer comprising the polymer segments ($\alpha$) and ($\beta$) (surface-localized type copolymer) is more effective not only for improving the surface releasability but also for maintaining such releasability.

More specifically, where a film is formed in the presence of a small amount of the resin or resin grains of copolymer containing a fluorine atom and/or a silicon atom, the resins (P) or resin grains (PL) easily migrate to the surface portion of the film and are localized in situ by the end of a drying step of the film to thereby modify the film surface so as to exhibit the releasability Where the resin (P) is the block copolymer in which the fluorine atom and/or silicon atom-containing polymer segment ($\alpha$) exists as a block, the other polymer segment ($\beta$) containing no, or if any a small proportion of, fluorine atom and/or silicon atom-containing polymer component undertakes sufficient interaction with the film-forming binder resin since it has good compatibility therewith. Thus, during the formation of transfer layer on the light-sensitive element, further migration of the resin into the transfer layer is inhibited or prevented by an anchor effect to form and maintain the definite interface between the transfer layer and the photoconductive layer.

Further, where the segment ($\beta$) of the block copolymer contains a photo- and/or heat-curable group, crosslinking between the polymer molecules takes place during the film formation to thereby ensure retention of the releasability at the interface of the light-sensitive element.

The above-described polymer may be used in the form of resin grains as described above. Preferred resin grains (PL) are resin grains dispersible in a non-aqueous solvent. Such resin grains include a block copolymer comprising a non-aqueous solvent-insoluble polymer segment (α) which contains a fluorine atom and/or silicon atom-containing polymer component and a non-aqueous solvent-soluble polymer segment (β) which contains no, or if any not more than 20% of, fluorine atom and/or silicon atom-containing polymer component.

Where the resin grains according to the present invention are used in combination with a binder resin, the insolubilized polymer segment (α) undertakes migration of the grains to the surface portion and is localized in situ while the soluble polymer segment (β) exerts an interaction with the binder resin (an anchor effect) similarly to the above-described resin. When the resin grains contain a photo- and/or heat-curable group, further migration of the grains to the transfer layer can be avoided.

The moiety having a fluorine atom and/or a silicon atom contained in the resin (P) or resin grains (PL) includes that incorporated into the main chain of the polymer and that contained as a substituent in the side chain of the polymer.

The fluorine atom-containing moieties include monovalent or divalent organic residues, for example, $-C_hF_{2h+1}$ (wherein h represents an integer of from 1 to (22), $-(CF_2)_jCF_2H$ (wherein j represents an integer of from 1 to 17),

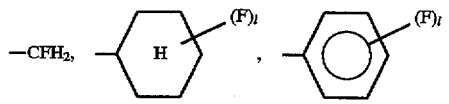

(wherein l represents an integer of from 1 to 5), $-CF_2-$, $-CFH-$,

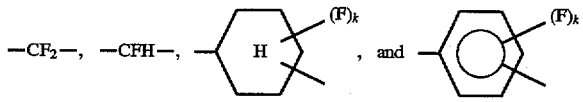

(wherein k represents an integer of from 1 to 4).

The silicon atom-containing moieties include monovalent or divalent organic residues, for example,

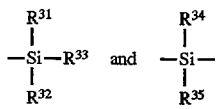

wherein $R^{31}$, $R^{32}$, $R^{33}$, $R^{34}$, and $R^{35}$, which may be the same or different, each represents a hydrocarbon group which may be substituted or $-OR^{36}$ wherein $R^{36}$ represents a hydrocarbon group which may be substituted.

The hydrocarbon group represented by $R^{31}$, $R^{32}$, $R^{33}$, $R^{34}$, $R^{35}$ or $R^{36}$ include specifically an alkyl group having from 1 to 18 carbon atoms which may be substituted (e.g., methyl, ethyl, propyl, butyl, hexyl, octyl, decyl, dodecyl, hexadecyl, 2-chloroethyl, 2-bromoethyl, 2,2,2-trifluoroethyl, 2-cyanoethyl, 3,3,3-trifluoropropyl, 2-methoxyethyl, 3-bromopropyl, 2-methoxycarbonylethyl, or 2,2,2,2',2',2'-hexafluoroisopropyl), an alkenyl group having from 4 to 18 carbon atoms which may be substituted (e.g., 2-methyl-1-propenyl, 2-butenyl, 2-pentenyl, 3-methyl-2-pentenyl, 1-pentenyl, 1-hexenyl, 2-hexenyl, or 4-methyl-2-hexenyl), an aralkyl group having from 7 to 12 carbon atoms which may be substituted (e.g., benzyl, phenethyl, 3-phenylpropyl, naphthylmethyl, 2-naphthylethyl, chlorobenzyl, bromobenzyl, methylbenzyl, ethylbenzyl, methoxybenzyl, dimethylbenzyl, or dimethoxybenzyl), an alicyclic group having from 5 to 8 carbon atoms which may be substituted (e.g., cyclohexyl, 2-cyclohexylethyl, or 2-cyclopentylethyl), or an aromatic group having from 6 to 12 carbon atoms which may be substituted (e.g., phenyl, naphthyl, tolyl, xylyl, propylphenyl, butylphenyl, octylphenyl, dodecylphenyl, methoxyphenyl, ethoxyphenyl, butoxyphenyl, decyloxyphenyl, chlorophenyl, dichlorophenyl, bromophenyl, cyanophenyl, acetylphenyl, methoxycarbonylphenyl, ethoxycarbonylphenyl, butoxycarbonylphenyl, acetamidophenyl, propionamidophenyl, or dodecyloylamidophenyl).

The fluorine atom and/or silicon atom-containing organic residue may be composed of a combination thereof. In such a case, they may be combined either directly or via a linking group. The linking groups include divalent organic residues, for example, divalent aliphatic groups, divalent aromatic groups, and combinations thereof, which may or may not contain a bonding group, e.g.,

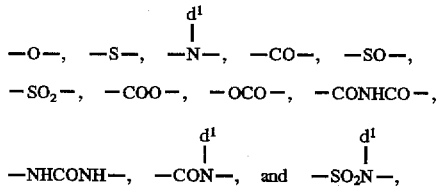

wherein $d^1$ has the same meaning as $R^{31}$ above.

Examples of the divalent aliphatic groups are shown below.

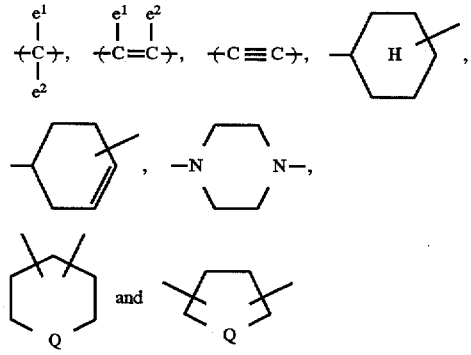

wherein $e^1$ and $e^2$, which may be the same or different, each represents a hydrogen atom, a halogen atom (e.g., chlorine or bromine) or an alkyl group having from 1 to 12 carbon atoms (e.g., methyl, ethyl, propyl, chloromethyl, bromomethyl, butyl, hexyl, octyl, nonyl or decyl); and Q represents

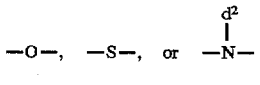

wherein $d^2$ represents an alkyl group having from 1 to 4 carbon atoms, $-CH_2Cl$, or $-CH_2Br$.

Examples of the divalent aromatic groups include a benzene ring, a naphthalene ring, and a 5- or 6-membered heterocyclic ring having at least one hetero atom selected from an oxygen atom, a sulfur atom and a nitrogen atom. The aromatic groups may have a substituent, for example, a halogen atom (e.g., fluorine, chlorine or bromine), an alkyl group having from 1 to 8 carbon atoms (e.g., methyl, ethyl, propyl, butyl, hexyl or octyl) or an alkoxy group having from 1 to 6 carbon atoms (e.g., methoxy, ethoxy, propoxy or butoxy). Examples of the heterocyclic ring include a furan ring, a thiophene ring, a pyridine ring, a piperazine ring, a tetrahydrofuran ring, a pyrrole ring, a tetrahydropyran ring, and a 1,3-oxazoline ring.

Specific examples of the repeating units having the fluorine atom and/or silicon atom-containing moiety as described above are set forth below, but the present invention should not be construed as being limited thereto. In formulae (F-1) to (F-32) below, Rf represents any one of the following groups of from (1) to (11); and b represents a hydrogen atom or a methyl group.

$-C_nF_{2n+1}$ (1)

$-CH_2C_nF_{2n+1}$ (2)

$-CH_2CH_2C_nF_{2n+1}$ (3)

$-CH_2(CF_2)_mCFHCF_3$ (4)

$-CH_2CH_2(CF_2)_mCFHCF_3$ (5)

$-CH_2CH_2(CF_2)_mCFHCF_2H$ (6)

$-CH_2(CF_2)_mCFHCF_2H$ (7)

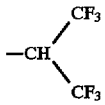

(8)

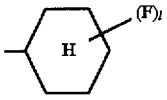

(9)

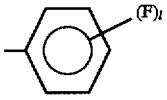

(10)

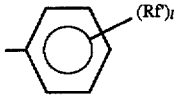

(11)

wherein Rf' represents any one of the above-described groups of from (1) to (8); n represents an integer of from 1 to 18; m represents an integer of from 1 to 18; and, Z represents an integer of from 1 to 5.

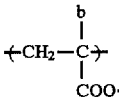

(F-1)

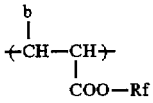

(F-2)

-continued

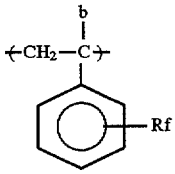

(F-3)

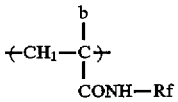

(F-4)

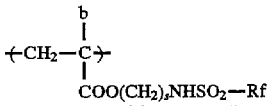

(F-5)

(s: an interger of from 1 to 12)

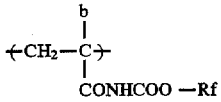

(F-6)

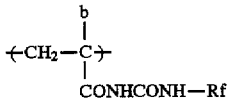

(F-7)

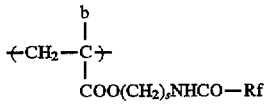

(F-8)

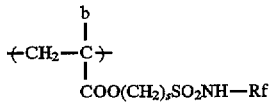

(F-9)

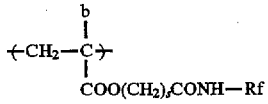

(F-10)

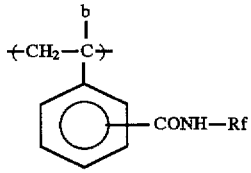

(F-11)

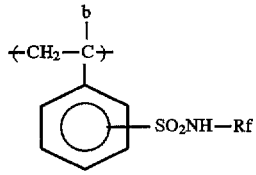

(F-12)

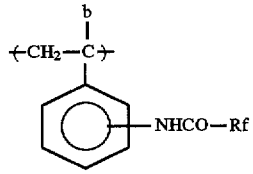

(F-13)

-continued (F-14)

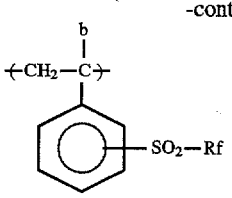

(F-15)

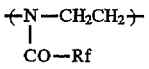

(F-16)

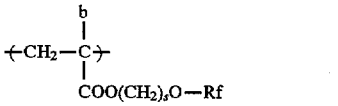

(F-17)

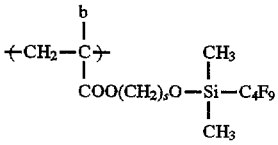

(F-18)

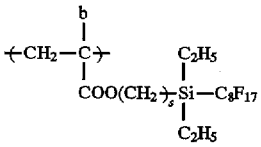

(F-19)

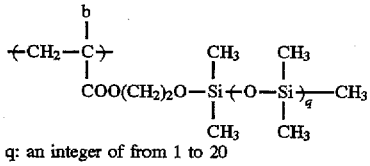

q: an integer of from 1 to 20

(F-20)

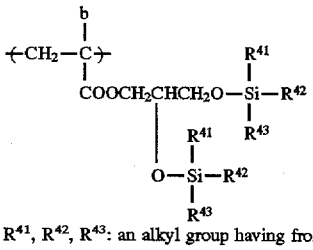

$R^{41}$, $R^{42}$, $R^{43}$: an alkyl group having from 1 to 12 carbon atoms (F-21)

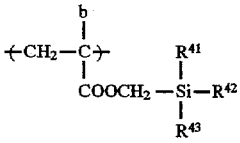

(F-22)

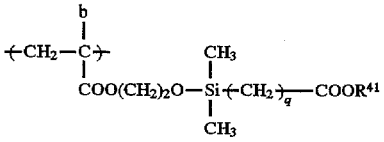

(F-23)

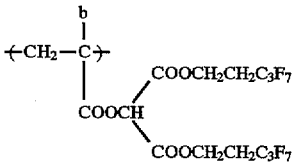

-continued (F-24)

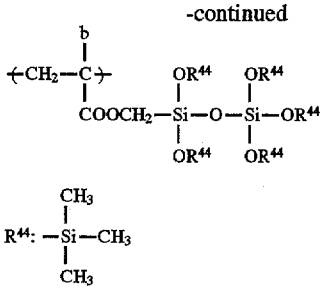

(F-25)

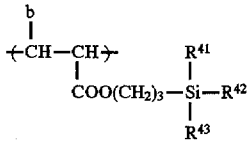

(F-26)

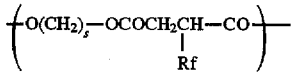

(F-27)

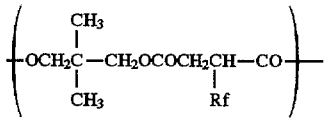

(F-28)

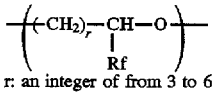

r: an integer of from 3 to 6

(F-29)

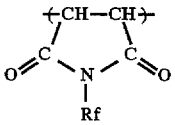

(F-30)

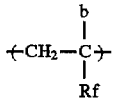

(F-31)

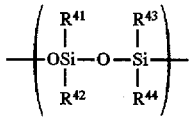

(F-32)

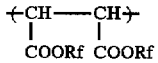

Of the resins (P) and resin grains (PL) each containing silicon atom and/or fluorine atom used in the present invention, the so-called surface-localized type copolymers will be described in detail below.

The content of the silicon atom and/or fluorine atom-containing polymer component in the segment (α) is at least 50% by weight, preferably at least 70% by weight, and more preferably at least 80% by weight. The content of the fluorine atom and/or silicon atom-containing polymer component in the segment (β) is not more than 20% by weight, and preferably 0% by weight.

A weight ratio of segment (α):segment (β) ranges usually from 1:99 to 95:5, and preferably from 5:95 to 90:10. In the range described above, the good migration effect and anchor effect of the resin (P) or resin grain (PL) at the surface region of light-sensitive element are obtained.

The resin (P) preferably has a weight average molecular weight of from $5\times10^3$ to $1\times10^6$, and more preferably from $1\times10^4$ to $5\times10^5$. The segment (α) in the resin (P) preferably has a weight average molecular weight of at least $1\times10^3$.

The resin grain (PL) preferably has an average grain diameter of from 0.001 to 1 μm, and more preferably from 0.05 to 0.5 μm.

A preferred embodiment of the surface-localized type copolymer in the resin (P) according to the present invention will be described below. Any type of the block copolymer can be used as far as the fluorine atom and/or silicon atom-containing polymer component is contained as a block. The term "to be contained as a block" means that the polymer has the polymer segment (α) containing at least 50% by weight of the fluorine atom and/or silicon atom-containing polymer component. The forms of blocks include an A-B type block, an A-B-A type block, a B-A-B type block, a graft type block, and a starlike type block as schematically illustrated below.

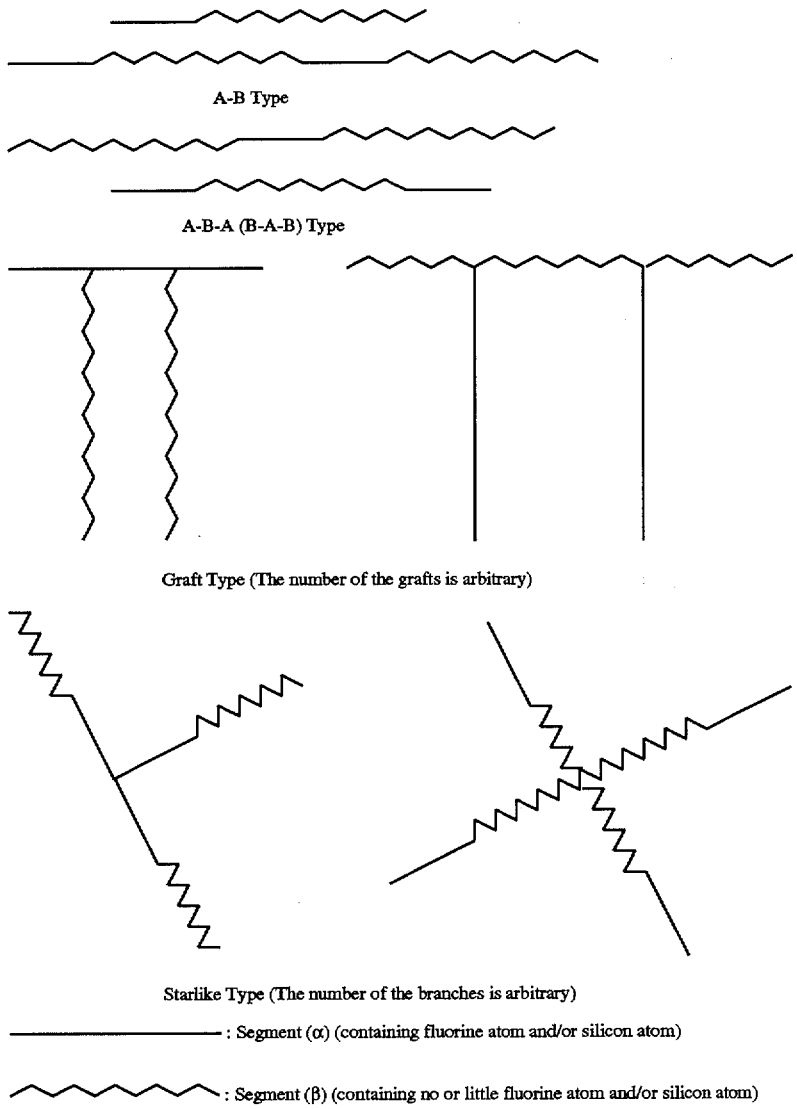

These various types of block copolymers (P) can be synthesized in accordance with conventionally known polymerizing methods. Useful methods are described, e.g., in W. J. Burlant and A. S. Hoffman, *Block and Graft Polymers*, Reuhold (1986), R. J. Cevesa, *Block and Graft Copolymers*, Butterworths (1962), D. C. Allport and W. H. James, *Block Copolymers*, Applied Sci. (1972), A. Noshay and J. E. McGrath, *Block Copolymers*, Academic Press (1977), G. Huvtreg, D. J. Wilson, and G. Riess, *NATO ASIser. SerE.*, Vol. 1985, p. 149, and V. Perces, *Applied Polymer Sci.*, Vol. 285, p. 95 (1985).

For example, ion polymerization reactions using an organometallic compound (e.g., an alkyl lithium, lithium diisopropylamide, an alkali metal alcoholate, an alkylmagnesium halide, or an alkylaluminum halide) as a polymerization initiator are described, for example, in T. E. Hogeu-Esch and J. Smid, *Recent Advances in Anion Polymerization*, Elsevier (New York) (1987), Yoshio Okamoto, *Kobunshi*, Vol. 38, P. 912 (1989), Mitsuo Sawamoto, *Kobunshi*, Vol. 38, p. 1018 (1989), Tadashi Narita, *Kobunshi*, Vol. 37, p. 252 (1988), B. C. Anderson, et al., *Macromolecules*, Vol. 14, p. 1601 (1981), and S. Aoshima and T. Higasimura, *Macromolecules*, Vol. 22, p. 1009 (1989).

Ion polymerization reactions using a hydrogen iodide/iodine system are described, for example, in T. Higashimura, et al., *Macromol. Chem., Macromol. Symp.*, Vol. 13/14, p.

457 (1988), and Toshinobu Higashimura and Mitsuo Sawamoto, *Kobunshi Ronbunshu*, Vol. 46, p. 189 (1989).

Group transfer polymerization reactions are described, for example, in D. Y. Sogah, et al., *Macromolecules*, Vol. 20, p. 1473 (1987), O. W. Webster and D. Y. Sogah, *Kobunshi*, Vol. 36, p. 808 (1987), M. T. Reetg, et al., *Angew. Chem. Int. Ed. Engl.*, Vol. 25, p. 9108 (1986), and JP-A-63-97609.

Living polymerization reactions using a metalloporphyrin complex are described, for example, in T. Yasuda, T. Aida, and S. Inoue, *Macromolecules*, Vol. 17, p. 2217 (1984), M. Kuroki, T. Aida, and S. Inoue, *J. Am. Chem. Soc.*, Vol. 109, p. 4737 (1987), M. Kuroki, et al., *Macromolecules*, Vol. 21, p. 3115 (1988), and M. Kuroki and I. Inoue, *Yuki Gosei Kagaku*, Vol. 47, p. 1017 (1989).

Ring-opening polymerization reactions of cyclic compounds are described, for example, in S. Kobayashi and T. Saegusa, *Ring Opening Polymerization*, Applied Science Publishers Ltd. (1984), W. Seeliger, et al., *Angew. Chem. Int. Ed. Engl.*, Vol. 5, p. 875 (1966), S. Kobayashi, et al., *Poly. Bull.*, Vol. 13, p. 447 (1985), and Y. Chujo, et al., *Macromolecules*, Vol. 22, p. 1074 (1989).

Photo living polymerization reactions using a dithiocarbamate compound or a xanthate compound, as an initiator are described, for example, in Takayuki Otsu, *Kobunshi*, Vol. 37, p. 248 (1988), Shun-ichi Himori and Koichi Otsu, *Polymer Rep. Jap.*, Vol. 37, p. 3508 (1988), JP-A-64-111, JP-A-64-26619, and M. Niwa, *Macromolecules*, Vol. 189, p. 2187 (1988).

Radical polymerization reactions using a polymer containing an azo group or a peroxide group as an initiator to synthesize block copolymers are described, for example, in Akira Ueda, et al., *Kobunshi Ronbunshu*, Vol. 33, p. 931 (1976), Akira Ueda, *Osaka Shiritsu Kogyo Kenkyusho Hokoku*, Vol. 84 (1989), O. Nuyken, et al., *Macromol. Chem., Rapid. Commun.*, Vol. 9, p. 671 (1988), and Ryohei Oda, *Kagaku to Kogyo*, Vol. 61, p. 43 (1987).

Syntheses of graft type block copolymers are described in the above-cited literature references and, in addition, Fumio Ide, *Graft Jugo to Sono Oyo*, Kobunshi Kankokai (1977), and Kobunshi Gakkai (ed.), *Polymer Alloy*, Tokyo Kagaku Dojin (1981). For example, known grafting techniques including a method of grafting of a polymer chain by a polymerization initiator, an actinic ray (e.g., radiant ray, electron beam), or a mechano-chemical reaction; a method of grafting with chemical bonding between functional groups of polymer chains (reaction between polymers); and a method of grafting comprising a polymerization reaction of a macromonomer may be employed.

The methods of grafting using a polymer are described, for example, in T. Shiota, et al., *J. Appl. Polym. Sci.*, Vol. 13, p. 2447 (1969), W. H. Buck, *Rubber Chemistry and Technology*, Vol. 50, p. 109 (1976), Tsuyoshi Endo and Tsutomu Uezawa, *Nippon Secchaku Kyokaishi*, Vol. 24, p. 323 (1988), and Tsuyoshi Endo, ibid., Vol. 25, p. 409 (1989).

The methods of grafting using a macromonomer are described, for example, in P. Dreyfuss and R. P. Quirk, *Encycl. Polym. Sci. Eng.*, Vol. 7, p. 551 (1987), P. F. Rempp and E. Franta, *Adv. Polym. Sci.*, Vol. 58, p. 1 (1984), V. Percec, *Appl. Poly. Sci.*, Vol. 285, p. 95 (1984), R. Asami and M. Takari, *Macromol. Chem. Suppl.*, Vol. 12, p. 163 (1985), P. Rempp, et al., *Macromol. Chem. Suppl.*, Vol. 8, p. 3 (1985), Katsusuke Kawakami, *Kagaku Kogyo*, Vol. 38, p. 56 (1987), Yuya Yamashita, *Kobunshi*, Vol. 31, p. 988 (1982), Shiro Kobayashi, *Kobunshi*, Vol. 30, p. 625 (1981), Toshinobu Higashimura, *Nippon Secchaku Kyokaishi*, Vol. 18, p. 536 (1982), Koichi Itoh, *Kobunshi Kako*, Vol. 35, p. 262 (1986), Takashiro Azuma and Takashi Tsuda, *Kino Zairyo*, Vol. 1987, No. 10, p. 5, Yuya Yamashita (ed.), *Macromonomer no Kagaku to Kogyo*, I.P.C. (1989), Tsuyoshi Endo (ed.), *Atarashii Kinosei Kobunshi no Bunshi Sekkei*, Ch. 4, C.M.C. (1991), and Y. Yamashita, et al., *Polym. Bull.*, Vol. 5, p. 361 (1981).

Syntheses of starlike block copolymers are described, for example, in M. T. Reetz, *Angew. Chem. Int. Ed. Engl.*, Vol. 27, p. 1373 (1988), M. Sgwarc, *Carbanions, Living Polymers and Electron Transfer Processes*, Wiley (New York) (1968), B. Gordon, et al., *Polym. Bull.*, Vol. 11, p. 349 (1984), R. B. Bates, et al., *J. Org. Chem.*, Vol. 44, p. 3800 (1979), Y. Sogah, *A.C.S. Polym. Rapr.*, Vol. 1988, No. 2, p. 3, J. W. Mays, *Polym. Bull.*, Vol. 23, p. 247 (1990), I. M. Khan et al., *Macromolecules*, Vol. 21, p. 2684 (1988), A. Morikawa, *Macromolecules*, Vol. 24, p. 3469 (1991), Akira Ueda and Toru Nagai, *Kobunshi*, Vol. 39, p. 202 (1990), and T. Otsu, *Polymer Bull.*, Vol. 11, p. 135 (1984).

While reference can be made to known techniques described in the literatures cited above, the method for synthesizing the block copolymers (P) according to the present invention is not limited to these methods.

A preferred embodiment of the resin grains (PL) according to the present invention will be described below. As described above, the resin grains (PL) preferably comprises the fluorine atom and/or silicon atom-containing polymer segment (α) insoluble in a non-aqueous solvent and the polymer segment (β) which is soluble in a non-aqueous solvent and contains substantially no fluorine atom and/or silicon atom. The polymer segment (α) constituting the insoluble portion of the resin grain (PL) may have a crosslinked structure.

Preferred methods for synthesizing the resin grains (PL) include the non-aqueous dispersion polymerization method described hereinafter with respect to non-aqueous solvent-dispersed resin grains.

The non-aqueous solvents which can be used in the preparation of the non-aqueous solvent-dispersed resin grains include any organic solvents having a boiling point of not more than 200° C., either individually or in combination of two or more thereof. Specific examples of such organic solvents include alcohols such as methanol, ethanol, propanol, butanol, fluorinated alcohols and benzyl alcohol, ketones such as acetone, methyl ethyl ketone, cyclohexanone and diethyl ketone, ethers such as diethyl ether, tetrahydrofuran and dioxane, carboxylic acid esters such as methyl acetate, ethyl acetate, butyl acetate and methyl propionate, aliphatic hydrocarbons containing from 6 to 14 carbon atoms such as hexane, octane, decane, dodecane, tridecane, cyclohexane and cyclooctane, aromatic hydrocarbons such as benzene, toluene, xylene and chlorobenzene, and halogenated hydrocarbons such as methylene chloride, dichloroethane, tetrachloroethane, chloroform, methylchloroform, dichloropropane and trichloroethane. However, the present invention should not be construed as being limited thereto.

Dispersion polymerization in such a non-aqueous solvent system easily results in the production of mono-dispersed resin grains having an average grain diameter of not greater than 1 μm with a very narrow size distribution.

More specifically, a monomer corresponding to the polymer component constituting the segment (α) (hereinafter referred to as a monomer (a)) and a monomer corresponding to the polymer component constituting the segment (β) (hereinafter referred to as a monomer (b)) are polymerized by heating in a non-aqueous solvent capable of dissolving a monomer (a) but incapable of dissolving the resulting polymer in the presence of a polymerization initiator, for example, a peroxide (e.g., benzoyl peroxide or lauroyl peroxide), an azobis compound (e.g., azobisisobutyronitrile or azobisisovaleronitrile), or an organometallic compound (e.g., butyl lithium). Alternatively, a monomer (a) and a polymer comprising the segment (β) (hereinafter referred to as a polymer (Pβ)) are polymerized in the same manner as described above.

The inside of the polymer grain (PL) according to the present invention may have a crosslinked structure. The formation of crosslinked structure can be conducted by any of conventionally known techniques. For example, (i) a method wherein a polymer containing the polymer segment (α) is crosslinked in the presence of a crosslinking agent or a curing agent; (ii) a method wherein at least the monomer (a) corresponding to the polymer segment (α) is polymerized in the presence of a polyfunctional monomer or oligomer containing at least two polymerizable functional groups to form a network structure over molecules; or (iii) a method wherein the polymer segment (α) and a polymer containing a reactive group-containing polymer component are subjected to a polymerization reaction or a polymer reaction to cause crosslinking may be employed.

The crosslinking agents to be used in the method (i) include those commonly employed as described, e.g., in Shinzo Yamashita and Tosuke Kaneko (ed.), *Kakyozai Handbook*, Taiseisha (1981) and Kobunshi Gakkai (ed.), *Kobunshi Data Handbook* (Kiso-hen), Baifukan (1986).

Specific examples of suitable crosslinking agents include organosilane compounds known as silane coupling agents (e.g., vinyltrimethoxysilane, vinyltributoxysilane, γ-glycidoxypropyltrimethoxysilane, γ-mercaptopropyltriethoxysilane, and γ-aminopropyltriethoxysilane), polyisocyanate compounds (e.g., toluylene diisocyanate, diphenylmethane diisocyanate, triphenylmethane triisocyanate, polymethylenepolyphenyl isocyanate, hexamethylene diisocyanate, isophorone diisocyanate, and polymeric polyisocyanates), polyol compounds (e.g., 1,4-butanediol, polyoxypropylene glycol, polyoxyethylene glycols, and 1,1,1-trimethylolpropane), polyamine compounds (e.g., ethylenediamine, γ-hydroxypropylated ethylenediamine, phenylenediamine, hexamethylenediamine, N-aminoethylpiperazine, and modified aliphatic polyamines), titanate coupling compounds (e.g., titanium tetrabutoxide, titanium tetrapropoxide, and isopropyltrisstearoyl titanate), aluminum coupling compounds (e.g., aluminum butylate, aluminum acetylacetate, aluminum oxide octate, and aluminum trisacetylacetate), polyepoxy group-containing compounds and epoxy resins (e.g., the compounds as described in Hiroshi Kakiuchi (ed.), *Shin-Epoxy Jushi*, Shokodo (1985) and Kuniyuki Hashimoto (ed.), *Epoxy Jushi*, Nikkan Kogyo Shinbunsha (1969)), melamine resins (e.g., the compounds as described in Ichiro Miwa and Hideo Matsunaga (ed.), *Urea•Melamine Jushi, Nikkan Kogyo Shinbunsha* (1969)), and poly(meth)acrylate compounds (e.g., the compounds as described in Shin Okawara, Takeo Saegusa, and Toshinobu Higashimura (ed.), *Oligomer*, Kodansha (1976), and Eizo Omori, *Kinosei Acryl-kei Jushi*, Techno System (1985)).

Specific examples of the polymerizable functional groups which are contained in the polyfunctional monomer or oligomer (the monomer will sometimes be referred to as a polyfunctional monomer (d)) having two or more polymerizable functional groups used in the method (ii) above include $CH_2{=}CH{-}CH_2{-}$, $CH_2{=}CH{-}CO{-}O{-}$, $CH_2{=}CH{-}$, $CH_2{=}C(CH_3){-}CO{-}O{-}$, $CH(CH_3){=}CH{-}CO{-}O{-}$, $CH_2{=}CH{-}CONH{-}$, $CH_2{=}C(CH_3){-}CONH{-}$, $CH(CH_3){=}CH{-}CONH{-}$, $CH_2{=}CH{-}O{-}CO{-}$, $CH_2{=}C(CH_3){-}O{-}CO{-}$, $CH_2{=}CH{-}CH_2{-}O{-}CO{-}$, $CH_2{=}CH{-}NHCO{-}$, $CH_2{=}CH{-}CH_2{-}NHCO{-}$, $CH_2{=}CH{-}SO_2{-}$, $CH_2{=}CH{-}CO{-}$, $CH_2{=}CH{-}O{-}$, and $CH_2{=}CH{-}S{-}$. The two or more polymerizable functional groups present in the polyfunctional monomer or oligomer may be the same or different.

Specific examples of the monomer or oligomer having the same two or more polymerizable functional groups include styrene derivatives (e.g., divinylbenzene and trivinylbenzene); methacrylic, acrylic or crotonic acid esters, vinyl ethers, or allyl ethers of polyhydric alcohols (e.g., ethylene glycol, diethylene glycol, triethylene glycol, polyethylene glycol 200, 400 or 600, 1,3-butylene glycol, neopentyl glycol, dipropylene glycol, polypropylene glycol, trimethylolpropane, trimethylolethane, and pentaerythritol) or polyhydric phenols (e.g., hydroquinone, resorcin, catechol, and derivatives thereof); vinyl esters, allyl esters, vinyl amides, or allyl amides of dibasic acids (e.g., malonic acid, succinic acid, glutaric acid, adipic acid, pimelic acid, maleic acid, phthalic acid, and itaconic acid); and condensation products of polyamines (e.g., ethylenediamine, 1,3-propylenediamine, and 1,4-butylenediamine) and vinyl-containing carboxylic acids (e.g., methacrylic acid, acrylic acid, crotonic acid, and allylacetic acid).

Specific examples of the monomer or oligomer having two or more different polymerizable functional groups include reaction products between vinyl group-containing carboxylic acids (e.g., methacrylic acid, acrylic acid, methacryloylacetic acid, acryloylacetic acid, methacryloylpropionic acid, acryloylpropionic acid, itaconyloylacetic acid, itaconyloylpropionic acid, and a carboxylic acid anhydride) and alcohols or amines, vinyl group-containing ester derivatives or amide derivatives (e.g., vinyl methacrylate, vinyl acrylate, vinyl itaconate, allyl methacrylate, allyl acrylate, allyl itaconate, vinyl methacryloylacetate, vinyl methacryloylpropionate, allyl methacryloylpropionate, vinyloxycarbonylmethyl methacrylate, vinyloxycarbonylmethyloxycarbonylethylene acrylate, N-allylacrylamide, N-allylmethacrylamide, N-allylitaconamide, and methacryloylpropionic acid allylamide) and condensation products between amino alcohols (e.g., aminoethanol, 1-aminopropanol, 1-aminobutanol, 1-aminohexanol, and 2-aminobutanol) and vinyl group-containing carboxylic acids.

The monomer or oligomer containing two or more polymerizable functional groups is used in an amount of not more than 10 mol %, and preferably not more than 5 mol %, based on the total amount of monomer (a) and other monomers copolymerizable with monomer (a) to form the resin.

Where crosslinking between polymer molecules is conducted by the formation of chemical bonds upon the reaction of reactive groups in the polymers according to the method (iii), the reaction may be effected in the same manner as usual reactions of organic low-molecular weight compounds.

From the standpoint of obtaining mono-dispersed resin grains having a narrow size distribution and easily obtaining fine resin grains having a diameter of 0.5 μm or smaller, the method (ii) using a polyfunctional monomer is preferred for the formation of network structure. Specifically, a monomer (a), a monomer (b) and/or a polymer (Pβ) and, in addition, a polyfunctional monomer (d) are subjected to polymerization granulation reaction to obtain resin grains. Where the above-described polymer (Pβ) comprising the segment (β) is used, it is preferable to use a polymer (Pβ') which has a polymerizable double bond group copolymerizable with the monomer (a) in the side chain or at one terminal of the main chain of the polymer (Pβ).

The polymerizable double bond group is not particularly limited as far as it is copolymerizable with the monomer (a). Specific examples thereof include

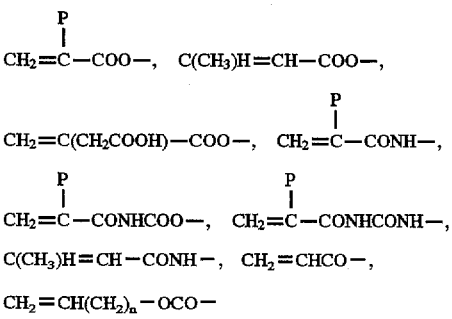

(wherein n represents 0 or an integer of from 1 to 3), $CH_2{=}CHO{-}$, and $CH_2{=}CH{-}C_6H_4{-}$, wherein p represents —H or —$CH_3$.

The polymerizable double bond group may be bonded to the polymer chain either directly or via a divalent organic residue. Specific examples of these polymers include those described, for example, in JP-A-61-43757, JP-A-1-257969, JP-A-2-74956, JP-A-1-282566, JP-A-2-173667, JP-A-3-15862, and JP-A-4-70669.

In the preparation of resin grains, the total amount of the polymerizable compounds used is from about 5 to about 80 parts by weight, preferably from 10 to 50 parts by weight, per 100 parts by weight of the non-aqueous solvent. The polymerization initiator is usually used in an amount of from 0.1 to 5% by weight based on the total amount of the polymerizable compounds. The polymerization is carried out at a temperature of from about 30° to about 180° C., and preferably from 40° to 120° C. The reaction time is preferably from 1 to 15 hours.

Now, an embodiment in which the resin (p) contains a photo- and/or heat-curable group or the resin (P) is used in combination with a photo- and/or heat-curable resin will be described below.

The polymer components containing at least one photo- and/or heat-curable group, which may be incorporated into the resin (P), include those described in the above-cited literature references. More specifically, the polymer components containing the above-described polymerizable functional group(s) can be used.

The content of the polymer component containing at least one photo- and/or heat-curable group ranges ordinarily from 1 to 95 parts by weight, preferably from 10 to 70 parts by weight, based on 100 parts by weight of the polymer segment (β) in the block copolymer (P) and the polymer component is preferably contained in the range of from 5 to 40 parts by weight per 100 parts by weight of the total polymer components in the block copolymer (P). When the photo- and/or heat-curable group-containing polymer component is present at least one part by weight based on 100 parts by weight of the polymer segment (β), curing of the photoconductive layer after film formation proceeds sufficiently, and thus the effect for improving the releasability of toner image can be obtained. On the other hand, in the event of using the polymer component up to 95 parts by weight based on 100 parts by weight of the polymer segment (β), good electrophotographic characteristics of the photoconductive layer are obtained and reduction in reproducibility of original in duplicated image and occurrence of background fog in non-image areas are avoided.

The photo- and/or heat-curable group-containing block copolymer (P) is preferably used in an amount of not more than 40% by weight based on the total binder resin. In the range described above, good electrophotographic characteristics are obtained.

The fluorine atom and/or silicon atom-containing resin may also be used in combination with a photo- and/or heat-curable resin (D) in the present invention. Any of conventionally known curable resins may be used as the photo- and/or heat-curable resin (D). For example, resins containing the curable group as described with respect to the block copolymer (P) may be used.

Further, conventionally known binder resins for an electrophotographic light-sensitive layer are employed. These resins are described, e.g., in Takaharu Shibata and Jiro Ishiwatari, *Kobunshi*, Vol. 17, p. 278 (1968), Harumi Miyamoto and Hidehiko Takei, *Imaging*, Vol. 1973, No. 8, Koichi Nakamura (ed.), *Kiroku Zairyoyo Binder no Jissai Gijutsu*, Ch. 10, C.M.C. (1985), Denshishashin Gakkai (ed.), *Denshishashinyo Yukikankotai no Genjo Symposium* (preprint) (1985), Hiroshi Kokado (ed.), *Saikin no Kododenzairyo to Kankotai no Kaihatsu•Jitsuyoka*, Nippon Kagaku Joho (1986), Denshishashin Gakkai (ed.), *Denshishashin Gijutsu no Kiso To Oyo*, Ch. 5, Corona (1988), D. Tatt and S. C. Heidecker, *Tappi*, Vol. 49, No. 10, p. 439 (1966), E. S. Baltazzi and R. G. Blanchlotte, et al., *Photo. Sci. Eng.*, Vol. 16, No. 5, p. 354 (1972), and Nguyen Chank Keh, Isamu Shimizu and Eiichi Inoue, *Denshishashin Gakkaishi*, Vol. 18, No. 2, p. 22 (1980).

Specific examples of these known binder resins used include olefin polymers or copolymers, vinyl chloride copolymers, vinylidene chloride copolymers, vinyl alkanoate polymers or copolymers, allyl alkanoate polymers or copolymers, polymers or copolymers of styrene or derivatives thereof, butadiene-styrene copolymers, isoprene-styrene copolymers, butadiene-unsaturated carboxylic ester copolymers, acrylonitrile copolymers, methacrylonitrile copolymers, alkyl vinyl ether copolymers, acrylic ester polymers or copolymers, methacrylic ester polymers or copolymers, styrene-acrylic ester copolymers, styrene-methacrylic ester copolymers, itaconic diester polymers or copolymers, maleic anhydride copolymers, acrylamide copolymers, methacrylamide copolymers, hydroxy group-modified silicone resins, polycarbonate resins, ketone resins, polyester resins, silicone resins, amide resins, hydroxy group- or carboxy group-modified polyester resins, butyral resins, polyvinyl acetal resins, cyclized rubber-methacrylic ester copolymers, cyclized rubber-acrylic ester copolymers, copolymers containing a heterocyclic ring containing no nitrogen atom (the heterocyclic ring including furan, tetrahydrofuran, thiophene, dioxane, dioxofuran, lactone, benzofuran, benzothiophene and 1,3-dioxetane rings), and epoxy resins.

More specifically, reference can be made to Tsuyoshi Endo, *Netsukokasei Kobunshi no Seimitsuka*, C.M.C. (1986), Yuji Harasaki, *Saishin Binder Gijutsu Binran*, Ch. II-1, Sogo Gijutsu Center (1985), Takayuki Otsu, *Acryl Jushi no Gosei•Sekkei to Shinyoto Kaihatsu*, Chubu Kei-ei Kaihatsu Center Shuppanbu (1985), and Eizo Omori, *Kinosei Acryl-Kei Jushi*, Techno System (1985).

As described above, when the uppermost layer of light-sensitive element, for example, the overcoat layer or the photoconductive layer contains at least one binder resin (B) and at least one binder resin (P) for modifying the surface thereof, it is preferred that the layer further contains a small amount of photo- and/or heat-curable resin (D) and/or a crosslinking agent for further improving film curability.

The amount of photo- and/or heat-curable resin (D) and/or crosslinking agent to be added is preferably from 0.01 to 20% by weight, and more preferably from 0.1 to 15% by weight, based on the total amount of the binder resin (B) and the binder resin (P). In the range described above, the effect of improving film curability is obtained without adversely affecting the electrophotographic characteristics.

A combined use of a crosslinking agent is preferable. Any of ordinarily employed crosslinking agents may be utilized. Suitable crosslinking agents are described, e.g., in Shinzo Yamashita and Tosuke Kaneko (ed.), *Kakyozai Handbook*, Taiseisha (1981) and Kobunshi Gakkai (ed.), *Kobunshi Data Handbook* (*Kiso-hen*), Baifukan (1986). Specific examples of the crosslinking agents include the compounds described as the crosslinking agents above.

In addition, monomers containing a polyfunctional polymerizable group (e.g., vinyl methacrylate, acryl methacrylate, ethylene glycol diacrylate, polyethylene glycol diacrylate, divinyl succinate, divinyl adipate, diacryl succinate, 2-methylvinyl methacrylate, trimethylolpropane trimethacrylate, divinylbenzene, and pentaerythritol polyacrylate) may also be used as the crosslinking agent.

As described above, the uppermost layer of the light-sensitive element, i.e. a layer which will be in contact with a transfer layer, is preferably cured after film formation. It is preferred that the binder resin (B), the binder resin (P), the curable resin (D), and the crosslinking agent to be used in the uppermost layer are so selected and combined that their functional groups easily undergo chemical bonding to each other.

Combinations of functional groups which easily undergo a polymer reaction are well known. Specific examples of such combinations are shown in Table 1 below, wherein a functional group selected from Group A can be combined with a functional group selected from Group B. However, the present invention should not be construed as being limited thereto.

TABLE 1

| Group A | Group B |
|---|---|
| —COOH, —$PO_3H_2$, —OH, —SH, —$NH_2$, —NHR, —$SO_2H$ | 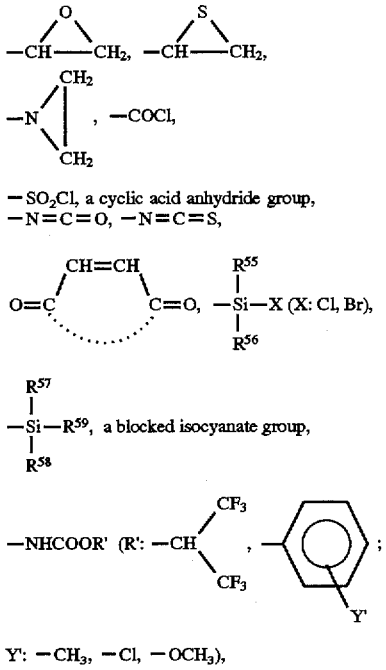 |

TABLE 1-continued

| Group A | Group B |
|---|---|
| | 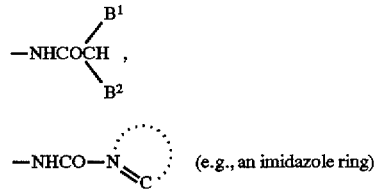 |

In Table 1, $R^{55}$ and $R^{56}$ each represents an alkyl group; $R^{57}$, $R^{58}$, and $R^{59}$ each represents an alkyl group or an alkoxy group, provided that at least one of them is an alkoxy group; R represents a hydrocarbon group; $B^1$ and $B^2$ each represent an electron attracting group, e.g., —CN, —$CF_3$, —$COR^{60}$, —$COOR^{60}$, —$SO_2OR^{60}$ ($R^{60}$ represents a hydrocarbon group, e.g., —$C_nH_{2n+1}$ (n: an integer of from 1 to 4), —$CH_2C_6H_5$, or —$C_6H_5$).

If desired, a reaction accelerator may be added to the binder resin for accelerating the crosslinking reaction in the light-sensitive layer.

The reaction accelerators which may be used for the crosslinking reaction forming a chemical bond between functional groups include organic acids (e.g., acetic acid, propionic acid, butyric acid, benzenesulfonic acid, and p-toluenesulfonic acid), phenols (e.g., phenol, chlorophenol, nitrophenol, cyanophenol, bromophenol, naphthol, and dichlorophenol), organometallic compounds (e.g., zirconium acetylacetonate, zirconium acetylacetone, cobalt acetylacetonate, and dibutoxytin dilaurate), dithiocarbamic acid compounds (e.g., diethyldithiocarbamic acid salts), thiuram disulfide compounds (e.g., tetramethylthiuram disulfide), and carboxylic acid anhydrides (e.g., phthalic anhydride, maleic anhydride, succinic anhydride, butylsuccinic anhydride, benzophenone-3,3',4,4'-tetracarboxylic acid dianhydride, and trimellitic anhydride).

The reaction accelerators which may be used for the crosslinking reaction involving polymerization include polymerization initiators, such as peroxides and azobis compounds.

After a coating composition for the light-sensitive layer is coated, the binder resin is preferably cured by light and/or heat. Heat curing can be carried out by drying under severer conditions than those for the production of a conventional light-sensitive element. For example, elevating the drying temperature and/or increasing the drying time may be utilized. After drying the solvent of the coating composition, the film is preferably subjected to a further heat treatment, for example, at 60° to 150° C. for 5 to 120 minutes. The conditions of the heat treatment may be made milder by using the above-described reaction accelerator in combination.

Curing of the resin containing a photo-curable functional group can be carried out by incorporating a step of irradiation of actinic ray into the production line according to the present invention. The actinic rays to be used include visible light, ultraviolet light, far ultraviolet light, electron beam, X-ray, γ-ray, and α-ray, with ultraviolet light being preferred. Actinic rays having a wavelength range of from 310 to 500 nm are more preferred. In general, a low-, high- or ultrahigh-pressure mercury lamp or a halogen lamp is employed as a light source. Usually, the irradiation treatment can be sufficiently performed at a distance of from 5 to 50 cm for 10 seconds to 10 minutes.

Now, the second method for obtaining an electrophotographic light-sensitive element having the surface of releasability by applying the compound (S) for imparting the desired releasability to the surface of a conventionally known electrophotographic light-sensitive element before the formation of transfer layer will be described in detail below.

The compound (S) is a compound containing a fluorine atom and/or a silicon atom. The compound (S) containing a moiety having a fluorine and/or silicon atom is not particularly limited in its structure as long as it can improve releasability of the surface of electrophotographic light-sensitive element, and includes a low molecular weight compound, an oligomer, and a polymer.

When the compound (S) is an oligomer or a polymer, the moiety having a fluorine and/or silicon atom includes that incorporated into the main chain of the oligomer or polymer and that contained as a substituent in the side chain thereof. Of the oligomers and polymers, those containing repeating units containing the moiety having a fluorine and/or silicon atom as a block are preferred since they adsorb on the surface of electrophotographic light-sensitive element to impart good releasability.

The fluorine atom and/or silicon atom-containing moieties include those described with respect to the resin (P) above.

Specific examples of the compound (S) containing a fluorine and/or silicon atom which can be used in the present invention include fluorine and/or silicon-containing organic compounds described, for example, in Tokiyuki Yoshida, et al. (ed.), *Shin-ban Kaimenkasseizai Handbook*, Kogaku Tosho (1987), Takao Karikome, *Saishin Kaimenkasseizai Oyo Gijutsu*, C.M.C. (1990), Kunio Ito (ed.), *Silicone Handbook*, Nikkan Kogyo Shinbunsha (1990), Takao Karikome, *Tokushukino Kaimenkasseizai*, C.M.C. (1986), and A. M. Schwartz, et al., *Surface Active Agents and Detergents*, Vol. II.

Further, the compound (S) according to the present invention can be synthesized by utilizing synthesis methods as described, for example, in Nobuo Ishikawa, *Fussokagobutsu no Gosei to Kino*, C.M.C. (1987), Jiro Hirano et al. (ed.), *Ganfussoyukikagobutsu— Sono Gosei to Oyo*, Gijutsu Joho Kokai (1991), and Mitsuo Ishikawa, *Yukikeiso Senryaku Shiryo*, Chapter 3, Science Forum (1991).

Specific examples of polymer components having the fluorine atom and/or silicon atom-containing moiety used in the oligomer or polymer include those described with respect to the resin (P) above.

When the compound (S) is a so-called block copolymer, the compound (S) may be any type of copolymer as long as it contains the fluorine atom and/or silicon atom-containing polymer components as a block. The term "to be contained as a block" means that the compound (S) has a polymer segment comprising at least 70% by weight of the fluorine atom and/or silicon atom-containing polymer component based on the weight of the polymer segment. The forms of blocks include an A-B type block, an A-B-A type block, a B-A-B type block, a graft type block, and a starlike type block as schematically illustrated with respect to the resin (P) above. These block copolymers can be synthesized according to the methods described with respect to the resin (P) above.

By the application of compound (S) onto the surface of electrophotographic light-sensitive element, the surface is modified to have the desired releasability. The term "application of compound (S) onto the surface of electrophotographic light-sensitive element" means that the compound is supplied on the surface of electrophotographic light-sensitive element to form a state wherein the compound (S) is adsorbed or adhered thereon.

In order to apply the compound (S) to the surface of electrophotographic light-sensitive element, conventionally known various methods can be employed. For example, methods using an air doctor coater, a blade coater, a knife coater, a squeeze coater, a dip coater, a reverse roll coater, a transfer roll coater, a gravure coater, a kiss roll coater, a spray coater, a curtain coater, or a calender coater as described, for example, in Yuji Harasaki, *Coating Kogaku*, Asakura Shoten (1971), Yuji Harasaki, *Coating Hoshiki*, Maki Shoten (1979), and Hiroshi Fukada, *Hot-melt Secchaku no Jissai* Kobunshi Kankokai (1979) can be used.

A method wherein cloth, paper or felt impregnated with the compound (S) is pressed on the surface of light-sensitive element, a method of pressing a curable resin impregnated with the compound (S), a method wherein the light-sensitive element is wetted with a non-aqueous solvent containing the compound (S) dissolved therein, and then dried to remove the solvent, and a method wherein the compound (S) dispersed in a non-aqueous solvent is migrated and adhered on the surface of light-sensitive element by electrophoresis according to a wet-type electrodeposition method as described hereinafter can also be employed.

Further, the compound (S) can be applied on the surface of light-sensitive element by utilizing a non-aqueous solvent containing the compound (S) according to an ink jet method, followed by drying. The ink jet method can be performed with reference to the descriptions in Shin Ohno (ed.), *Non-impact Printing*, C.M.C. (1986). More specifically, a Sweet process or Hartz process of a continuous jet type, a Winston process of an intermittent jet type, a pulse jet process of an ink on-demand type, a bubble jet process, and a mist process of an ink mist type are illustrated.

In any system, the compound (S) itself or diluted with a solvent is filled in an ink tank or ink head cartridge in place of an ink to use. The solution of compound (S) used ordinarily has a viscosity of from 1 to 10 cp and a surface tension of from 30 to 60 dyne/cm, and may contain a surface active agent, or may be heated if desired. Although a diameter of ink droplet is in a range of from 30 to 100 μm due to a diameter of an orifice of head in a conventional ink jet printer in order to reproduce fine letters, droplets of a larger diameter can also be used in the present invention. In such a case, an amount of jet of the compound (S) becomes large and thus a time necessary for the application can be shortened. Further, to use multiple nozzles is very effective to shorten the time for application.

When silicone rubber is used as the compound (S), it is preferred that silicone rubber is provided on a metal axis to cover and the resulting silicone rubber roller is directly pressed on the surface of electrophotographic light-sensitive element. In such a case, a nip pressure is ordinarily in a range of from 0.5 to 10 $Kgf/cm^2$ and a time for contact is ordinarily in a range of from 1 second to 30 minutes. Also, the light-sensitive element and/or silicone rubber roller may be heated up to a temperature of 150° C. According to this method, it is believed that a part of low molecular weight components contained in silicone rubber is moved from the silicone rubber roller onto the surface of light-sensitive element during the press. The silicone rubber may be swollen with silicone oil. Moreover, the silicone rubber may be a form of sponge and the sponge roller may be impregnated with silicone oil or a solution of silicone surface active agent.

The application method of the compound (S) is not particularly limited, and an appropriate method can be selected depending on a state (i.e., liquid, wax or solid) of the compound (S) used. A flowability of the compound (S) can be controlled using a heat medium, if desired.

The application of compound (S) is preferably performed by a means which is easily incorporated into an electrophotographic apparatus.

An amount of the compound (S) applied to the surface of electrophotographic light-sensitive element is not particularly limited and is adjusted in a range wherein the electrophotographic characteristics of light-sensitive element do not adversely affected in substance. Ordinarily, a thickness of the coating is sufficiently 1 μm or less. By the formation of weak boundary layer as defined in Bikerman, *The Science of Adhesive Joints*, Academic Press (1961), the releasability-imparting effect of the present invention can be obtained. Specifically, when an adhesive strength of the surface of an electrophotographic light-sensitive element to which the compound (S) has been applied is measured according to the method described above, the resulting adhesive strength is preferably not more than 100 gram·force.

In accordance with the present invention, the surface of electrophotographic light-sensitive element is provided with the desired releasability by the application of compound (S), and the light-sensitive element can be repeatedly employed as far as the releasability is maintained. Specifically, the application of compound (S) is not always necessarily whenever a series of steps for the preparation of a printing plate according to the present invention is repeated. The application may be suitably performed by an appropriate combination of a light-sensitive element, an ability of compound (S) for imparting the releasability and a means for the application.

The third method for obtaining an electrophotographic light-sensitive element having the surface of the desired releasability comprises conducting an electrodeposition coating method using a dispersion of resin grains for forming a transfer layer, to which a compound (S) exhibiting the desired releasability is added. According to the method, the dispersion for electrodeposition containing the compound (S) is subjected to electrodeposition on a conventionally known electrophotographic light-sensitive element, thereby providing the releasability on the surface of light-sensitive element as well as the formation of transfer layer.

More specifically, the dispersion for electrodeposition used comprises an electrically insulating organic solvent having a dielectric constant of not more than 3.5, grains of resin (A) dispersed therein and the compound (S) exhibiting the desired releasability.

The compound (S) present in the dispersion for electrodeposition is able to adhere to or adsorb on the surface of light-sensitive element before the electrodeposition of the grains of resin (A) on the surface of the light-sensitive element by electrophoresis and as a result, the light-sensitive element having the surface of desired releasability is obtained before the formation of transfer layer.

The compound (S) used is same as the compound (S) described in the second method above in substance. Of the compounds (S), those soluble at least 0.01 g per one liter of an electrically insulating organic solvent having a dielectric constant of not more than 3.5 used in the dispersion for electrodeposition at 25° C. are preferred.

The amount of compound (S) added to the dispersion for electrodeposition may by varied depending on the compound (S) and the electrically insulating organic solvent to be used. A suitable amount of the compound (S) is determined taking the effect to be obtained and adverse affects on electrophoresis of resin grains (e.g., decrease in electric resistance or increase in viscosity of the dispersion) into consideration. A preferred range of the compound (S) added is ordinarily from 0.01 to 20 g per one liter of the electrically insulating organic solvent used.

The construction and material used for the electrophotographic light-sensitive element according to the present invention are not particularly limited and any of those conventionally known can be employed.

Suitable examples of electrophotographic light-sensitive element used are described, for example, in R. M. Schaffert, *Electrophotography*, Forcal Press, London (1980), S. W. Ing, M. D. Tabak and W. E. Haas, *Electrophotography Fourth International Conference*, SPSE (1983), Isao Shinohara, Hidetoshi Tsuchida and Hideaki Kusakawa (ed.), *Kirokuzairyo to Kankoseijushi*, Gakkai Shuppan Center (1979), Hiroshi Kokado, *Kagaku to Kogyo*, Vol. 39, No. 3, p. 161 (1986), *Saikin no Kododen Zairyo to Kankotai no Kaihatsu•Jitsuyoka*, Nippon Kagaku Joho Shuppanbu (1986), Denshishashin Gakkai (ed.), *Denshishashin no Kiso to Oyo*, Corona (1986), and Denshishashin Gakkai (ed.), *Denshishashinyo Yukikankotai no Genjo Symposium* (preprint), (1985).

A photoconductive layer for the electrophotographic light-sensitive element which can be used in the present invention is not particularly limited, and any known photoconductive layer may be employed.

Specifically, the photoconductive layer includes a single layer made of a photoconductive compound itself and a photoconductive layer comprising a binder resin having dispersed therein a photoconductive compound. The dispersed type photoconductive layer may have a single layer structure or a laminated structure.

The photoconductive compounds used in the present invention may be inorganic compounds or organic compounds.

Inorganic photoconductive compounds used in the present invention include those conventionally known for example, zinc oxide, titanium oxide, zinc sulfide, cadmium sulfide, selenium, selenium-tellurium, amorphous silicon, lead sulfide. These compounds are used together with a binder resin to form a photoconductive layer, or they are used alone to form a photoconductive layer by vacuum deposition or spattering.

Where an inorganic photoconductive compound, e.g., zinc oxide or titanium oxide, is used, a binder resin is usually used in an amount of from 10 to 100 parts by weight, and preferably from 15 to 40 parts by weight, per 100 parts by weight of the inorganic photoconductive compound.

Organic photoconductive compounds used may be selected from conventionally known compounds. Suitable photoconductive layers containing an organic photoconductive compound include (i) a layer mainly comprising an organic photoconductive compound, a sensitizing dye, and a binder resin as described, e.g., in JP-B-37-17162, JP-B-62-51462, JP-A-52-2437, JP-A-54-19803, JP-A-56-107246, and JP-A-57-161863; (ii) a layer mainly comprising a charge generating agent, a charge transporting agent, and a binder resin as described, e.g., in JP-A-56-146145, JP-A-60-17751, JP-A-60-17752, JP-A-60-17760, JP-A-60-254142, and JP-A-62-54266; and (iii) a double-layered structure containing a charge generating agent and a charge transporting agent in separate layers as described, e.g., in JP-A-60-230147, JP-A-60-230148, and JP-A-60-238853.

The photoconductive layer of the electrophotographic light-sensitive element according to the present invention may have any of the above-described structure.

The organic photoconductive compounds which may be used in the present invention include (a) triazole derivatives described, e.g., in U.S. Pat. No. 3,112,197, (b) oxadiazole derivatives described, e.g., in U.S. Pat. No. 3,189,447, (c) imidazole derivatives described in JP-B-37-16096, (d) polyarylalkane derivatives described, e.g., in U.S. Pat. Nos. 3,615,402, 3,820,989, and 3,542,544, JP-B-45-555, JP-B-51-10983, JP-A-51-93224, JP-A-55-108667, JP-A-55-156953, and JP-A-56-36656, (e) pyrazoline derivatives and pyrazolone derivatives described, e.g., in U.S. Pat. Nos. 3,180,729 and 4,278,746, JP-A-55-88064, JP-A-55-88065, JP-A-49-105537, JP-A-55-51086, JP-A-56-80051, JP-A-56-88141, JP-A-57-45545, JP-A-54-112637, and JP-A-55-74546, (f) phenylenediamine derivatives described, e.g., in U.S. Pat. No. 3,615,404, JP-B-51-10105, JP-B-46-3712, JP-B-47-28336, JP-A-54-83435, JP-A-54-110836, and JP-A-54-119925, (g) arylamine derivatives described, e.g., in U.S. Pat. Nos. 3,567,450, 3,180,703, 3,240,597, 3,658,520, 4,232,103, 4,175,961, and 4,012,376, JP-B-49-35702, West German Patent (DAS) 1,110,518, JP-B-39-27577, JP-A-55-144250, JP-A-56-119132, and JP-A-56-22437, (h) amino-substituted chalcone derivatives described, e.g., in U.S. Pat. No. 3,526,501, (i) N,N-bicarbazyl derivatives described, e.g., in U.S. Pat. No. 3,542,546, (j) oxazole derivatives described, e.g., in U.S. Pat. No. 3,257,203, (k) styryl-anthracene derivatives described, e.g., in JP-A-56-46234, (1) fluorenone derivatives described, e.g., in JP-A-54-110837, (m) hydrazone derivatives described, e.g., in U.S. Pat. No. 3,717,462, JP-A-54-59143 (corresponding to U.S. Pat. No. 4,150,987), JP-A-55-52063, JP-A-55-52064, JP-A-55-46760, JP-A-55-85495, JP-A-57-11350, JP-A-57-148749, and JP-A-57-104144, (n) benzidine derivatives described, e.g., in U.S. Pat. Nos. 4,047,948, 4,047,949, 4,265,990, 4,273,846, 4,299,897, and 4,306,008, (o) stilbene derivatives described, e.g., in JP-A-58-190953, JP-A-59-95540, JP-A-59-97148, JP-A-59-195658, and JP-A-62-36674, (p) polyvinylcarbazole and derivatives thereof described in JP-B-34-10966, (q) vinyl polymers, such as polyvinylpyrene, polyvinylanthracene, poly-2-vinyl-4-(4'-dimethylaminophenyl)-5-phenyloxazole, and poly-3-vinyl-N-ethylcarbazole, described in JP-B-43-18674 and JP-B-43-19192, (r) polymers, such as polyacenaphthylene, polyindene, and an acenaphthylene-styrene copolymer, described in JP-B-43-19193, (s) condensed resins, such as pyrene-formaldehyde resin, bromopyrene-formaldehyde resin, and ethylcarbazole-formaldehyde resin, described, e.g., in JP-B-56-13940, and (t) triphenylmethane polymers described in JP-A-56-90833 and JP-A-56-161550.

The organic photoconductive compounds which can be used in the present invention are not limited to the above-described compounds (a) to (t), and any of known organic photoconductive compounds may be employed in the present invention. The organic photoconductive compounds may be used either individually or in combination of two or more thereof.

The sensitizing dyes which can be used in the photoconductive layer of (i) include those conventionally known as described, e.g., in *Denshishashin*, Vol. 12, p. 9 (1973) and *Yuki Gosei Kagaku*, Vol. 24, No. 11, p. 1010 (1966). Specific examples of suitable sensitizing dyes include pyrylium-dyes described, e.g., in U.S. Pat. Nos. 3,141,770 and 4,283,475, JP-A-48-25658, and JP-A-62-71965; triarylmethane dyes described, e.g., in *Applied Optics Supplement*, Vol. 3, p. 50 (1969) and JP-A-50-39548; cyanine dyes described, e.g., in U.S. Pat. No. 3,597,196; and styryl dyes described, e.g., in JP-A-60-163047, JP-A-59-164588, and JP-A-60-252517.

The charge generating agents which can be used in the photoconductive layer of (ii) include various conventionally known charge generating agents, either organic or inorganic, such as selenium, selenium-tellurium, cadmium sulfide, zinc oxide, and organic pigments, for example, (1) azo pigments (including monoazo, bisazo, and trisazo pigments) described, e.g., in U.S. Pat. Nos. 4,436,800 and 4,439,506, JP-A-47-37543, JP-A-58-123541, JP-A-58-192042, JP-A-58-219263, JP-A-59-78356, JP-A-60-179746, JP-A-61-148453, JP-A-61-238063, JP-B-60-5941, and JP-B-60-45664, (2) metal-free or metallized phthalocyanine pigments described, e.g., in U.S. Pat. Nos. 3,397,086 and 4,666,802, JP-A-51-90827, and JP-A-52-55643, (3) perylene pigments described, e.g., in U.S. Pat. No. 3,371,884 and JP-A-47-30330, (4) indigo or thioindigo derivatives described, e.g., in British Patent 2,237,680 and JP-A-47-30331, (5) quinacridone pigments described, e.g., in British Patent 2,237,679 and JP-A-47-30332, (6) polycyclic quinone dyes described, e.g., in British Patent 2,237,678, JP-A-59-184348, JP-A-62-28738, and JP-A-47-18544, (7) bisbenzimidazole pigments described, e.g., in JP-A-47-30331 and JP-A-47-18543, (8) squarylium salt pigments described, e.g., in U.S. Pat. Nos. 4,396,610 and 4,644,082, and (9) azulenium salt pigments described, e.g., in JP-A-59-53850 and JP-A-61-212542.

These organic pigments may be used either individually or in combination of two or more thereof.

The charge transporting agents which can be used in the photoconductive layer of (ii) include these exemplified as the organic photoconductive compound described above.

With respect to a mixing ratio of the organic photoconductive compound and a binder resin, particularly the upper limit of the organic photoconductive compound is determined depending on the compatibility between these materials. The organic photoconductive compound, if added in an amount over the upper limit, may undergo undesirable crystallization. The lower the content of the organic photoconductive compound, the lower the electrophotographic sensitivity. Accordingly, it is desirable to use the organic photoconductive compound in an amount as much as possible within such a range that crystallization does not occur. In general, 5 to 120 parts by weight, and preferably from 10 to 100 parts by weight, of the organic photoconductive compound is used per 100 parts by weight of the total binder resins.

The binder resins (B) which can be used in the light-sensitive element according to the present invention include those for conventionally known electrophotographic light-sensitive elements. A preferred weight average molecular weight of the binder resin is from $5\times10^3$ to $1\times10^6$, and particularly from $2\times10^4$ to $5\times10^5$. A preferred glass transition point of the binder resin is from −40° to 200° C., and particularly from −10° to 140° C.

Conventional binder resins which may be used in the present invention are described, e.g., in Takaharu Shibata and Jiro Ishiwatari, *Kobunshi*, Vol. 17, p. 278 (1968), Harumi Miyamoto and Hidehiko Takei, *Imaging*, Vol. 1973, No. 8, Koichi Nakamura (ed.), *Kiroku Zairyoyo Binder no Jissai Gijutsu*, Ch. 10, C.M.C. (1985), Denshishashin Gakkai (ed.), *Denshishashinyo Yukikankotai no Genjo Symposium* (preprint) (1985), Hiroshi Kokado (ed.), *Saikin no Kododen Zairyo to Kankotai no Kaihatsu•Jitsuyoka*, Nippon Kagaku Joho (1986), Denshishashin Gakkai (ed.), *Denshishashin Giiutsu no Kiso to Oyo*, Ch. 5, Corona (1988), D. Tatt and S. C. Heidecker, *Tappi*, Vol. 49, No. 10, p. 439 (1966), E. S. Baltazzi and R. G. Blanchlotte, et al., *Photo. Sci. Eng.*, Vol. 16, No. 5, p. 354 (1972), and Nguyen Chank Keh, Isamu Shimizu and Eiichi Inoue, *Denshi Shashin Gakkaishi*, Vol. 18, No. 2, p. 22 (1980).

Specific examples of these known binder resins used include olefin polymers or copolymers, vinyl chloride copolymers, vinylidene chloride copolymers, vinyl alkanoate polymers or copolymers, allyl alkanoate polymers or copolymers, polymers or copolymers of styrene or derivatives thereof, butadiene-styrene copolymers, isoprene-styrene copolymers, butadiene-unsaturated carboxylic ester copolymers, acrylonitrile copolymers, methacrylonitrile copolymers, alkyl vinyl ether copolymers, acrylic ester polymers or copolymers, methacrylic ester polymers or copolymers, styrene-acrylic ester copolymers, styrene-methacrylic ester copolymers, itaconic diester polymers or copolymers, maleic anhydride copolymers, acrylamide copolymers, methacrylamide copolymers, hydroxy group-modified silicone resins, polycarbonate resins, ketone resins, polyester resins, silicone resins, amide resins, hydroxy group- or carboxy group-modified polyester resins, butyral resins, polyvinyl acetal resins, cyclized rubber-methacrylic ester copolymers, cyclized rubber-acrylic ester copolymers, copolymers containing a heterocyclic ring containing no nitrogen atom (the heterocyclic ring including furan, tetrahydrofuran, thiophene, dioxane, dioxofuran, lactone, benzofuran, benzothiophene and 1,3-dioxetane rings), and epoxy resins.

Further, the electrostatic characteristics of the photoconductive layer are improved by using, as a binder resin (B), a resin having a relatively low molecular weight (e.g., a weight average molecular weight of from $10^3$ to $10^4$) and containing an acidic group such as a carboxy group, a sulfo group or a phosphono group. For instance, JP-A-63-217354 discloses a resin having polymer components containing an acidic group at random in the polymer main chain, JP-A-64-70761 discloses a resin having an acidic group bonded at one terminal of the polymer main chain, JP-A-2-67563, JP-A-2-236561, JP-A-2-238458, JP-A-2-236562 and JP-A-2-247656 disclose a resin of graft type copolymer having an acidic group bonded at one terminal of the polymer main chain or a resin of graft type copolymer containing acidic groups in the graft portion, and JP-A-3-181948 discloses an AB block copolymer containing acidic groups as a block.

Moreover, in order to obtain a satisfactorily high mechanical strength of the photoconductive layer which may be insufficient by only using such a low molecular weight resin, a medium to high molecular weight resin is preferably used together with the low molecular weight resin. For instance, JP-A-2-68561 discloses a thermosetting resin capable of forming crosslinked structures between polymers, JP-A-2-68562 discloses a resin partially having crosslinked structures, and JP-A-2-69759 discloses a resin of graft type copolymer having an acidic group bonded at one terminal of the polymer main chain.

Also, in order to maintain the relatively stable performance even when ambient conditions are widely fluctuated, a specific medium to high molecular weight resin is employed in combination. For instance, JP-A-3-29954, JP-A-3-77954, JP-A-3-92861 and JP-A-3-53257 disclose a resin of graft type copolymer having an acidic group bonded at the terminal of the graft portion or a resin of graft type copolymer containing acidic groups in the graft portion. Moreover, JP-A-3-206464 and JP-A-3-223762 discloses a medium to high molecular weight resin of graft type copolymer having a graft portion formed from an AB block copolymer comprising an A block containing acidic groups and a B block containing no acidic group.

In a case of using these resins, the photoconductive substance is uniformly dispersed to form a photoconductive layer having good smoothness. Also, excellent electrostatic characteristics can be maintained even when ambient conditions are fluctuated or when a scanning exposure system using a semiconductor laser beam is utilized for the image exposure.

The photoconductive layer usually has a thickness of from 1 to 100 μm, and preferably from 10 to 50 μm.

Where a photoconductive layer functions as a charge generating layer of a laminated type light-sensitive element composed of a charge generating layer and a charge transporting layer, the charge generating layer has a thickness of from 0.01 to 5 μm, and preferably from 0.05 to 2 μm.

Depending on the kind of a light source for exposure, for example, visible light or semiconductor laser beam, various dyes may be used as spectral sensitizers. The sensitizing dyes used include carbonium dyes, diphenylmethane dyes, triphenylmethane dyes, xanthene dyes, phthalein dyes, polymethine dyes (including oxonol dyes, merocyanine dyes, cyanine dyes, rhodacyanine dyes, and styryl dyes), and phthalocyanine dyes (including metallized dyes), as described e.g., in Harumi Miyamoto and Hidehiko Takei, *Imaging*, Vol. 1973, No. 8, p. 12, C. J. Young et al., *RCA Review*, Vol. 15, p. 469 (1954), Kohei Kiyota et al., *Denkitsushin Gakkai Ronbunshi*, Vol. J 63-C, No. 2, p. 97 (1980), Yuji Harasaki et al., *Kogyo Kagaku Zasshi*, Vol. 66, p. 78 and 188 (1963), and Tadaaki Tani, *Nihon Shashin Gakkaishi*, Vol. 35, p. 208 (1972).

Specific examples of carbonium dyes, triphenylmethane dyes, xanthene dyes, and phthalein dyes are described, e.g., in JP-B-51-452, JP-A-50-90334, JP-A-50-114227, JP-A-53-39130, JP-A-53-82353, U.S. Pat. Nos. 3,052,540 and 4,054,450, and JP-A-57-16456.

Usable polymethine dyes, such as oxonol dyes, merocyanine dyes, cyanine dyes, and rhodacyanine dyes, are described in F. M. Hamer, *The Cyanine Dyes and Related Compounds*. Specific examples of these dyes are described, e.g., in U.S. Pat. Nos. 3,047,384, 3,110,591, 3,121,008, 3,125,447, 3,128,179, 3,132,942, and 3,622,317, British Patents 1,226,892, 1,309,274, and 1,405,898, JP-B-48-7814, and JP-B-55-18892.

Further, polymethine dyes capable of performing spectral sensitization in the near infrared to infrared region of 700 nm or more include those described, e.g., in JP-A-47-840, JP-A-47-44180, JP-B-51-41061, JP-A-49-5034, JP-A-49-45122, JP-A-57-46245, JP-A-56-35141, JP-A-57-157254, JP-A-61-26044, JP-A-61-27551, U.S. Pat. Nos. 3,619,154 and 4,175,956, and *Research Disclosure*, No. 216, pp. 117–118 (1982).

The light-sensitive element of the present invention is excellent in that the characteristics thereof hardly vary with the combined use of various sensitizing dyes.

If desired, the light-sensitive element may further contain various additives conventionally known for electrophotographic light-sensitive elements. The additives include chemical sensitizers for increasing electrophotographic sensitivity and plasticizers or surface active agents for improving film properties.

Suitable examples of the chemical sensitizers include electron attracting compounds such as a halogen, benzoquinone, chloranil, fluoranil, bromanil, dinitrobenzene, anthraquinone, 2,5-dichlorobenzoquinone, nitrophenol, tetrachlorophthalic anhydride, phthalic anhydride, maleic anhydride, N-hydroxymaleimide, N-hydroxyphthalimide, 2,3-dichloro-5,6-dicyanobenzoquinone, dinitrofluorenone, trinitrofluorenone, tetracyanoethylene, nitrobenzoic acid, and dinitrobenzoic acid; and polyarylalkane compounds, hindered phenol compounds and p-phenylenediamine compounds as described in the literature references cited in Hiroshi Kokado, et al., *Saikin no Kododen Zairyo to Kankotai no Kaihatsu•Jitsuyoka*, Chs. 4 to 6, Nippon Kagaku Joho (1986). In addition, the compounds as described in JP-A-

58-65439, JP-A-58-102239, JP-A-58-129439, and JP-A-62-71965 may also be used.

Suitable examples of the plasticizers, which may be added for improving flexibility of a photoconductive layer, include dimethyl phthalate, dibutyl phthalate, dioctyl phthalate, diphenyl phthalate, triphenyl phosphate, diisobutyl adipate, dimethyl sebacate, dibutyl sebacate, butyl laurate, methyl phthalyl glycolate, and dimethyl glycol phthalate. The plasticizer can be added in an amount that does not impair electrostatic characteristics of the photoconductive layer.

The amount of the additive to be added is not particularly limited, but ordinarily ranges from 0.001 to 2.0 parts by weight per 100 parts by weight of the photoconductive substance.

The photoconductive layer of the present invention can be provided on a conventionally known support. In general, a support for an electrophotographic light-sensitive layer is preferably electrically conductive. The electrically conductive support which can be used includes a substrate (e.g., a metal plate, paper, or a plastic sheet) having been rendered conductive by impregnation with a low-resistant substance, a substrate whose back side (opposite to the light-sensitive layer side) is rendered conductive and further having coated thereon at least one layer for, for example, curling prevention, the above-described substrate having formed on the surface thereof a water-resistant adhesive layer, the above-described substrate having on the surface thereof at least one precoat layer, and a paper substrate laminated with a plastic film on which aluminum, etc. has been vacuum deposited.

Specific examples of the conductive substrate and materials for rendering non-conductive substrates electrically conductive are described, for example, in Yukio Sakamoto, *Denshishashin*, Vol. 14, No. 1, pp. 2–11 (1975), Hiroyuki Moriga, *Nyumon Tokushushi no Kagaku*, Kobunshi Kankokai (1975), and M. F. Hoover, *J. Macromol. Sci. Chem.*, Vol. A-4, No. 6, pp. 1327–1417 (1970).

Now, the transfer layer which can be used in the present invention will be described in greater detail below.

The transfer layer of the present invention is a layer having a function-of transferring the toner image from the light-sensitive element to a primary receptor and then to a receiving material which provides a support for a printing plate, and of being removed upon a chemical reaction treatment to prepare a printing plate.

Therefore, it is desirable that the transfer layer has thermoplasticity sufficient for efficient and easy transfer of toner image formed on the light-sensitive element to a primary receptor and then to a receiving material without the occurence of image degradation and irrespective of the kind of the receiving material, and that the transfer layer is easily removed upon a chemical reaction treatment.

The transfer layer of the present invention is light-transmittive and capable of transmitting a radiation having a wavelength which constitutes at least one part of a spectrally sensitive region of the electrophotographic light-sensitive element. The layer may be colored. A colorless and transparent first transfer layer is usually employed.

The transfer layer is preferred to be transferred under conditions of temperature of not more than 180° C. and/or pressure of not more than 30 Kgf/cm$^2$, more preferably under conditions of temperature of not more than 160° C. and/or pressure of not more than 20 Kgf/cm$^2$. When the transfer conditions are lower than the above-described upper limit, there is no problem in practice since a large-sized apparatus is almost unnecessary in order to maintain the heat capacity and pressure sufficient for release of the transfer layer from the surface of light-sensitive element and transfer to a primary receptor and then to a receiving material, and the transfer is sufficiently performed at an appropriate transfer speed. The lower limit of transfer conditions is preferably not less than room temperature and/or pressure of not less than 100 gf/cm$^2$.

Thus, the resin (A) constituting the transfer layer of the present invention is a resin which is thermoplastic and capable of being removed upon a chemical reaction treatment.

With respect to thermal property of the resin (A), a glass transition point thereof is preferably not more than 140° C., more preferably not more than 100° C., or a softening point thereof is preferably not more than 180° C., more preferably not more than 150° C.

The term "resin capable of being removed upon a chemical reaction treatment" means and includes a resin which is dissolved and/or swollen upon a chemical reaction treatment to remove and a resin which is rendered hydrophilic upon a chemical reaction treatment and as a result, dissolved and/or swollen to remove.

One representative example of the resin (A) capable of being removed upon a chemical reaction treatment used in the transfer layer according to the present invention is a resin which can be removed with an alkaline processing solution. Particularly useful resins of the resins capable of being removed with an alkaline processing solution include polymers comprising a polymer component containing a hydrophilic group.

Another representative example of the resin (A) capable of being removed upon the chemical reaction treatment used in the transfer layer according to the present invention is a resin which has a hydrophilic group protected by a protective group and is capable of forming the hydrophilic group upon a chemical reaction.

The chemical reaction for converting the protected hydrophilic group to a hydrophilic group includes a reaction for rendering hydrophilic with a processing solution utilizing a conventionally known reaction, for example, hydrolysis, hydrogenolysis, oxygenation, β-release, and nucleophilic substitution, and a reaction for rendering hydrophilic by a decomposition reaction induced by exposure of actinic radiation.

Particularly useful resins of the resins capable of being rendered hydrophilic upon the chemical reaction treatment includes polymers comprising a polymer component containing a functional group capable of forming a hydrophilic group.

As the resin (A) for the formation of transfer layer, a polymer comprising at least one polymer component selected from a polymer component (a) containing a specific hydrophilic group described below and a polymer component (b) containing a functional group capable of forming a specific hydrophilic group upon a chemical reaction described below is preferred.

Polymer component (a):

a polymer component containing at least one group selected from a —$CO_2H$ group, a —CHO group, a —$SO_3H$ group, a —$SO_2H$ group, a —P(=O)(OH)$R^1$ group (wherein $R^1$ represents a —OH group, a hydrocarbon group or a —$OR^2$ group (wherein $R^2$ represents a hydrocarbon group)), a phenolic hydroxy group, a cyclic acid anhydride-containing group, a —$CONHCO^{R3}$ group (wherein $R^3$ represents a hydrocarbon group) and a —$CONHSO_2R^3$ group;

Polymer component (b):

a polymer component containing at least one functional group capable of forming at least one group selected from a —$CO_2H$ group, a —CHO group, a —$SO_3H$ group, a —$SO_2H$ group, a —P(=O)(OH)$^{R1}$ group (wherein $R^1$ has the same meaning as defined above) and a —OH group upon a chemical reaction.

The —P(=O)(OH)$^{R1}$ group denotes a group having the following formula:

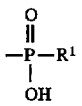

The hydrocarbon group represented by $R^1$, $R^2$ or $R^3$ preferably includes an aliphatic group having from 1 to 18 carbon atoms which may be substituted (e.g., methyl, ethyl, propyl, butyl, hexyl, octyl, decyl, dodecyl, octadecyl, 2-chloroethyl, 2-methoxyethyl, 3-ethoxypropyl, allyl, crotonyl, butenyl, cyclohexyl, benzyl, phenethyl, 3-phenylpropyl, methylbenzyl, chlorobenzyl, fluorobenzyl, and methoxybenzyl) and an aryl group which may be substituted (e.g., phenyl, tolyl, ethylphenyl, propylmethylphenyl, dichlorophenyl, methoxyphenyl, cyanophenyl, acetamidophenyl, acetylphenyl and butoxyphenyl).

The cyclic acid anhydride-containing group is a group containing at least one cyclic acid anhydride. The cyclic acid anhydride to be contained includes an aliphatic dicarboxylic acid anhydride and an aromatic dicarboxylic acid anhydride.

Specific examples of the aliphatic dicarboxylic acid anhydrides include succinic anhydride ring, glutaconic anhydride ring, maleic anhydride ring, cyclopentane-1,2-dicarboxylic acid anhydride ring, cyclohexane-1,2-dicarboxylic acid anhydride ring, cyclohexene-1,2-dicarboxylic acid anhydride ring, and 2,3-bicyclo[2,2,2]octanedicarboxylic acid anhydride. These rings may be substituted with, for example, a halogen atom (e.g., chlorine and bromine) and an alkyl group (e.g., methyl, ethyl, butyl, and hexyl).

Specific examples of the aromatic dicarboxylic acid anhydrides include phthalic anhydride ring, naphthalenedicarboxylic acid anhydride ring, pyridinedicarboxylic acid anhydride ring and thiophenedicarboxylic acid anhydride ring. These rings may be substituted with, for example, a halogen atom (e.g., chlorine and bromine), an alkyl group (e.g., methyl, ethyl, propyl, and butyl), a hydroxyl group, a cyano group, a nitro group, and an alkoxycarbonyl group (e.g., methoxycarbonyl, and ethoxycarbonyl).

To incorporate the polymer component (a) having the specific hydrophilic group into the thermoplastic resin used for the formation of transfer layer is preferred since the removal of transfer layer is easily and rapidly performed by a chemical reaction treatment. On the other hand, it is advantageous to use the thermoplastic resin contain the polymer component (b) which forms the specific hydrophilic group by a chemical reaction, because a glass transition point of the resin can be controlled in a low temperature range.

By appropriately selecting the polymer component (a) and the polymer component (b) to be employed in the resin (A), a glass transition point of the resin (A) is suitably controlled and thus, transferability of the transfer layer is remarkably improved. Also, the transfer layer is rapidly and completely removed to provide a printing plate without adversely affecting the hydrophilic property of the non-image areas and causing degradation of the toner image. As a result, the image transferred on receiving material has excellent reproducibility, and a transfer apparatus of small size can be utilized since the transfer is easily conducted under conditions of low temperature and low pressure. Moreover, in the resulting printing plate, cutting of toner image in highly accurate image portions such as fine lines, fine letters and dots for continuous tone areas is prevented and the residual transfer layer is not observed in the non-image areas.

Suitable contents of polymer component (a) and/or polymer component (b) in the resin (A) are determined so as to prevent the occurrence of background stain in the non-image areas of prints because of incomplete removal of the transfer layer by a chemical reaction treatment on the one side, and to prevent degradation of transferability of the transfer layer onto a receiving material due to an excessively high glass transition point or softening point of the resin (A) on the other side.

Preferred ranges of the contents of polymer component (a) and/or polymer component (b) in the resin (A) are as follows.

When the resin (A) contains only the polymer component (a) having the specific hydrophilic group, the content of polymer component (a) is preferably from 3 to 50% by weight, and more preferably from 5 to 40% by weight based on the total polymer component in the resin (A). On the other hand, when the resin (A) contains only the polymer component (b) having a functional group capable of forming the specific hydrophilic group by a chemical reaction, the content of polymer component (b) is preferably from 3 to 100% by weight, and more preferably from 5 to 70% by weight based on the total polymer component in the resin (A).

Further, when the resin (A) contains both the polymer component (a) and the polymer component (b), the content of polymer component (a) is preferably from 0.5 to 30% by weight, more preferably from 1 to 25% by weight, and the content of polymer component (b) is preferably from 3 to 99.5% by weight, more preferably from 5 to 50% by weight, based on the total polymer component in the resin (A).

Now, each of the polymer components which can be included in the resin (A) will be described in detail below.

The polymer component (a) containing the above-described specific hydrophilic group present in the resin (A) should not be particularly limited. Of the specific hydrophilic groups described above, those capable of forming a salt may be present in the form of salt in the polymer component (a). For instance, the above-described polymer component containing the specific hydrophilic group used in the resin (A) may be any of vinyl compounds each having the hydrophilic group. Such vinyl compounds are described, for example, in *Kobunshi Data Handbook (Kiso-hen)*, edited by Kobunshi Gakkai, Baifukan (1986). Specific examples of the vinyl compound are acrylic acid, α- and/or β-substituted acrylic acid (e.g., α-acetoxy compound, α-acetoxymethyl compound, α-(2-amino)ethyl compound, α-chloro compound, α-bromo compound, α-fluoro compound, α-tributylsilyl compound, α-cyano compound, β-chloro compound, β-bromo compound, α-chloro-β-methoxy compound, and α,β-dichloro compound), methacrylic acid, itaconic acid, itaconic acid half esters, itaconic acid half amides, crotonic acid, 2-alkenylcarboxylic acids (e.g., 2-pentenoic acid, 2-methyl-2-hexenoic acid, 2-octenoic acid, 4-methyl-2-hexenoic acid, and 4-ethyl-2-octenoic acid), maleic acid, maleic acid half esters, maleic acid half amides, vinylbenzenecarboxylic acid, vinylbenzenesulfonic acid, vinylsulfonic acid, vinylphosphonic acid, half ester derivatives of the vinyl group or allyl group of dicarboxylic acids, and ester derivatives or amide derivatives of these carboxylic acids or sulfonic acids having the above-described hydrophilic group in the substituent thereof. The hydrophilic group may be a salt thereof.

Specific examples of the polymer components (a) containing the specific hydrophilic group are set forth below, but the present invention should not be construed as being limited thereto. In the following formulae, $R^4$ represents —H or —$CH_3$; $R^5$ represents —H, —$CH_3$ or —$CH_2COOCH_3$; $R^6$ represents an alkyl group having from 1 to 4 carbon atoms; $R^7$ represents an alkyl group having from 1 to 6 carbon atoms, a benzyl group or a phenyl group; e represents an integer of 1 or 2; f represents an integer of from 1 to 3; g represents an integer of from 2 to 11; h represents an integer of from 1 to 11; and i represents an integer of from 2 to 4; and j represents an integer of from 2 to 10.

(a-1)

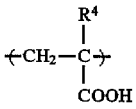

(a-2)

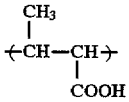

(a-3)

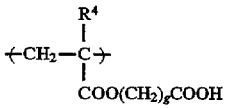

(a-4)

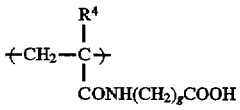

(a-5)

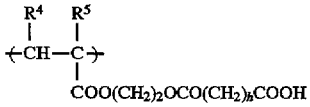

(b-6)

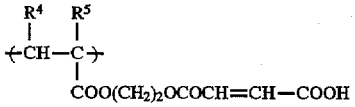

(a-7)

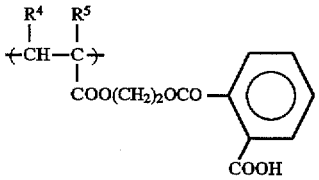

(a-8)

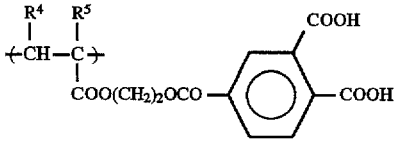

(a-9)

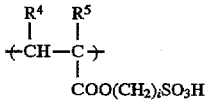

(a-10)

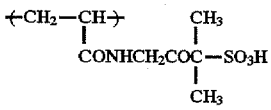

-continued (a-11)

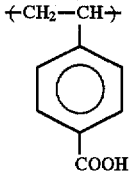

(a-12)

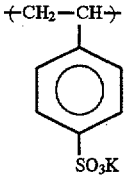

(a-13)

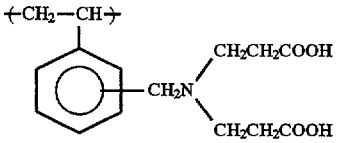

(a-14)

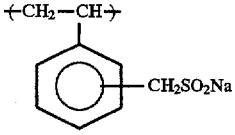

(a-15)

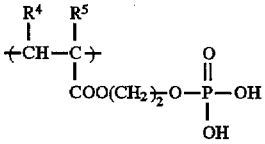

(a-16)

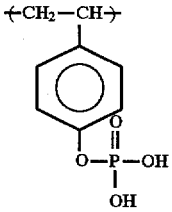

(a-17)

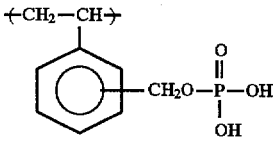

(a-18)

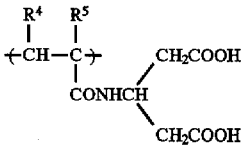

(a-19)

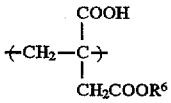

(a-20)

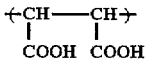

(a-21)

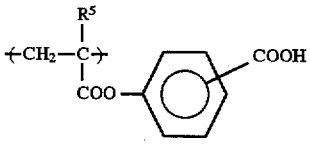

-continued
(a-22)
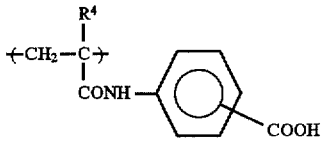
(a-23)
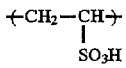
(a-23)
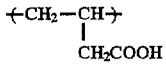
(a-25)
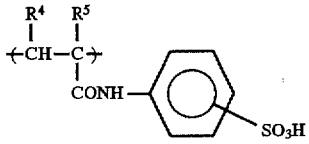
(a-26)
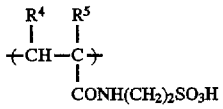
(a-27)
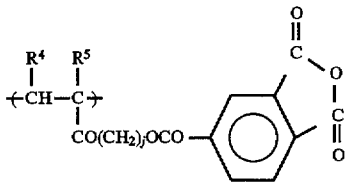
(a-28)
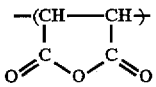
(a-29)
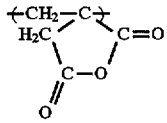
(a-30)
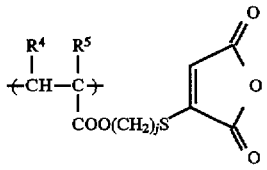
(a-31)
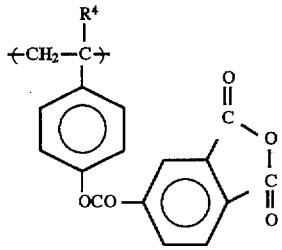
(a-32)
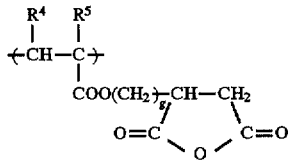
-continued
(a-33)
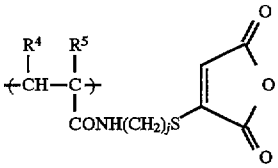
(a-34)
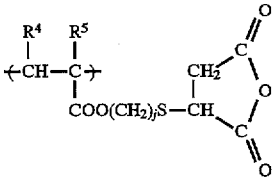
(a-35)
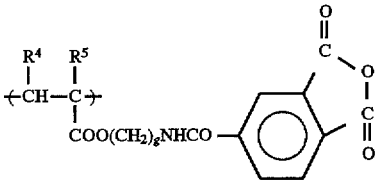
(a-36)
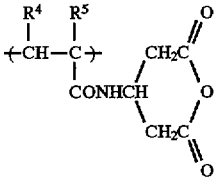
(a-37)
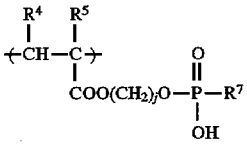
(a-38)
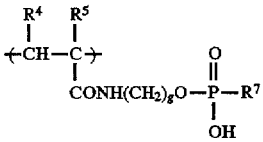
(a-39)
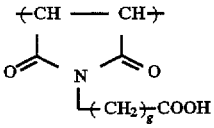
(a-40)
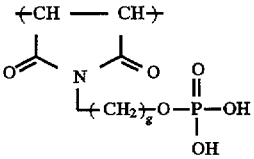
(a-41)
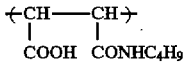
(a-42)
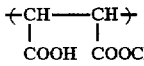
(a-43)
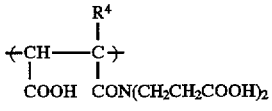

-continued (a-44)

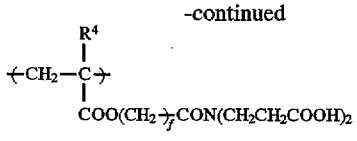

(a-45)

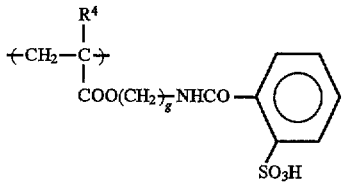

(a-46)

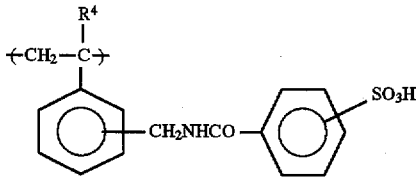

(a-47)

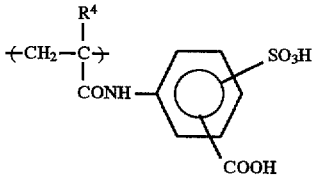

(a-48)

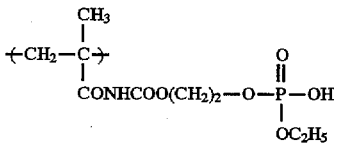

(a-49)

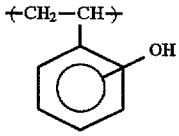

(a-50)

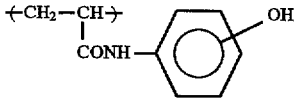

(a-51)

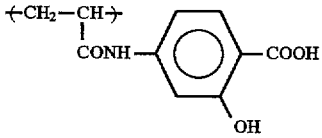

(a-52)

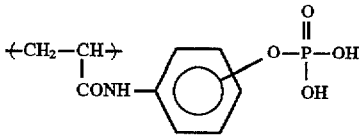

(a-53)

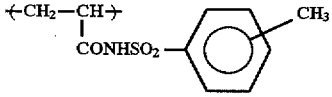

(a-54)

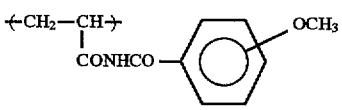

-continued (a-55)

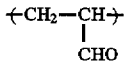

(a-56)

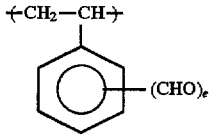

The polymer component (b) containing a functional group capable of forming a specific hydrophilic group upon a chemical reaction will be described below.

The number of hydrophilic groups formed from one functional group capable of forming a hydrophilic group upon the chemical reaction may be one, two or more. Now, a functional group capable of forming at least one carboxyl group upon a chemical reaction will be described below.

According to one preferred embodiment of the present invention, a carboxy group-forming functional group is represented by the following general formula (F-I):

$$-COO-L^1 \qquad \text{(F-I)}$$

wherein $L^1$ represents

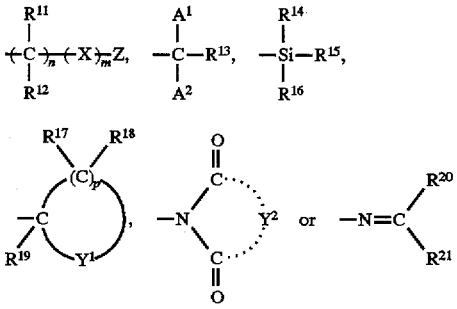

wherein $R^{11}$ and $R^{12}$, which may be the same or different, each represent a hydrogen atom or a hydrocarbon group; X represents an aromatic group; Z represents a hydrogen atom, a halogen atom, a trihalomethyl group, an alkyl group, a cyano group, a nitro group, $-SO_2-Z^1$ (wherein $Z^1$ represents a hydrocarbon group), $-COO-Z^2$ (wherein $Z^2$ represents a hydrocarbon group), $-O-Z^3$ (wherein $Z^3$ represents a hydrocarbon group), or $-CO-Z^4$ (wherein $Z^4$ represents a hydrocarbon group); n and m each represent 0, 1 or 2, provided that when both n and m are 0, Z is not a hydrogen atom; $A^1$ and $A^2$, which may be the same or different, each represent an electron attracting group having a positive Hammett's σ value; $R^{13}$ represents a hydrogen atom or a hydrocarbon group; $R^{14}$, $R^{15}$, $R^{16}$, $R^{20}$ and $R^{21}$, which may be the same or different, each represent a hydrocarbon group or $-O-Z^5$ (wherein $Z^5$ represents a hydrocarbon group); $Y^1$ represents an oxygen atom or a sulfur atom; $R^{17}$, $R^{18}$, and $R^{19}$, which may be the same or different, each represent a hydrogen atom, a hydrocarbon group or $-O-Z^7$ (wherein $Z^7$ represents a hydrocarbon group); p represents an integer of 3 or 4; $Y^2$ represents an organic residue for forming a cyclic imido group.

In more detail, $R^{11}$ and $R^{12}$, which may be the same or different, each preferably represents a hydrogen atom or a straight chain or branched chain alkyl group having from 1 to 12 carbon atoms which may be substituted (e.g., methyl, ethyl, propyl, chloromethyl, dichloromethyl, trichloromethyl, trifluoromethyl, butyl, hexyl, octyl, decyl, hydroxyethyl, or 3-chloropropyl). X preferably represents a phenyl or naphthyl group which may be substituted (e.g., phenyl, methylphenyl, chlorophenyl, dimethylphenyl, chloromethylphenyl, or naphthyl). Z preferably represents a hydrogen atom, a halogen atom (e.g., chlorine or fluorine), a trihalomethyl group (e.g., trichloromethyl or trifluoromethyl), a straight chain or branched chain alkyl group having from 1 to 12 carbon atoms which may be substituted (e.g., methyl, chloromethyl, dichloromethyl, ethyl, propyl, butyl, hexyl, tetrafluoroethyl, octyl, cyanoethyl, or chloroethyl), a cyano group, a nitro group, $—SO_2—Z^1$ (wherein $Z^1$ represents an aliphatic group (for example an alkyl group having from 1 to 12 carbon atoms which may be substituted (e.g., methyl, ethyl, propyl, butyl, chloroethyl, pentyl, or octyl) or an aralkyl group having from 7 to 12 carbon atoms which may be substituted (e.g., benzyl, phenethyl, chlorobenzyl, methoxybenzyl, chlorophenethyl, or methylphenethyl)), or an aromatic group (for example, a phenyl or naphthyl group which may be substituted (e.g., phenyl, chlorophenyl, dichlorophenyl, methylphenyl, methoxyphenyl, acetylphenyl, acetamidophenyl, methoxycarbonylphenyl, or naphthyl)), $—COO—Z^2$ (wherein $Z^2$ has the same meaning as $Z^1$ above), $—O—Z^3$ (wherein $Z^3$ has the same meaning as $Z^1$ above), or $—CO—Z^4$ (wherein $Z^4$ has the same meaning as $Z^1$ above). n and m each represent 0, 1 or 2, provided that when both n and m are 0, Z is not a hydrogen atom.

$R^{14}$, $R^{15}$, $R^{16}$, $R^{20}$ and $R^{21}$, which may be the same or different, each preferably represent an aliphatic group having 1 to 18 carbon atoms which may be substituted (wherein the aliphatic group includes an alkyl group, an alkenyl group, an aralkyl group, and an alicyclic group, and the substituent therefor includes a halogen atom, a cyano group, and $—O—Z^6$ (wherein $Z^6$ represents an alkyl group, an aralkyl group, an alicyclic group, or an aryl group)), an aromatic group having from 6 to 18 carbon atoms which may be substituted (e.g., phenyl, tolyl, chlorophenyl, methoxyphenyl, acetamidophenyl, or naphthyl), or $—O—Z^5$ (wherein $Z^5$ represents an alkyl group having from 1 to 12 carbon atoms which may be substituted, an alkenyl group having from 2 to 12 carbon atoms which may be substituted, an aralkyl group having from 7 to 12 carbon atoms which may be substituted, an alicyclic group having from 5 to 18 carbon atoms which may be substituted, or an aryl group having from 6 to 18 carbon atoms which may be substituted).

$A^1$ and $A^2$ may be the same or different, at least one of $A^1$ and $A^2$ represents an electron attracting group, with the sum of their Hammett's $\sigma_p$ values being 0.45 or more. Examples of the electron attracting group for $A^1$ or $A^2$ include an acyl group, an aroyl group, a formyl group, an alkoxycarbonyl group, a phenoxycarbonyl group, an alkylsulfonyl group, an aroylsulfonyl group, a nitro group, a cyano group, a halogen atom, a halogenated alkyl group, and a carbamoyl group.

A Hammett's $\sigma_p$ value is generally used as an index for estimating the degree of electron attracting or donating property of a substituent. The greater the positive value, the higher the electron attracting property. Hammett's $\sigma_p$ values of various substituents are described, e.g., in Naoki Inamoto, *Hammett Soku—Kozo to Han-nosei*, Maruzen (1984).

It seems that an additivity rule applies to the Hammett's $\sigma_p$ values in this system so that both of $A^1$ and $A^2$ need not be electron attracting groups. Therefore, where one of them is an electron attracting group, the other may be any group selected without particular limitation as far as the sum of their $\sigma_p$ values is 0.45 or more.

$R^{13}$ preferably represents a hydrogen atom or a hydrocarbon group having from 1 to 8 carbon atoms which may be substituted, e.g., methyl, ethyl, propyl, butyl, pentyl, hexyl, octyl, allyl, benzyl, phenethyl, 2-hydroxyethyl, 2-methoxyethyl, 2-ethoxyethyl, 3-methoxypropyl, or 2-chloroethyl.

$Y^1$ represents an oxygen atom or a sulfur atom. $R^{17}$, $R^{18}$, and $R^{19}$, which may be the same or different, each preferably represents a hydrogen atom, a straight chain or branched chain alkyl group having from 1 to 18 carbon atoms which may be substituted (e.g., methyl, ethyl, propyl, butyl, pentyl, hexyl, octyl, decyl, dodecyl, octadecyl, chloroethyl, methoxyethyl, or methoxypropyl), an alicyclic group which may be substituted (e.g., cyclopentyl or cyclohexyl), an aralkyl group having from 7 to 12 carbon atoms which may be substituted (e.g., benzyl, phenethyl, chlorobenzyl, or methoxybenzyl), an aromatic group which may be substituted (e.g., phenyl, naphthyl, chlorophenyl, tolyl, methoxyphenyl, methoxycarbonylphenyl, or dichlorophenyl), or $—O—Z^7$ (wherein $Z^7$ represents a hydrocarbon group and specifically the same hydrocarbon group as described for $R^{14}$, $R^{15}$, or $R^{16}$). p represents an integer of 3 or 4.

$Y^2$ represents an organic residue for forming a cyclic imido group, and preferably represents an organic residue represented by the following general formula (A) or (B):

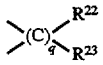

(A)

wherein $R^{22}$ and $R^{23}$, which may be the same or different, each represent a hydrogen atom, a halogen atom (e.g., chlorine or bromine), an alkyl group having from 1 to 18 carbon atoms which may be substituted (e.g., methyl, ethyl, propyl, butyl, pentyl, hexyl, octyl, decyl, dodecyl, hexadecyl, octadecyl, 2-chloroethyl, 2-methoxyethyl, 2-cyanoethyl, 3-chloropropyl, 2-(methanesulfonyl)ethyl, or 2-(ethoxymethoxy)ethyl), an aralkyl group having from 7 to 12 carbon atoms which may be substituted (e.g., benzyl, phenethyl, 3-phenylpropyl, methylbenzyl, dimethylbenzyl, methoxybenzyl, chlorobenzyl, or bromobenzyl), an alkenyl group having from 3 to 18 carbon atoms which may be substituted (e.g., allyl, 3-methyl-2-propenyl, 2-hexenyl, 4-propyl-2-pentenyl, or 12-octadecenyl), $—S—Z^8$ (wherein $Z^8$ represents an alkyl, aralkyl or alkenyl group having the same meaning as $R^{22}$ or $R^{23}$ described above or an aryl group which may be substituted (e.g., phenyl, tolyl, chlorophenyl, bromophenyl, methoxyphenyl, ethoxyphenyl, or ethoxycarbonylphenyl)) or $—NH—Z^9$ (wherein $Z^9$ has the same meaning as $Z^8$ described above). Alternatively, $R^{22}$ and $R^{23}$ may be taken together to form a ring, such as a 5- or 6-membered monocyclic ring (e.g., cyclopentane or cyclohexane) or a 5- or 6-membered bicyclic ring (e.g., bicyclopentane, bicycloheptane, bicycloheptene, bicyclooctane, or bicyclooctene). The ring may be substituted. The substituent includes those described for $R^{22}$ or $R^{23}$. q represents an integer of 2 or 3.

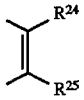

(B)

wherein $R^{24}$ and $R^{25}$, which may be the same or different, each have the same meaning as $R^{22}$ or $R^{23}$ described above. Alternatively, $R^{24}$ and $R^{25}$ may be taken together to form an aromatic ring (e.g., benzene or naphthalene).

According to another preferred embodiment of the present invention, the carboxyl group-forming functional group is a group containing an oxazolone ring represented by the following general formula (F-II):

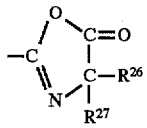

(F-II)

wherein $R^{26}$ and $R^{27}$, which may be the same or different, each represent a hydrogen atom or a hydrocarbon group, or $R^{25}$ and $R^{27}$ may be taken together to form a ring.

In the general formula (F-II), $R^{26}$ and $R^{27}$ each preferably represents a hydrogen atom, a straight chain or branched chain alkyl group having from 1 to 12 carbon atoms which may be substituted (e.g., methyl, ethyl, propyl, butyl, hexyl, 2-chloroethyl, 2-methoxyethyl, 2-methoxycarbonylethyl, or 3-hydroxypropyl), an aralkyl group having from 7 to 12 carbon atoms which may be substituted (e.g., benzyl, 4-chlorobenzyl, 4-acetamidobenzyl, phenethyl, or 4-methoxybenzyl), an alkenyl group having from 2 to 12 carbon atoms which may be substituted (e.g., vinyl, allyl, isopropenyl, butenyl, or hexenyl), a 5- to 7-membered alicyclic group which may be substituted (e.g., cyclopentyl, cyclohexyl, or chlorocyclohexyl), or an aromatic group which may be substituted (e.g., phenyl, chlorophenyl, methoxyphenyl, acetamidophenyl, methylphenyl, dichlorophenyl, nitrophenyl, naphthyl, butylphenyl, or dimethylphenyl). Alternatively, $R^{26}$ and $R^{27}$ may be taken together to form a 4- to 7-membered ring (e.g., tetramethylene, pentamethylene, or hexamethylene).

A functional group capable of forming at least one sulfo group upon a chemical reaction includes a functional group represented by the following general formula (F-III) or (F-IV):

$$-SO_2-O-L^2 \quad \text{(F-III)}$$

$$-SO_2-S-L^2 \quad \text{(F-IV)}$$

wherein $L^2$ represents

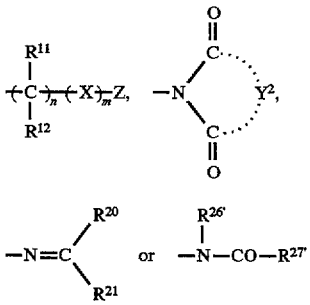

wherein $R^{11}$, $R^{12}$, X, Z, n, m, $Y^2$, $R^{20}$ and $R^{21}$ each has the same meaning as defined above; and $R^{26'}$ and $R^{27'}$, which may be the same or different, each represents a hydrogen atom or a hydrocarbon group, and specifically a hydrocarbon group as described for $R^{26}$.

A functional group capable of forming at least one sulfinic acid group upon a chemical reaction includes a functional group represented by the following general formula (F-V):

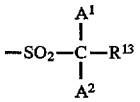

(F-V)

wherein $A^1$, $A^2$ and $R^{13}$ each has the same meaning as defined above.

A functional group capable of forming at least one $-P(=O)(OH)R^1$ group upon a chemical reaction includes a functional group represented by the following general formula (F-VIa) or (F-VIb):

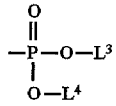

(F-VIa)

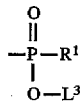

(F-VIb)

wherein $L^3$ and $L^4$, which may be the same or different, each has the same meaning as $L^1$ described above, and $R^1$ has the same meaning as defined above.

One preferred embodiment of functional groups capable of forming at least one hydroxyl group upon a chemical reaction includes a functional group represented by the following general formula (F-VII):

$$-O-L^5 \quad \text{(F-VII)}$$

wherein $L^5$ represents

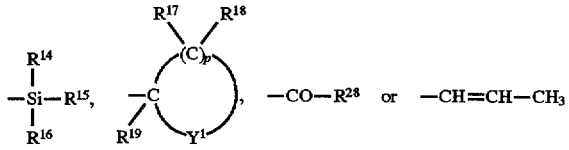

wherein $R^{14}$, $R^{15}$, $R^{16}$, $R^{17}$, $R^{18}$, $R^{19}$, $Y^1$, and p each has the same meaning as defined above; and $R^{28}$ represents a hydrocarbon group, and specifically a hydrocarbon group as described for $R^{11}$.

Another preferred embodiment of functional groups capable of forming at least one hydroxyl group upon a chemical reaction includes a functional group wherein at least two hydroxyl groups which are sterically close to each other are protected with one protective group. Such hydroxyl group-forming functional groups are represented, for example, by the following general formulae (F-VIII), (F-IX) and (F-X):

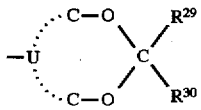

(F-VIII)

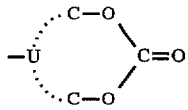

(F-IX)

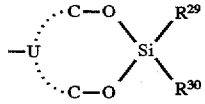

(F-X)

wherein $R^{29}$ and $R^{30}$, which may be the same or different, each represents a hydrogen atom, a hydrocarbon group, or $-O-Z^{10}$ (wherein $Z^{10}$ represents a hydrocarbon group); and U represents a carbon-to-carbon bond which may contain a hetero atom, provided that the number of atoms present between the two oxygen atoms is 5 or less.

More specifically, $R^{29}$ and $R^{30}$, which may be the same or different, each preferably represents a hydrogen atom, an alkyl group having from 1 to 12 carbon atoms which may be substituted (e.g., methyl, ethyl, propyl, butyl, hexyl, 2-methoxyethyl, or octyl), an aralkyl group having from 7 to 9 carbon atoms which may be substituted (e.g., benzyl, phenethyl, methylbenzyl, methoxybenzyl, or chlorobenzyl), an alicyclic group having from 5 to 7 carbon atoms (e.g., cyclopentyl or cyclohexyl), an aryl group which may be substituted (e.g., phenyl, chlorophenyl, methoxyphenyl, methylphenyl, or cyanophenyl), or $—OZ^{10}$ (wherein $Z^{10}$ represents a hydrocarbon group, and specifically a hydrocarbon group as described for $R^{29}$ or $R^{30}$), and U represents a carbon-to-carbon bond which may contain a hetero atom, provided that the number of atoms present between the two oxygen atoms is 5 or less.

Specific examples of the functional groups represented by the general formulae (F-I) to (F-X) described above are set forth below, but the present invention should not be construed as being limited thereto. In the following formulae (b-1) through (b-67), the symbols used have the following meanings respectively:

$W_1$: $—CO—$, $—SO_2—$, or $—\overset{\overset{O}{\|}}{\underset{|}{P}}—$;

$W_2$: $—CO—$ or $—SO_2—$;

$Q^1$: $—C_nH_{n+1}$ (n: an integer of from 1 to 8),

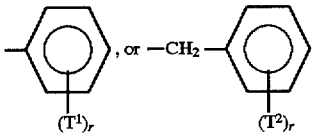

$T^1$, $T^2$: —H, $—C_nH_{2n+1}$, $—OC_nH_{2n+1}$, —CN, $—NO_2$, —Cl, —Br, $—COOC_nH_{2n+1}$, $—NHCOC_nH_{2n+1}$, or $—COC_nH_{2n+1}$;

r: an integer of from 1 to 5;

$Q^2$: $—C_nH_{2n+1}$, $—CH_2C_6H_5$, or $—C_6H_5$;

$Q^3$: $—C_mH_{2m+1}$ (m: an integer of from 1 to 4) or $—CH_2C_6H_5$;

$Q^4$: —H, $—CH_3$, or $—OCH_3$;

$Q^5$, $Q^6$: —H, $—CH_3$, $—OCH_3$, $—C_6H_5$, or $—CH_2C_6H_5$;

G: —O— or —S—; and

J: —Cl or —Br $—W_1—O(CH_2)_2COQ^1$ (b-1)

$—W_1—O—C(CH_3)_2—CH_2COQ^1$ (b-2)

$—W_1—O(CH_2)_2COOQ^1$ (b-3)

$—W_1—O(CH_2)_2SO_2Q^1$ (b-4)

$—W_1—O(CH_2)_2CN$ (b-5)

$—W_1—O(CH_2)_2NO_2$ (b-6)

-continued $—W_1—O—CH(Q^2)—CH_2COQ^1$ (b-7)

$—W_1—O—CH_2—CH(Q^2)—COQ^1$ (b-8)

$—W_1—O—CH(Q^2)—CH(Q^2)—COQ^1$ (b-9)

$—W_1—O—C(CH_3)_2—CH_2SO_2Q^1$ (b-10)

$—W_1—O—C(COCH_3)(COOQ^1)—Q^3$ (b-11)

$—W_1—O—C(COOQ^1)_2—Q^3$ (b-12)

$—W_1—O—C(CN)_2—Q^3$ (b-13)

$—W_1—O—C(COQ^1)(COQ^2)—Q^3$ (b-14)

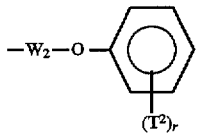

(b-15)

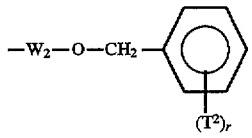

(b-16)

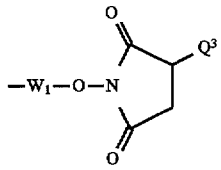

(b-17)

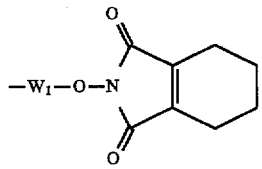

(b-17)

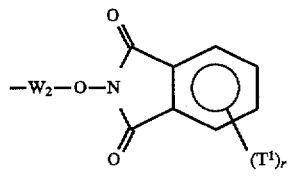

(b-19)

-continued
(b-20)
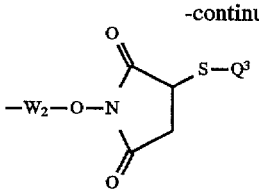
(b-21)
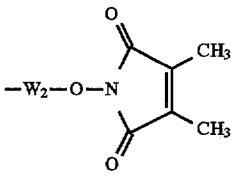
(b-22)
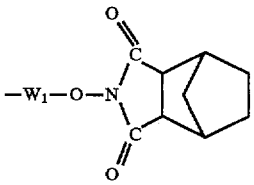
(b-23)
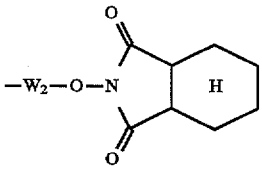
(b-24)
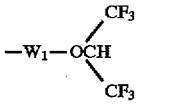
$-W_1-O-CH_2CF_3$ (b-25)
(b-26)
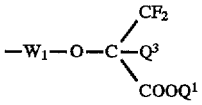
(b-27)
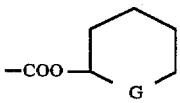
(b-28)
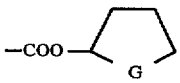
(b-29)
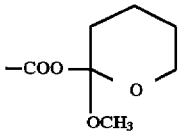
(b-29)
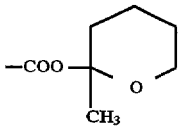
$-COOSi(C_3H_7)_3$ (b-31)
(b-32)
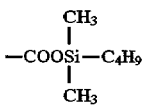
-continued
(b-33)
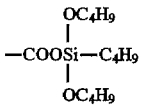
(b-34)
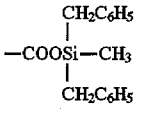
$-SO_3-CH_2COQ^1$ (b-35)
$-SO_3CH_2COOQ^1$ (b-36)
$-SO_3(CH_2)_2J$ (b-37)
(b-38)
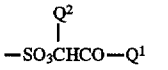
(b-39)
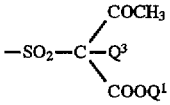
(b-40)
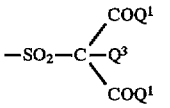
(b-41)
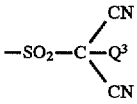
(b-42)
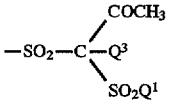
(b-43)
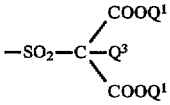
(b-44)
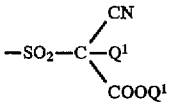
(b-45)
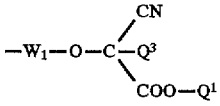
(b-46)
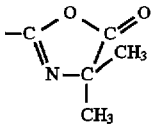
(b-47)
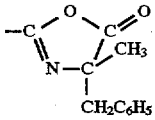
(b-48)
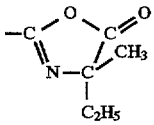

-continued (b-49)

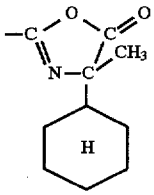

(b-50)

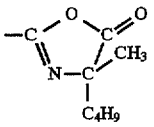

(b-51)

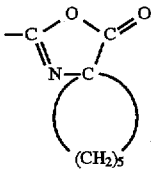

(b-52)

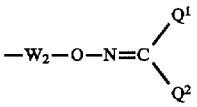

(b-53)

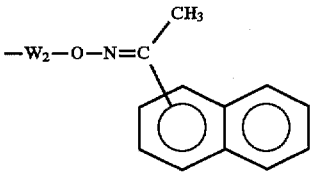

(b-54)

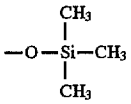

(b-55)

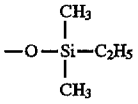

(b-56)

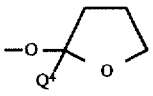

(b-57)

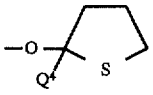

(b-58)

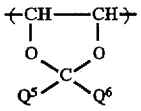

(b-59)

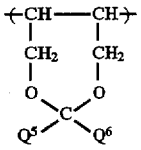

(b-60)

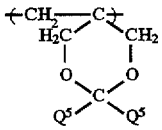

-continued (b-61)

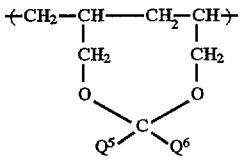

(b-62)

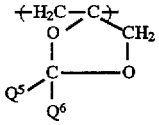

(b-63)

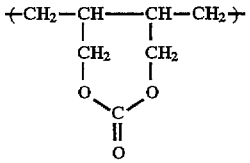

(b-64)

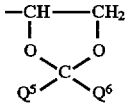

(b-65)

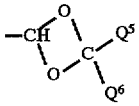

(b-66)

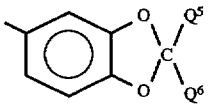

(b-67)

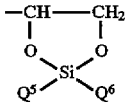

The polymer component (b) which contains the functional group capable of forming at least one hydrophilic group selected from —COOH, —CHO, —$SO_3H$, —$SO_2H$, —P(=O)(OH)$R^1$ and —OH upon a chemical reaction which can be used in the present invention is not particularly limited. Specific examples thereof include polymer components obtained by protecting the hydrophilic group in the polymer components (a) described above.

The above-described functional group capable of forming at least one hydrophilic group selected from —COOH, —CHO, —$SO_3H$, —$SO_2H$, —P(=O)(OH)$R^1$, and —OH upon a chemical reaction used in the present invention is a functional group in which such a hydrophilic group is protected with a protective group. Introduction of the protective group into a hydrophilic group by a chemical bond can easily be carried out according to conventionally known methods. For example, the reactions as described in J. F. W. McOmie, *Protective Groups in Organic Chemistry*, Plenum Press (1973), T. W. Greene, *Protective Groups in Organic Synthesis*, Wiley-Interscience (1981), Nippon Kagakukai (ed.), *Shin Jikken Kagaku Koza*, Vol. 14, "Yuki Kagobutsu no Gosei to Han-no", Maruzen (1978), and Yoshio Iwakura and Keisuke Kurita, *Han-nosei Kobunshi*, Kodansha can be employed.

In order to introduce the functional group which can be used in the present invention into a resin, a process using a so-called polymer reaction in which a polymer containing at least one hydrophilic group selected from —COOH, —CHO, —$SO_3H$, —$SO_2H$, —$PO_3H_2$, and —OH is reacted to convert its hydrophilic group to a protected hydrophilic group or a process comprising synthesizing at least one monomer containing at least one of the functional groups, for example, those represented by the general formulae (F-I) to (F-X) and then polymerizing the monomer or copolymerizing the monomer with any appropriate other copolymerizable monomer(s) is used.

The latter process (comprising preparing the desired monomer and then conducting polymerization reaction) is preferred for reasons that the amount or kind of the functional group to be incorporated into the polymer can be appropriately controlled and that incorporation of impurities can be avoided (in case of the polymer reaction process, a catalyst to be used or byproducts are mixed in the polymer).

For example, a resin containing a carboxyl group-forming functional group may be prepared by converting a carboxyl group of a carboxylic acid containing a polymerizable double bond or a halide thereof to a functional group represented by the general formula (F-I) by the method as described in the literature references cited above and then subjecting the functional group-containing monomer to a polymerization reaction.

Also, a resin containing an oxazolone ring represented by the general formula (F-II) as a carboxyl group-forming functional group may be obtained by conducting a polymerization reaction of at least one monomer containing the oxazolone ring, if desired, in combination with other copolymerizable monomer(s). The monomer containing the oxazolone ring can be prepared by a dehydrating cyclization reaction of an N-acyloyl-α-amino acid containing a polymerizable unsaturated bond. More specifically, it can be prepared according to the method described in the literature references cited in Yoshio Iwakura and Keisuke Kurita, *Han-nosei Kobunshi*, Ch. 3, Kodansha.

The resin (A) preferably contains other polymer component(s) in addition to the above-described specific polymer components (a) and/or (b) in order to maintain its thermoplasticity and to prevent its removal in the image area during an oil-desensitizing treatment. As such polymer components, those which form a homopolymer having a glass transition point of not more than 130° C. are preferred. More specifically, examples of such other polymer components include those corresponding to the repeating unit represented by the following general formula (U):

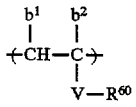

(U)

wherein V represents —COO—, —OCO—, —O—, —CO—, $-C_6H_4-$, $-(CH_2)_nCOO-$ or $-(CH_2)_nOCO-$; n represents an integer of from 1 to 4; $R^{60}$ represents a hydrocarbon group having from 1 to 22 carbon atoms; and $b^1$ and $b^2$, which may be the same or different, each represents a hydrogen atom, a fluorine atom, a chlorine atom, a bromine atom, a cyano group, a trifluoromethyl group, a hydrocarbon group having from 1 to 7 carbon atoms (e.g., methyl, ethyl, propyl, butyl, pentyl, hexyl, phenyl and benzyl) or $—COOZ^{11}$ (wherein $Z^{11}$ represents a hydrocarbon group having from 1 to 7 carbon atoms).

Preferred examples of the hydrocarbon group represented by $R^{60}$ include an alkyl group having from 1 to 18 carbon atoms which may be substituted (e.g., methyl, ethyl, propyl, butyl, pentyl, hexyl, heptyl, octyl, decyl, dodecyl, tridecyl, tetradecyl, 2-chloroethyl, 2-bromoethyl, 2-cyanoethyl, 2-hydroxyethyl, 2-methoxyethyl, 2-ethoxyethyl, and 2-hydroxypropyl), an alkenyl group having from 2 to 18 carbon atoms which may be substituted (e.g., vinyl, allyl, isopropenyl, butenyl, hexenyl, heptenyl, and octenyl), an aralkyl group having from 7 to 12 carbon atoms which may be substituted (e.g., benzyl, phenethyl, naphthylmethyl, 2-naphthylethyl, methoxybenzyl, ethoxybenzyl, and methylbenzyl), a cycloalkyl group having from 5 to 8 carbon atoms which may be substituted (e.g., cyclopentyl, cyclohexyl, and cycloheptyl), and an aromatic group having from 6 to 12 carbon atoms which may be substituted (e.g., phenyl, tolyl, xylyl, mesityl, naphthyl, methoxyphenyl, ethoxyphenyl, fluorophenyl, methylfluorophenyl, difluorophenyl, bromophenyl, chlorophenyl, dichlorophenyl, methylcarbonylphenyl, methoxycarbonylphenyl, ethoxycarbonylphenyl, methanesulfonylphenyl, and cyanophenyl).

The content of one or more polymer components represented by the general formula (U) are preferably from 30 to 97% by weight based on the total polymer component in the resin (A).

The resin (A) may contain, in addition to the polymer components (a) and/or (b), a polymer component (f) containing a moiety having at least one of a fluorine atom and a silicon atom in order to increase the releasability of the resin (A) itself. Using such a resin, releasability of the transfer layer from a primary receptor is increased and as a result, the transferability is improved.

The moiety having a fluorine atom and/or a silicon atom contained in the resin (A) includes that incorporated into the main chain of the polymer and that contained as a substituent in the side chain of the polymer.

The polymer component (f) is same as the polymer component containing a moiety having a fluorine atom and/or a silicon atom which is included in the resin (P) described in detail hereinbefore.

The polymer components (f) are preferably present as a block in the resin (A). Embodiments of polymerization patterns of copolymer containing polymer components (f) as a block and methods for the preparation of the copolymer are the same as those described for the resin (P) comprising the fluorine atom and/or silicon atom-containing polymer components as a block described hereinbefore.

The content of polymer component (f) is preferably from 1 to 20% by weight based on the total polymer component in the resin (A). If the content of polymer component (f) is less than 1% by weight, the effect for improving the releasability of the resin (A) is small and on the other hand, if the content is more than 20% by weight, wettability of the resin (A) with a processing solution may tend to decrease, resulting in some difficulties for complete removal of the transfer layer.

Moreover, the resin (A) may further contain other copolymerizable polymer components than the above described specific polymer components. Examples of monomers corresponding to such other polymer components include, in addition to methacrylic acid esters, acrylic acid esters and crotonic acid esters containing substituents other than those described for the general formula (U), α-olefins, vinyl or allyl esters of carboxylic acids (including, e.g., acetic acid, propionic acid, butyric acid, valeric acid, benzoic acid, naphthalenecarboxylic acid, as examples of the carboxylic acids), acrylonitrile, methacrylonitrile, vinyl ethers, itaconic acid esters (e.g., dimethyl ester, and diethyl ester), acrylamides, methacrylamides, styrenes (e.g., styrene, vinyltoluene, chlorostyrene, N,N-dimethylaminomethylstyrene, methoxycarbonylstyrene, methanesulfonyloxystyrene, and vinylnaphthalene), vinyl sulfone compounds, vinyl ketone compounds, and heterocyclic vinyl compounds (e.g., vinylpyrrolidone, vinylpyridine, vinylimidazole, vinylthiophene, vinylimidazoline, vinylpyrazoles, vinyldioxane, vinylquinoline, vinyltetrazole, and vinyloxazine). Such other polymer components may be employed in an appropriate range wherein the transferability of the resin (A) is not damaged. Specifically, it is preferred that the content of such other polymer components does not exceed 30% by weight based on the total polymer component of the resin (A).

The resin (A) may be employed individually or as a combination of two or more thereof.

According to a preferred embodiment of the present invention, the transfer layer is composed of at least two resins (A) having a glass transition point or a softening point different from each other. By using such a combination of the resins (A), transferability of the transfer layer is further improved.

Specifically, the transfer layer mainly contains a resin having a glass transition point of from 10° C. to 140° C. or a softening point of from 35° C. to 180° C. (hereinafter referred to as resin (AH) sometimes) and a resin having a glass transition point of not more than 45° C. or a softening point of not more than 60° C. (hereinafter referred to as resin (AL) sometimes) in which a difference in the glass transition point or softening point between the resin (AH) and the resin (AL) is at least 2° C.

Further, the resin (AH) has a glass transition point of preferably from 30° C. to 120° C., and more preferably from 35° C. to 90° C., or a softening point of preferably from 38° C. to 160° C., and more preferably from 40° C. to 120° C., and on the other hand, the thermoplastic resin (AL) has a glass transition point of preferably from −50° C. to 40° C., and more preferably from −20° C. to 33° C., or a softening point of preferably from −30° C. to 45° C., and more preferably from 0° C. to 40° C. The difference in the glass transition point or softening point between the resin (AH) and the resin (AL) used is preferably at least 5° C., and more preferably at least 10° C. The difference in the glass transition point or softening point between the resin (AH) and the resin (AL) means a difference between the lowest glass transition point or softening point of those of the resins (AH) and the highest glass transition point or softening point of those of the resins (AL) when two or more of the resins (AH) and/or resins (AL) are employed.

The resin (AH) and/or resin (AL) may contain the polymer component (f) described above, if desired.

A weight ratio of the resin (AH)/the resin (AL) used in the transfer layer is preferably from 5/95 to 90/10, more preferably from 10/90 to 70/30.

If desired, the transfer layer may further contain other conventional resins in addition to the resin (A). It should be noted, however, that such other resins be used in a range that the easy removal of the transfer layer is not deteriorated.

Specifically, the polymer components (a) and/or (b) are preferably present at least 3% by weight based on the total resin used in the transfer layer.

Examples of other resins which may be used combination with the resin (A) include vinyl chloride resins, polyolefin resins, acrylic ester polymers or copolymers, methacrylic ester polymers or copolymers, styrene-acrylic ester copolymers, styrene-methacrylic ester copolymers, itaconic diester polymers or copolymers, maleic anhydride copolymers, acrylamide copolymers, methacrylamide copolymers, hydroxy group-modified silicone resins, polycarbonate resins, ketone resins, polyester resins, silicone resins, amide resins, hydroxy group- or carboxy group-modified polyester resins, butyral resins, polyvinyl acetal resins, cyclized rubber-methacrylic ester copolymers, cyclized rubber-acrylic ester copolymers, copolymers containing a heterocyclic ring (the heterocyclic ring including furan, tetrahydrofuran, thiophene, dioxane, dioxofuran, lactone, benzofuran, benzothiophene and 1,3-dioxethane rings), cellulose resins, fatty acid-modified cellulose resins, and epoxy resins.

Further, specific examples of usable resins are described, e.g., in *Plastic Zairyo Koza Series*, Vols. 1 to 18, Nikkan Kogyo Shinbunsha (1981), Kinki Kagaku Kyokai Vinyl Bukai (ed.), *Polyenka Vinyl*, Nikkan Kogyo Shinbunsha (1988), Eizo Omori, *Kinosei Acryl Jushi*, Techno System (1985), Ei-ichiro Takiyama, *Polyester Jushi Handbook*, Nikkan Kogyo Shinbunsha (1988), Kazuo Yuki, *Howa Polyester Jushi Handbook*, Nikkan Kogyo Shinbunsha (1989), Kobunshi Gakkai (ed.), *Kobunshi Data Handbook* (*Oyohen*), Ch. 1, Baifukan (1986), Yuji Harasaki (ed.), *Saishin Binder Gijutsu Binran*, Ch. 2, Sogo Gijutsu Center (1985), Taira Okuda (ed.), *Kobunshi Kako*, Vol. 20, Supplement "Nenchaku", Kobunshi Kankokai (1976), Keizi Fukuzawa, *Nenchaku Gijutsu*, Kobunshi Kankokai (1987), Mamoru Nishiguchi, *Secchaku Binran*, 14th Ed., Kobunshi Kankokai (1985), and Nippon Secchaku Kokai (ed.), *Secchaku Handbook*, 2nd Ed., Nikkan Kogyo Shinbunsha (1980).

These resins may be used either individually or in combination of two or more thereof.

If desired, the transfer layer may contain various additives for improving physical characteristics, such as adhesion, film-forming property, and film strength. For example, rosin, petroleum resin, or silicone oil may be added for controlling adhesion; polybutene, DOP, DBP, low-molecular weight styrene resins, low molecular weight polyethylene wax, microcrystalline wax, or paraffin wax, as a plasticizer or a softening agent for improving wetting property to the light-sensitive element or decreasing melting viscosity; and a polymeric hindered polyvalent phenol, or a triazine derivative, as an antioxidant. For the details, reference can be made to Hiroshi Fukada, *Hot-melt Secchaku no Jissai*, pp. 29 to 107, Kobunshi Kankokai (1983).

The transfer layer may be composed of two or more layers, if desired. In accordance with a preferred embodiment, the transfer layer is composed of a first layer which is positioned on the light-sensitive element and which comprises a resin having a relatively high glass transition point or softening point, for example, one of the resins (AH) described above, and a second layer provided thereon comprising a resin having a relatively low glass transition point or softening point, for example, one of the resins (AL) described above, and in which the difference in the glass transition point or softening point therebetween is at least 2° C. By introducing such a configuration of the transfer layer, transferability of the transfer layer to a primary receptor is remarkably improved and a further enlarged latitude of transfer conditions (e.g., heating temperature, pressure, and transportation speed) can be achieved while maintaining easy transfer to a final receiving material irrespective of the kind of receiving material which is to be converted to a printing plate.

The transfer layer suitably has a thickness of from 0.1 to 10 μm, and preferably from 0.5 to 5 μm. When the thickness of transfer layer is at least 0.1 μm, the transfer is sufficiently performed. In order to save the amount of resin to be used, the upper limit thereof is usually 10 μm. When the transfer layer is composed of a plurality of layers, a thickness of a single layer is at least 0.1 μm while the thickness of the total layers is usually at most 10 μm.

According to the method of the present invention, the transfer layer is provided on the electrophotographic light-sensitive element. It is preferred that the transfer layer is provided on the light-sensitive element in an apparatus for performing the electrophotographic process. By the installation of a device of providing the transfer layer in the apparatus for performing the electrophotographic process, the light-sensitive element can be repeatedly employed after the transfer layer is released therefrom. Therefore, it is advantageous in that the formation and release of transfer layer can be performed in sequence with the electrophotographic process in the electrophotographic apparatus. As a result, a cost for the preparation of printing plate can be remarkably reduced.

In order to provide the transfer layer on the light-sensitive element in the present invention, conventional layer-forming methods can be employed. For instance, a solution or dispersion containing the composition for transfer layer is applied onto the surface of light-sensitive element in a known manner. In particular, for the formation of transfer layer on the surface of light-sensitive element, a hot-melt coating method, an electrodeposition coating method or a transfer method from a releasable support is preferably used. These methods are preferred in view of easy formation of the transfer layer on the surface of light-sensitive element in an electrophotographic apparatus. Each of these methods will be described in greater detail below.

The hot-melt coating method comprises hot-melt coating of the composition for the transfer layer by a known method. For such a purpose, a mechanism of a non-solvent type coating machine, for example, a hot-melt coating apparatus for a hot-melt adhesive (hot-melt coater) as described in the above-mentioned *Hot-melt Secchaku no Jissai*, pp. 197 to 215 can be utilized with modification to suit with coating onto the light-sensitive element. Suitable examples of coating machines include a direct roll coater, an offset gravure roll coater, a rod coater, an extrusion coater, a slot orifice coater, and a curtain coater.

A melting temperature of the resin (A) at coating is usually in a range of from 50° to 180° C., while the optimum temperature is determined depending on the composition of the resin to be used. It is preferred that the resin is first molten using a closed pre-heating device having an automatic temperature controlling means and then heated in a short time to the desired temperature in a position to be coated on the light-sensitive element. To do so can prevent from degradation of the resin upon thermal oxidation and unevenness in coating.

A coating speed may be varied depending on flowability of the resin at the time of being molten by heating, a kind of coater, and a coating amount, etc., but is suitably in a range of from 1 to 100 mm/sec, preferably from 5 to 40 mm/sec.

Now, the electrodeposition coating method will be described below. According to this method, the resin (A) is electrostatically adhered or electrodeposited (hereinafter simply referred to as electrodeposition sometimes) on the surface of light-sensitive element in the form of resin grains and then transformed into a uniform thin film, for example, by heating, thereby forming the transfer layer. Grains of the resins (A) are sometimes referred to as resin grains (AR) hereinafter.

The resin grains must have either a positive charge or a negative charge. The electroscopicity of the resin grains is appropriately determined depending on a charging property of the light-sensitive element to be used in combination.

The resin grains may contain two or more resins, if desired. For instance, when a combination of resins, for example, those selected from the resins (AH) and (AL), whose glass transition points or softening points are different at least 2° C. from each other is used, improvement in transferability of the transfer layer formed therefrom to a receiving material and an enlarged latitude of transfer conditions can be achieved. The resin grains containing at least two kinds of resins therein are sometimes referred to as resin grains (ARW) hereinafter. In such a case, these resins may be present as a mixture in the grains or may form a layered structure such as a core/shell structure wherein a core part and a shell part are composed of different resins respectively. Resin grains having a core/shell structure wherein the core part is composed of one of the resins (AL) and (AH) and the shell part is composed of the other resin are preferred to form the transfer layer since the transfer onto a receiving material can be rapidly performed under mild conditions.

An average grain diameter of the resin grains having the physical property described above is generally in a range of from 0.01 to 15 μm, preferably from 0.05 to 5 μm and more preferably from 0.1 to 1 μm. The resin grains may be employed as powder grains (in case of dry type electrodeposition), grains dispersed in a non-aqueous system (in case of wet type electrodeposition), or grains dispersed in an electrically insulating organic substance which is solid at normal temperature but becomes liquid by heating (in case of pseudo-wet type electrodeposition). The resin grains dispersed in a non-aqueous system are preferred since they can easily prepare a thin layer of uniform thickness.

The resin grains used in the present invention can be produced by a conventionally known mechanical powdering method or polymerization granulation method. These methods can be applied to the production of resin grains for both of dry type electrodeposition and wet type electrodeposition.

The mechanical powdering method for producing powder grains used in the dry type electrodeposition method includes a method wherein the resin is directly powdered by a conventionally known pulverizer to form fine grains (for example, a method using a ball mill, a paint shaker or a jet mill). If desired, mixing, melting and kneading of the materials for resin grains before the powdering and classification for a purpose of controlling a grain diameter and after-treatment for treating the surface of grain after the powdering may be performed in an appropriate combination. A spray dry method is also employed.

Specifically, the powder grains can be easily produced by appropriately using a method as described in detail, for example, in Shadanhojin Nippon Funtai Kogyo Gijutsu Kyokai (ed.), *Zoryu Handbook*, II ed., Ohm Sha (1991), Kanagawa Keiei Kaihatsu Center, *Saishin Zoryu Gijutsu no Jissai*, Kanagawa Keiei Kaihatsu Center Shuppan-bu (1984), and Masafumi Arakawa et al (ed.), *Saishin Funtai no Sekkei Gijutsu*, Techno System (1988).

The polymerization granulation methods include conventionally known methods using an emulsion polymerization reaction, a seed polymerization reaction or a suspension polymerization reaction each conducted in an aqueous system, or using a dispersion polymerization reaction conducted in a non-aqueous solvent system.

More specifically, grains are formed according to the methods as described, for example, in Soichi Muroi, *Kobunshi Latex no Kagaku*, Kobunshi Kankokai (1970), Taira Okuda and Hiroshi Inagaki, *Gosei Jushi Emulsion*, Kobunshi Kankokai (1978), Soichi Muroi, *Kobunshi Latex Nyumon*, Kobunsha (1983), I. Pürma and P. C. Wang, *Emulsion Polymerization*, I. Pürma and J. L. Gaudon, *ACS Symp. Sev.*, 24, p. 34 (1974), Fumio Kitahara et al, *Bunsan Nyukakei no Kagaku*, Kogaku Tosho (1979), and Soichi Muroi (supervised), *Chobiryushi Polymer no Saisentan Gijutsu*, C.M.C. (1991), and then collected and pulverized in such a manner as described in the reference literatures cited with respect to the mechanical method above, thereby the resin grains being obtained.

In order to conduct dry type electrodeposition of the fine powder grains thus-obtained, a conventionally known method, for example, a coating method of electrostatic powder and a developing method with a dry type electrostatic developing agent can be employed. More specifically, a method for electrodeposition of fine grains charged by a method utilizing, for example, corona charge, triboelectrification, induction charge, ion flow charge, and inverse ionization phenomenon, as described, for example, in J. F. Hughes, *Seiden Funtai Toso*, translated by Hideo Nagasaka and Machiko Midorikawa, or a developing method, for example, a cascade method, a magnetic brush method, a fur brush method, an electrostatic method, an induction method, a touchdown method and a powder cloud method, as described, for example, in Koich Nakamura (ed.), *Saikin no Denshishashin Genzo System to Toner Zairyo no Kaihatsu•Jitsuyoka*, Ch. 1, Nippon Kogaku Joho (1985) is appropriately employed.

The production of resin grains dispersed in a non-aqueous system which are used in the wet type electrodeposition method can also be performed by any of the mechanical powdering method and polymerization granulation method as described above.

The mechanical powdering method includes a method wherein the thermoplastic resin is dispersed together with a dispersion polymer in a wet type dispersion machine (for example, a ball mill, a paint shaker, Keddy mill, and Dyno-mill), and a method wherein the materials for resin grains and a dispersion assistant polymer (or a covering polymer) have been previously kneaded, the resulting mixture is pulverized and then is dispersed together with a dispersion polymer. Specifically, a method of producing paints or electrostatic developing agents can be utilized as described, for example, in Kenji Ueki (translated), *Toryo no Ryudo to Ganryo Bunsan,* Kyoritsu Shuppan (1971), D. H. Solomon, *The Chemistry of Organic Film Formers*, John Wiley & Sons (1967), *Paint and Surface Coating Theory and Practice*, Yuji Harasaki, *Coating Kogaku*, Asakura Shoten (1971), and Yuji Harasaki, *Coating no Kiso Kagaku*, Maki Shoten (1977).

The polymerization granulation method includes a dispersion polymerization method in a non-aqueous system conventionally known and is specifically described, for example, in *Chobiryushi Polymer no Saisentan Gijutsu*, Ch. 2, mentioned above, *Saikin no Denshishashin Genzo System to Toner Zairyo no Kaihatsu•Jitsuyoka*, Ch. 3, mentioned above, and K. E. J. Barrett, *Dispersion Polymerization in Organic Media*, John Wiley & Sons (1975).

The resin grains (ARW) having a core/shell structure containing at least two kinds of resins having different glass transition points or softening points from each other therein described above can also be prepared easily using the seed polymerization method. Specifically, fine grains composed of the first resin are prepared by a conventionally known dispersion polymerization method in a non-aqueous system and then using these fine grains as seeds, a monomer corresponding to the second resin is supplied to conduct polymerization in the same manner as above.

The resin grains (AR) composed of a random copolymer containing the polymer component (f) to increase the peelability of the resin (A) can be easily obtained by performing a polymerization reaction using one or more monomers forming the resin (A) which are soluble in an organic solvent but becomes insoluble therein by being polymerized together with a monomer corresponding to the polymer component (f) according to the polymerization granulation method described above.

The resin grains (AR) containing the polymer component (f) as a block can be prepared by conducting a polymerization reaction using, as a dispersion stabilizing resins, a block copolymer containing the polymer component (f) as a block, or conducting polymerization reaction using a monofunctional macromonomer having a weight average molecular weight of from $1\times10^3$ to $2\times10^4$, preferably from $3\times10^3$ to $1.5\times10^4$ and containing the polymer component (f) as the main repeating unit together with one or more monomers forming the resin (A). Alternatively, the resin grains composed of block copolymer can be obtained by conducting a polymerization reaction using a polymer initiator (for example, azobis polymer initiator or peroxide polymer initiator) containing the polymer component (f) as the main repeating unit.

As the non-aqueous solvent used in the dispersion polymerization method in a non-aqueous system, there can be used any of organic solvents having a boiling point of at most 200° C., individually or in a combination of two or more thereof. Specific examples of the organic solvent include alcohols such as methanol, ethanol, propanol, butanol, fluorinated alcohols and benzyl alcohol, ketones such as acetone, methyl ethyl ketone, cyclohexanone and diethyl ketone, ethers such as diethyl ether, tetrahydrofuran and dioxane, carboxylic acid esters such as methyl acetate, ethyl acetate, butyl acetate and methyl propionate, aliphatic hydrocarbons containing from 6 to 14 carbon atoms such as hexane, octane, decane, dodecane, tridecane, cyclohexane and cyclooctane, aromatic hydrocarbons such as benzene, toluene, xylene and chlorobenzene, and halogenated hydrocarbons such as methylene chloride, dichloroethane, tetrachloroethane, chloroform, methylchloroform, dichloropropane and trichloroethane. However, the present invention should not be construed as being limited thereto.

When the dispersed resin grains are synthesized by the dispersion polymerization method in a non-aqueous solvent system, the average grain diameter of the dispersed resin grains can readily be adjusted to at most 1 μm while simultaneously obtaining grains of monodisperse system with a very narrow distribution of grain diameters.

A dispersive medium used for the resin grains dispersed in a non-aqueous system is preferably a non-aqueous solvent having an electric resistance of not less than $10^8$ Ω·cm and a dielectric constant of not more than 3.5, since the dispersion is employed in a method wherein the resin grains are electrodeposited utilizing a wet type electrostatic photographic developing process or electrophoresis in electric fields.

The insulating solvents which can be used include straight chain or branched chain aliphatic hydrocarbons, alicyclic hydrocarbons, aromatic hydrocarbons, and halogen-substituted derivatives thereof. Specific examples of the solvent include octane, isooctane, decane, isodecane, decalin, nonane, dodecane, isododecane, cyclohexane, cyclooctane, cyclodecane, benzene, toluene, xylene, mesitylene, Isopar E, Isopar G, Isopar H, Isopar L (Isopar: trade name of Exxon Co.), Shellsol 70, Shellsol 71 (Shellsol: trade name of Shell Oil Co.), Amsco OMS and Amsco 460 Solvent (Amsco: trade name of Americal Mineral Spirits Co.). They may be used singly or as a combination thereof.

The insulating organic solvent described above is preferably employed as a non-aqueous solvent from the beginning of polymerization granulation of resin grains dispersed in the non-aqueous system. However, it is also possible that the granulation is performed in a solvent other than the above-described insulating solvent and then the dispersive medium is substituted with the insulating solvent to prepare the desired dispersion.

Another method for the preparation of a dispersion of resin grains in non-aqueous system is that a block copolymer comprising a polymer portion which is soluble in the above-described non-aqueous solvent having an electric resistance of not less than $10^8$ Ω·cm and a dielectric constant of not more than 3.5 and a polymer portion which is insoluble in the non-aqueous solvent, is dispersed in the non-aqueous solvent by a wet type dispersion method. Specifically, the block copolymer is first synthesized in an organic solvent which dissolves the resulting block copolymer according to the synthesis method of block copolymer as described above and then dispersed in the non-aqueous solvent described above.

In order to electrodeposit dispersed grains in a dispersive medium upon electrophoresis, the grains must be electroscopic grains of positive charge or negative charge. The impartation of electroscopicity to the grains can be performed by appropriately utilizing techniques on developing agents for wet type electrostatic photography. More specifically, it can be carried out using electroscopic materials and other additives as described, for example, in *Saikin no Denshishashin Genzo System to Toner Zairyo no Kaihatsu•Jitsuyoka*, pp. 139 to 148, mentioned above, Denshishashin Gakkai (ed.), *Denshishashin Gijutsu no Kiso to Oyo*, pp. 497 to 505, Corona Sha (1988), and Yuji Harasaki, *Denshishashin*, Vol. 16, No. 2, p. 44 (1977). Further, compounds as described, for example, in British Patents 893,429 and 934,038, U.S. Pat. Nos. 1,122,397, 3,900,412 and 4,606,989, JP-A-60-179751, JP-A-60-185963 and JP-A-2-13965 are also employed.

The dispersion of resin grains in a non-aqueous system (latex) which can be employed for electrodeposition usually comprises from 0.1 to 20 g of grains mainly containing the resin (A), from 0.01 to 50 g of a dispersion stabilizing resin and if desired, from 0.0001 to 10 g of a charge control agent per one liter of an electrically insulating dispersive medium.

Furthermore, if desired, other additives may be added to the dispersion of resin grains in order to maintain dispersion stability and charging stability of grains. Suitable examples of such additives include rosin, petroleum resins, higher alcohols, polyethers, silicone oil, paraffin wax and triazine derivatives. The total amount of these additives is restricted by the electric resistance of the dispersion. Specifically, if the electric resistance of the dispersion in a state of excluding the grains therefrom becomes lower than $10^8$ Ω·cm, a sufficient amount of the resin grains deposited is reluctant to obtain and, hence, it is necessary to control the amounts of these additives in the range of not lowering the electric resistance than $10^8$ Ω·cm.

The resin grains which are prepared, provided with an electrostatic charge and dispersed in an electrically insulting liquid behave in the same manner as an electrophotographic wet type developing agent. For instance, the resin grains can be subjected to electrophoresis on the surface of light-sensitive element using a developing device, for example, a slit development electrode device as described in *Denshishashin Gijutsu no Kiso to Oyo*, pp. 275 to 285, mentioned above. Specifically, the grains comprising the resin (A) are supplied between the light-sensitive element and an electrode placed in face of the light-sensitive element, and migrated by electrophoresis according to a potential gradient applied from an external power source to cause the grains to adhere to or electrodeposit on the light-sensitive element, thereby forming a film.

In general, if the charge of grains is positive, an electric voltage was applied between an electroconductive support of the light-sensitive element and a development electrode of a developing device from an external power source so that the light-sensitive element is negatively charged, thereby the grains being electrostatically electrodeposited on the surface of light-sensitive element.

Electrodeposition of grains can also be performed by wet type toner development in a conventional electrophotographic process. Specifically, the light-sensitive element is uniformly charged and then subjected to a conventional wet type toner development as described in *Denshishashin Gijutsu no Kiso to Oyo*, pp. 46 to 79, mentioned above.

The medium for the resin grains dispersed therein which becomes liquid by heating is an electrically insulating organic compound which is solid at normal temperature and becomes liquid by heating at temperature of from 30° C. to 80° C., preferably from 40° C. to 70° C. Suitable compounds include paraffins having a solidifying point of from 30° C. to 80° C., waxes, low molecular weight polypropylene having a solidifying point of from 20° C. to 80° C., beef tallow having a solidifying point of from 20° C. to 50° C. and hardened oils having a solidifying point of from 30° C. to 80° C. They may be employed individually or as a combination of two or more thereof.

Other characteristics required are same as those for the dispersion of resin grains used in the wet type developing method.

The resin grains used in the pseudo-wet type electrodeposition according to the present invention can stably maintain their state of dispersion without the occurrence of heat adhesion of dispersed resin grains by forming a core/shell structure wherein the core portion is composed of a resin having a lower glass transition point or softening point and the shell portion is composed of a resin having a higher glass transition point or softening point which is not softened at the temperature at which the medium used becomes liquid.

The amount of resin grain adhered to the light-sensitive element can be appropriately controlled, for example, by modifying an external bias voltage applied, a potential of the light-sensitive element charged and a processing time.

After the electrodeposition of grains, the liquid is wiped off upon squeeze using a rubber roller, a gap roller or a reverse roller. Other known methods, for example, corona squeeze and air squeeze can also be employed. Then, the deposit is dried with cool air or warm air or by a infrared lamp preferably to be rendered the resin grains in the form of a film, thereby forming the transfer layer.

The electrodeposition coating method is particularly preferred since a device used therefor is simple and compact and a uniform layer of a small thickness can be stably and easily prepared.

Now, the formation of transfer layer by the transfer method from a releasable support will be described below. According to this method, the transfer layer provided on a releasable support typically represented by release paper (hereinafter simply referred to as release paper) is transferred onto the surface of light-sensitive element.

The release paper having the transfer layer thereon is simply supplied to a transfer device in the form of a roll or sheet.

The release paper which can be employed in the present invention include those conventionally known as described, for example, in *Nenchaku (Nensecchaku) no Shin Gijutsu to Sono Yoto•Kakushu Oyoseihin no Kaihatsu Siryo*, published by Keiei Kaihatsu Center Shuppan-bu (May 20, 1978), and *All Paper Guide Shi no Shohin Jiten, Jo Kan, Bunka Sangyo Hen*, published by Shigyo Times Sha (Dec. 1, 1983).

Specifically, the release paper comprises a substrate such as nature Clupak paper laminated with a polyethylene resin, high quality paper pre-coated with a solvent-resistant resin, kraft paper, a PET film having an under-coating or glassine having coated thereon a release agent mainly composed of silicone.

A solvent type of silicone is usually employed and a solution thereof having a concentration of from 3 to 7% by weight is coated on the substrate, for example, by a gravure roll, a reverse roll or a wire bar, dried and then subjected to heat treatment at not less than 150° C. to be cured. The coating amount is usually about 1 g/m$^2$.

Release paper for tapes, labels, formation industry use and cast coat industry use each manufactured by a paper making company and put on sale are also generally employed. Specific examples thereof include Separate Shi (manufactured by Oji Paper Co., Ltd.), King Rease (manufactured by Shikoku Seishi K.K.), San Release (manufactured by Sanyo Kokusaku Pulp K.K.) and NK High Release (manufactured by Nippon Kako Seishi K.K.).

In order to form the transfer layer on release paper, a composition for the transfer layer mainly composed of the resin (A) is applied to releasing paper in a conventional manner, for example, by bar coating, spin coating or spray coating to form a film. The transfer layer may also be formed on release paper by a hot-melt coating method or an electrodeposition coating method.

Figure 4:
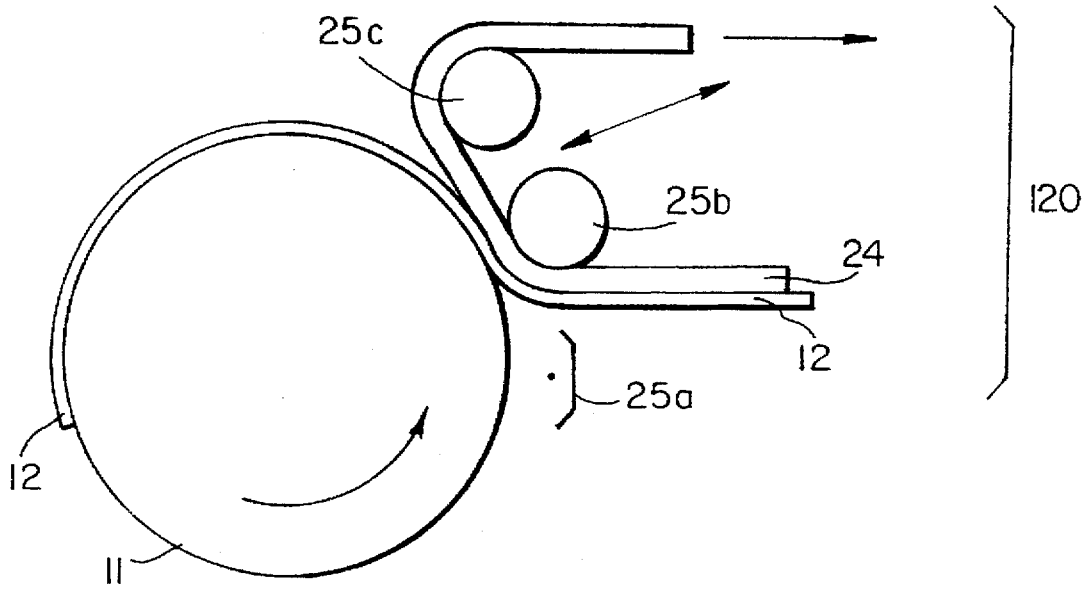
FIG. 4 is a partially schematic view of a device for providing a transfer layer on a light-sensitive element utilizing release paper.

For a purpose of heat transfer of the transfer layer on release paper to the light-sensitive element, conventional heat transfer methods are utilized. Specifically, release paper having the transfer layer thereon is pressed on the light-sensitive element to heat transfer the transfer layer. For instance, a device shown in FIG. 4 is employed for such a purpose.

The conditions for transfer of the transfer layer from release paper to the surface of light-sensitive element are preferably as follows. A nip pressure of the roller is from 0.1 to 10 kgf/cm$^2$ and more preferably from 0.2 to 8 kgf/cm$^2$. A temperature at the transfer is from 25° to 100° C. and more preferably from 40° to 80° C. A speed of the transportation is from 0.5 to 300 mm/sec and more preferably from 3 to 200 mm/sec. The speed of transportation may differ from that of the electrophotographic step, or that of the heat transfer step of the transfer layer to a primary receptor.

Now, the formation of toner image on the transfer layer provided on the electrophotographic light-sensitive element whose surface has releasability will be described in detail below.

For the formation of toner image, a conventional electrophotographic process can be utilized. Specifically, each step of charging, light exposure, development and fixing is performed in a conventionally known manner.

In order to form the toner image by an electrophotographic process according to the present invention, any methods and apparatus conventionally known can be employed.

The developers which can be used in the present invention include conventionally known developers for electrostatic photography, either dry type or liquid type. For example, specific examples of the developer are described in *Denshishashin Gijutsu no Kiso to Oyo*, supra, pp. 497–505, Koichi Nakamura (ed.), *Toner Zairyo no Kaihatsu•Jitsuyoka*, Ch. 3, Nippon Kagaku Joho (1985), Gen Machida, *Kirokuyo Zairyo to Kankosei Jushi*, pp. 107–127 (1983), and Denshishasin Gakkai (ed.), *Imaging*, Nos. 2–5, "Denshishashin no Genzo•Teichaku•Taiden•Tensha,", Gakkai Shuppan Center.

Dry developers practically used include one-component magnetic toners, two-component toners, one-component non-magnetic toners, and capsule toners. Any of these dry developers may be employed in the present invention.

The typical liquid developer is basically composed of an insulating organic solvent, for example, an isoparaffinic aliphatic hydrocarbon (e.g., Isopar H or Isopar G (manufactured by Esso Chemical Co.), Shellsol 70 or Shellsol 71 (manufactured by Shell Oil Co.) or IP-Solvent 1620 (manufactured by Idemitsu Petro-Chemical Co., Ltd.)) as a dispersion medium, having dispersed therein a colorant (e.g., an organic or inorganic dye or pigment) and a resin for imparting dispersion stability, fixability, and chargeability to the developer (e.g., an alkyd resin, an acrylic resin, a polyester resin, a styrene-butadiene resin, and rosin). If desired, the liquid developer can contain various additives for enhancing charging characteristics or improving image characteristics.

The colorant is appropriately selected from known dyes and pigments, for example, benzidine type, azo type, azomethine type, xanthene type, anthraquinone type, phthalocyanine type (including metallized type), titanium white, nigrosine, aniline black, and carbon black.

Other additives include, for example, those described in Yuji Harasaki, *Denshishashin*, Vol. 16, No. 2, p. 44, such as di-2-ethylhexylsufosuccinic acid metal salts, naphthenic acid metal salts, higher fatty acid metal salts, alkylbenzenesulfonic acid metal salts, alkylphosphoric acid metal salts, lecithin, polyvinylpyrrolidone, copolymers containing a maleic acid monoamido component, coumarone-indene resins, higher alcohols, polyethers, polysiloxanes, and waxes.

With respect to the content of each of the main components of the liquid developer, toner particles mainly comprising a resin (and, if desired, a colorant) are preferably present in an amount of from 0.5 to 50 parts by weight per 1000 parts by weight of a carrier liquid. If the toner content is less than 0.5 part by weight, the image density is insufficient, and if it exceeds 50 parts by weight, the occurrence of fog in the non-image areas may be tended to.

If desired, the above-described resin for dispersion stabilization which is soluble in the carrier liquid is added in an amount of from about 0.5 to about 100 parts by weight per 1000 parts by weight of the carrier liquid. The above-described charge control agent can be preferably added in an amount of from 0.001 to 1.0 part by weight per 1000 parts by weight of the carrier liquid. Other additives may be added to the liquid developer, if desired. The upper limit of the total amount of other additives is determined, depending on electrical resistance of the liquid developer. Specifically, the amount of each additive should be controlled so that the liquid developer exclusive of toner particles has an electrical resistivity of not less than $10^9$ Ωcm. If the resistivity is less than $10^9$ Ωcm, a continuous gradation image of good quality can hardly be obtained.

The liquid developer can be prepared, for example, by mechanically dispersing a colorant and a resin in a dispersing machine, e.g., a sand mill, a ball mill, a jet mill, or an attritor, to produce colored particles, as described, for example, in JP-B-35-5511, JP-B-35-13424, JP-B-50-40017, JP-B-49-98634, JP-B-58-129438, and JP-A-61-180248.

The colored particles may also be obtained by a method comprising preparing dispersed resin grains having a fine grain size and good monodispersity in accordance with a non-aqueous dispersion polymerization method and coloring the resulting resin grains. In such a case, the dispersed grains prepared can be colored by dyeing with an appropriate dye as described, e.g., in JP-A-57-48738, or by chemical bonding of the dispersed grains with a dye as described, e.g., in JP-A-53-54029. It is also effective to polymerize a monomer already containing a dye at the polymerization granulation to obtain a dye-containing copolymer as described, e.g., in JP-B-44-22955.

Particularly, a combination of a scanning exposure system using a laser beam based on digital information and a development system using a liquid developer is an advantageous process since the process is particularly suitable to form highly accurate images.

One specific example of the methods for preparing a color transfer image is illustrated below. An electrophotographic light-sensitive material comprising a transfer layer provided on an electrophotographic light-sensitive element is positioned on a flat bed by a register pin system and fixed on the flat bed by air suction from the backside. Then it is charged by means of a charging device, for example, the device as described in Denshishashin Gakkai (ed.), *Denshishashin Gijutsu no Kiso to Oyo*, p. 212 et seq., Corona Sha (1988). A corotron or scotron system is usually used for the charging process. In a preferred charging process, the charging conditions may be controlled by a feedback system of the information on charged potential from a detector connected to the light-sensitive material thereby to control the surface potential within a predetermined range.

Thereafter, the charged light-sensitive material is exposed to light by scanning with a laser beam in accordance with the system described, for example, in ibidem, p. 254 et seq.

Toner development is then conducted using a liquid developer. The light-sensitive material charged and exposed is removed from the flat bed and developed according to a wet type developing method as described, for example, in ibidem, p. 275 et seq. The exposure mode is determined in accordance with the toner image development mode. Specifically, in case of reversal development, a negative image is irradiated with a laser beam, and a toner having the same charge polarity as that of the charged light-sensitive material is electrodeposited on the exposed area with a bias voltage applied. For the details, reference can be made to ibidem, p. 157 et seq.

After the toner development, the light-sensitive material is squeezed to remove the excess developer as described in ibidem, p. 283 and dried. Preferably, the light-sensitive material is rinsed with the carrier liquid used in the liquid developer before squeezing.

According to the method of the present invention, after the formation of toner image on the transfer layer provided on the light-sensitive element, the toner image is heat-transferred together with the transfer layer onto a primary receptor.

The heat-transfer of the toner image together with the transfer layer onto a primary receptor can be performed using known methods and devices. For instance, the light-sensitive element having the transfer layer and the toner image formed thereon is brought into intimate contact with a primary receptor and they are passed between rollers under pressure and the toner image is transferred together with the transfer layer onto a primary receptor.

The surface temperature of transfer layer at the time of heat transfer is preferably in a range of from 30° to 150° C., and more preferably from 35° to 90° C. A non-contact type heater such as an infrared line heater or a flash heater is employed in order to heat the transfer layer into the desired temperature range, if desired.

The nip pressure of rollers is preferably in a range of from 0.2 to 20 kgf/cm$^2$ and more preferably from 0.5 to 15 kgf/cm$^2$. The rollers may be pressed by springs provided on opposite ends of the roller shaft or by an air cylinder using compressed air. A speed of the transportation is preferably in a range of from 0.1 to 300 mm/sec and more preferably in a range of from 10 to 250 mm/sec. The speed of transportation may differ between the electrophotographic process and the heat transfer step.

Now, the primary receptor which can be used in the present invention will be described in detail below. It is important that releasability of the surface of primary receptor is less than releasability of the surface of light-sensitive element but is sufficient for peeling and transferring onto a receiving material. Specifically, the surface of primary receptor has the adhesive strength larger, preferably 10 g·f larger, more preferably 50 g·f larger, than the adhesive strength of the surface of light-sensitive element. On the other hand, the adhesive strength of the surface of primary receptor is preferably at most 250 g·f, more preferably at most 200 g·f.

Any type of primary receptor can be employed as long as the above described conditions are fulfilled. For example, primary receptors of a drum type and an endless belt type which are repeatedly usable are preferred in the present invention. Also, any material can be employed for the primary receptor as long as the conditions described above are fulfilled. In the primary receptor of drum type or endless belt type, an elastic material layer or a stratified structure of an elastic material layer and a reinforcing layer is preferably provided on the surface thereof stationarily or removably so as to be replaced.

Any of conventionally known natural resins and synthetic reins can be used as the elastic material. These resins may be used either individually or as a combination of two or more thereof in a single or plural layer. Specifically, various resins described, for example, in A. D. Roberts, *Natural Rubber Science and Technology*, Oxford Science Publications (1988), W. Hofmann, *Rubber Technology Handbook*, Hanser Publisher (1989) and *Plastic Zairyo Koza*, Vols. 1 to 18, Nikkan Kogyo Shinbunsha can be employed.

Specific examples of the elastic material include styrene-butadiene rubber, butadiene rubber, acrylonitrile-butadiene rubber, cyclized rubber, chloroprene rubber, ethylene-propylene rubber, butyl rubber, chloro-sulfonated polyethylene rubber, silicone rubber, fluoro-rubber, polysulfide rubber, natural rubber, isoprene rubber and urethane rubber. The desired elastic material can be appropriately selected by taking releasability from the transfer layer, durability, etc. into consideration. The thickness of elastic material layer is preferably from 0.01 to 10 mm.

Examples of materials used in the reinforcing layer for the elastic material layer include cloth, glass fiber, resin-impregnated specialty paper, aluminum and stainless steel. A spongy rubber layer may be provided between the surface elastic material layer and the reinforcing layer.

Conventionally known materials can be used as materials for the primary receptor of endless belt type. For example, those described in U.S. Pat. Nos. 3,893,761, 4,684,238 and 4,690,539 are employed. Further, a layer serving as a heating medium may be provided in the belt as described in JP-W-4-503265 (the term "JP-W" as used herein means an "unexamined published international patent application").

The adhesive strength of the surface of primary receptor can be easily adjusted by applying the method as described with respect to the releasability of the surface of light-sensitive element hereinbefore, including the application of the compound (S). The surface of primary receptor has preferably an average roughness of 0.01 mm or below.

The toner image on the primary receptor is then heat-transferred together with the transfer layer onto a receiving material.

The receiving material used in the present invention is any of material which provide a hydrophilic surface suitable for lithographic printing. Supports conventionally used for offset printing plates (lithographic printing plates) can be preferably employed. Specific examples of support include a substrate having a hydrophilic surface, for example, a plastic sheet, paper having been rendered durable to printing, an aluminum plate, a zinc plate, a bimetal plate, e.g., a copper-aluminum plate, a copper-stainless steel plate, or a chromium-copper plate, a trimetal plate, e.g., a chromium-copper-aluminum plate, a chromium-lead-iron plate, or a chromium-copper-stainless steel plate. The support preferably has a thickness of from 0.1 to 3 mm, and particularly from 0.1 to 1 mm.

A support with an aluminum surface is preferably subjected to a surface treatment, for example, surface graining, immersion in an aqueous solution of sodium silicate, potassium fluorozirconate or a phosphate, or anodizing. Also, an aluminum plate subjected to surface graining and then immersion in a sodium silicate aqueous solution as described in U.S. Pat. No. 2,714,066, or an aluminum plate subjected to anodizing and then immersion in an alkali silicate aqueous solution as described in JP-B-47-5125 is preferably employed.

Anodizing of an aluminum surface can be carried out by electrolysis of an electrolytic solution comprising at least one aqueous or nonaqueous solution of an inorganic acid (e.g., phosphoric acid, chromic acid, sulfuric acid or boric acid) or an organic acid (e.g., oxalic acid or sulfamic acid) or a salt thereof to oxidize the aluminum surface as an anode.

Silicate electrodeposition as described in U.S. Pat. No. 3,658,662 or a treatment with polyvinylsulfonic acid described in West German Patent Application (OLS) 1,621,478 is also effective.

The surface treatment is mainly conducted for rendering the surface of a support hydrophilic.

Further, in order to control an adhesion property between the support and the transfer layer having provided thereon the toner image, a surface layer may be provided on the surface of the support.

A plastic sheet or paper as the support should have a hydrophilic surface layer, as a matter of course, since its areas other than those corresponding to the toner images must be hydrophilic. Specifically, a receiving material having the same performance as a known direct writing type lithographic printing plate precursor or an image-receptive layer thereof may be employed.

The heat-transfer of the toner image together with the transfer layer onto a receiving material can be performed using known methods and apparatus.

Preferred ranges of temperature, nip pressure and transportation speed for the heat-transfer of transfer layer bearing the toner image from the primary receptor onto the receiving material are same as those described for the heat transfer step of toner image to the primary receptor respectively. Further, the specific conditions of transfer onto the receiving material may be the same as or different from those of transfer of toner image to the primary receptor.

The heat-transfer behavior of transfer layer onto the receiving material is considered as follows. Specifically, when the transfer layer softened to a certain extent, for example, by a pre-heating means is further heated, for example, a heating roller, the tackiness of the transfer layer increases and the transfer layer is closely adhered to the receiving material.

After the transfer layer is passed under a roller for release, for example, a cooling roller, the temperature of the transfer layer is decreased to reduce the flowability and the tackiness and thus the transfer layer is peeled as a film from the surface of the primary receptor together with the toner image thereon. Accordingly, the transfer conditions should be set so as to realize such a situation.

The cooling roller comprises a metal roller which has a good thermal conductivity such as aluminum, copper or the like and is covered with silicone rubber. It is preferred that the cooling roller is provided with a cooling means therein or on a portion of the outer surface which is not brought into contact with the receiving material in order to radiate heat. The cooling means includes a cooling fan, a coolant circulation or a thermoelectric cooling element, and it is preferred that the cooling means is coupled with a temperature controller so that the temperature of the cooling roller is maintained within a predetermined range.

In the method of the present invention, the transfer of toner image together with the transfer layer from the light-sensitive element to the primary receptor and the transfer of toner image together with the transfer layer from the primary receptor to the receiving material may be simultaneously performed within one sheet. Alternatively, after the transfer of all images of one sheet from the light-sensitive element to the primary receptor is completed, the image is then transferred to the receiving material.

It is needless to say that the above-described conditions for the transfer of toner image and transfer layer should be optimized depending on the physical properties of the light-sensitive element (i.e., the light-sensitive layer and the support), the transfer layer, the primary receptor, and the receiving material. Especially it is important to determine the conditions of temperature, in the heat transfer step taking into account the factors such as glass transition point, softening temperature, flowability, tackiness, film properties and film thickness of the transfer layer.

Now, the step of subjecting the receiving material having the transfer layer transferred together with the toner image thereon (printing plate precursor) with a chemical reaction treatment to remove the transfer layer in the non-image area, thereby providing a printing plate will be described below. In order to remove the transfer layer, an appropriate means can be selected in consideration of a chemical reaction treatment upon which a resin used in the transfer layer is removed. For instance, treatment with a processing solution, treatment with irradiation of actinic ray or a combination thereof can be employed for removal of the transfer layer. In the image area, the transfer layer is not removed since the toner image acts as a resist.

In order to effect the removal by a chemical reaction with a processing solution, an aqueous solution which is adjusted to the prescribed pH is used. Known pH control agents can be employed to adjust the pH of solution. While the pH of the processing solution used may be any of acidic, neutral and alkaline region, the processing solution is preferably employed in an alkaline region having a pH of 8 or higher taking account of an anticorrosive property and a property of dissolving the transfer layer. The alkaline processing solution can be prepared by using any of conventionally known organic or inorganic compounds, such as carbonates, sodium hydroxide, potassium hydroxide, potassium silicate, sodium silicate, and organic amine compounds, either individually or in combination thereof.

The processing solution may contain a hydrophilic compound which contains a substituent having a Pearson's nucleophilic constant n (refer to R. G. Pearson and H. Sobel, *J. Amer. Chem. Soc.*, Vol. 90, p. 319 (1968)) of not less than 5.5 and has a solubility of at least 1 part by weight in 100 parts by weight of distilled water, in order to accelerate the reaction for rendering hydrophilic.

Suitable examples of such hydrophilic compounds include hydrazines, hydroxylamines, sulfites (e.g., ammonium sulfite, sodium sulfite, potassium sulfite or zinc sulfite), thiosulfates, and mercapto compounds, hydrazide compounds, sulfinic acid compounds and primary or secondary amine compounds each containing at least one polar group selected from a hydroxyl group, a carboxyl group, a sulfo group, a phosphono group and an amino group in the molecule thereof.

Specific examples of the polar group-containing mercapto compounds include 2-mercaptoethanol, 2-mercaptoethylamine, N-methyl-2-mercaptoethylamine, N-(2-hydroxyethyl)-2-mercaptoethylamine, thioglycolic acid, thiomalic acid, thiosalicylic acid, mercaptobenzenecarboxylic acid, 2-mercaptotoluensulfonic acid, 2-mercaptoethylphosphonic acid, mercaptobenzenesulfonic acid, 2-mercaptopropionylaminoacetic acid, 2-mercapto-1-aminoacetic acid, 1-mercaptopropionylaminoacetic acid, 1,2-dimercaptopropionylaminoacetic acid, 2,3-dihydroxypropylmercaptan, and 2-methyl-2-mercapto-1-aminoacetic acid. Specific examples of the polar group-containing sulfinic acid compounds include 2-hydroxyethylsulfinic acid, 3-hydroxypropanesulfinic acid, 4-hydroxybutanesulfinic acid, carboxybenzenesulfinic acid, and dicarboxybenzenesulfinic acid. Specific examples of the polar group-containing hydrazide compounds include 2-hydrazinoethanolsulfonic acid, 4-hydrazinobutanesulfonic acid, hydrazinobenzenesulfonic acid, hydrazinobenzoic acid, and hydrazinobenzenecarboxylic acid. Specific examples of the polar group-containing primary or secondary amine compounds include N-(2-hydroxyethyl)amine, N,N-di(2-hydroxyethyl)amine, N,N-di(2-hydroxyethyl)ethylenediamine, tri(2-hydroxyethyl)ethylenediamine, N-(2,3-dihydroxypropyl)amine, N,N-di(2,3-dihydroxypropyl)amine, 2-aminopropionic acid, aminobenzoic acid, aminopyridine, aminobenzenedicarboxylic acid, 2-hydroxyethylmorpholine, 2-carboxyethylmorpholine, and 3-carboxypiperazine.

The amount of the nucleophilic compound present in the processing solution is preferably from 0.05 to 10 mol/l, and more preferably from 0.1 to 5 mol/l. The pH of the processing solution is preferably not less than 8.

The processing solution may contain other compounds in addition to the pH control agent and nucleophilic compound described above. For example, an organic solvent soluble in water may be used in a range of from about 1 to about 50 parts by weight per 100 parts by weight of water. Suitable examples of the water-soluble organic solvent include alcohols (e.g., methanol, ethanol, propanol, propargyl alcohol, benzyl alcohol, and phenethyl alcohol), ketones (e.g., acetone, methyl ethyl ketone, cyclohexanone and acetophenone), ethers (e.g., dioxane, trioxane, tetrahydrofuran, ethylene glycol dimethyl ether, propylene glycol diethyl ether, ethylene glycol monomethyl ether, propylene glycol monomethyl ether, and tetrahydropyran), amides (e.g., dimethylformamide, pyrrolidone, N-methylpyrrolidone, and dimethylacetamide), esters (e.g., methyl acetate, ethyl acetate, and ethyl formate), sulforan and tetramethylurea. These organic solvents may be used either individually or in combination of two or more thereof.

The processing solution may contain a surface active agent in an amount ranging from about 0.1 to about 20 parts by weight per 100 parts by weight of water. Suitable examples of the surface active agent include conventionally known anionic, cationic or nonionic surface active agents, such as the compounds as described, for example, in Hiroshi Horiguchi, *Shin Kaimen Kasseizai*, Sankyo Shuppan (1975) and Ryohei Oda and Kazuhiro Teramura, *Kaimen Kasseizai no Gosei to Sono Oyo*, Maki Shoten (1980). Moreover, conventionally known antiseptic compounds and antimoldy compounds are employed in appropriate amounts in order to improve the antiseptic property and antimoldy property of the processing solution during preservation.

With respect to the conditions of the treatment, a temperature of from about 15° to about 60° C., and an immersion time of from about 10 seconds to about 5 minutes are preferred.

The treatment with the processing solution may be combined with a physical operation, for example, application of ultrasonic wave or mechanical movement (such as rubbing with a brush).

Actinic ray which can be used for decomposition to render the transfer layer hydrophilic upon the irradiation treatment includes any of visible light, ultraviolet light, far ultraviolet light, electron beam, X-ray, γ-ray, and α-ray, with ultraviolet light being preferred. More preferably rays having a wavelength range of from 310 to 500 nm are used. As a light source, a high-pressure or ultrahigh-pressure mercury lamp is ordinarily utilized. Usually, the irradiation treatment can be sufficiently carried out from a distance of from 5 to 50 cm for a period of from 10 seconds to 10 minutes. The thus irradiated transfer layer is then soaked in an aqueous solution whereby the transfer layer is easily removed.

Now, the method for preparation of a printing plate using an electrophotographic process according to the present invention will be described in more detail with reference to the accompanying drawings hereinbelow.

Figure 2:
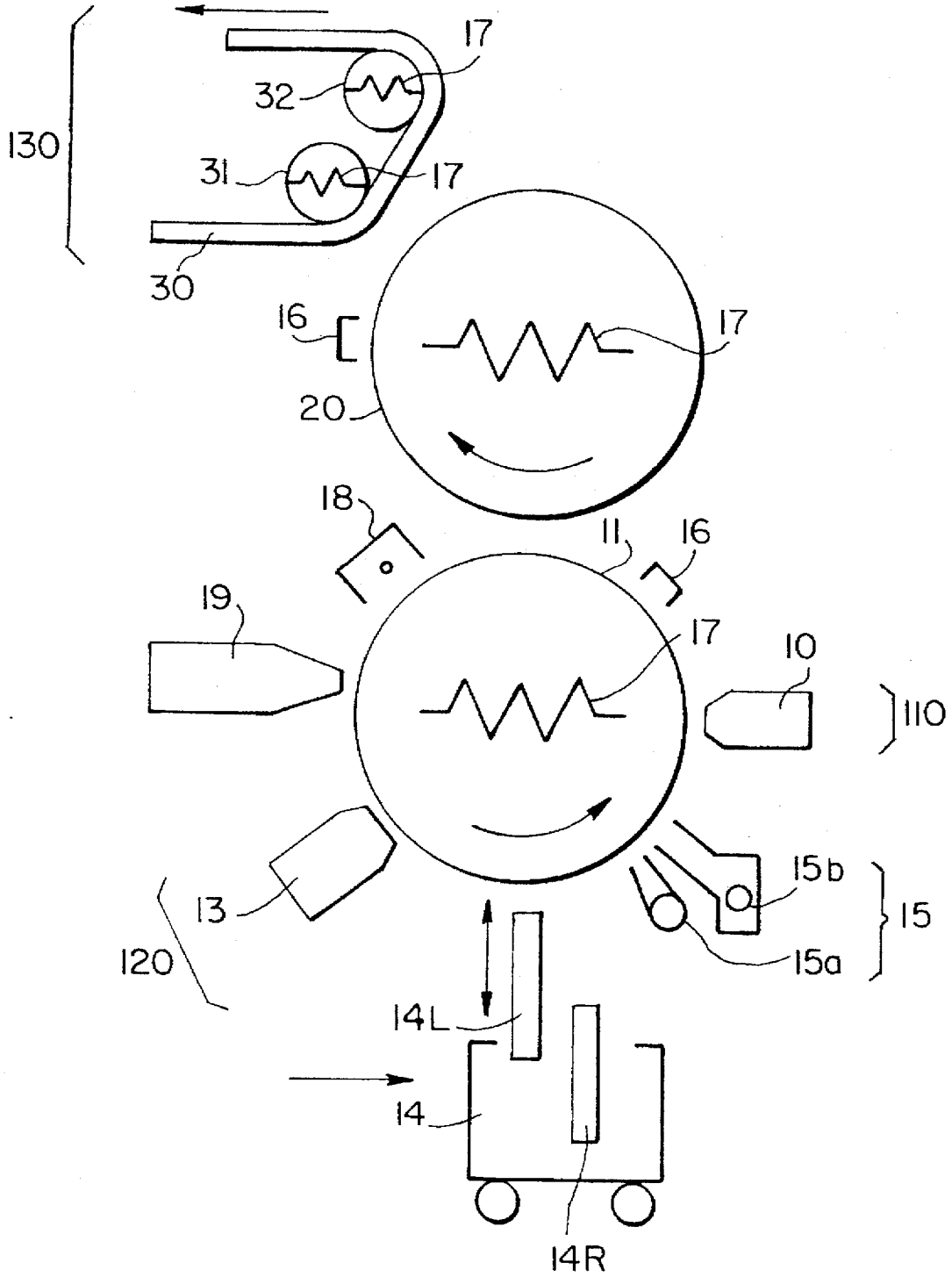
FIG. 2 is a schematic view of an apparatus for preparation of a printing plate precursor by an electrophotographic process suitable for performing the method according to the present invention in which a primary receptor of a drum type is used.

FIG. 2 is a schematic view of an apparatus for preparation of a printing plate precursor by an electrophotographic process suitable for conducting the method according to the present invention wherein a primary receptor of a drum type is employed.

As described above, when an electrophotographic light-sensitive element 11 whose surface has been modified to have releasability, a transfer layer 12 is formed on light-sensitive element 11. On the other hand, when releasability of the surface of light-sensitive element 11 is insufficient, the compound (S) is applied to the surface of light-sensitive element before the formation of transfer layer thereby imparting the desired releasability to the surface of light-sensitive element 11. Specifically, the compound (S) is supplied from a device for applying compound (S) 10 which utilizes any one of the embodiments as described above onto the surface of light-sensitive element 11. The device for applying compound (S) 10 may be stationary or movable.

On the light-sensitive element 11 is now provided a transfer layer by a device for providing transfer layer 13. In this embodiment, the transfer layer is formed by the electrodeposition coating method. An electrodeposition unit containing a dispersion of resin grains is first brought near the surface of light-sensitive element and is kept stationary with a gap of 1 mm between the surface thereof and a development electrode of the electrodeposition unit. The light-sensitive element is rotated while supplying the dispersion of resin grains into the gap and applying an electric voltage across the gap from an external power source (not shown), whereby the grains are deposited over the entire areas of the surface of light-sensitive element.

The dispersion of resin grains adhering to the surface of the light-sensitive element is removed by a squeezing device built in the electrodeposition unit. Then the resin grains are fused by a heating means and thus a transfer layer in the form of resin film is obtained.

In order to conduct the exhaustion of solvent in the dispersion, the suction/exhaust unit 15 provided for an electrophotographic process of the electrophotographic light-sensitive element may be employed. As the pre-bathing solution and the rinse solution, a carrier liquid for a liquid developer is ordinarily used. While the electrodeposition unit is provided independently as the device for providing transfer layer as shown in FIG. 2, it may be built in a liquid developing unit set 14 as 14T shown in FIG. 3.

After the transfer layer is formed on the light-sensitive element, the light-sensitive element is subjected to the electrophotographic process. While a dry developer can be utilized in the development step according to the present invention as described above, a wet type developing method is employed in the following embodiment since duplicated image having high definition can be obtained.

The light-sensitive element 11 having the transfer layer 12 provided thereon is uniformly charged to, for instance, a positive polarity by a corona charger 18 and then is exposed imagewise by an exposure device (e.g., a semi-conductor laser) 19 on the basis of image information, whereby the potential is lowered in the exposed regions and thus, a contrast in potential is formed between the exposed regions and the unexposed regions. A liquid developing unit 14L containing a liquid developer comprising resin grains having a positive electrostatic charge dispersed in an electrically insulating liquid is brought near the surface of a light-sensitive material comprising the light-sensitive element 11 and the transfer layer 12 provided thereon from a liquid developing unit set 14 and is kept stationary with a gap of 1 mm therebetween.

The light-sensitive material is first pre-bathed by a pre-bathing means provided in the liquid developing unit, and then the liquid developer is supplied on the surface of the light-sensitive material while applying a developing bias voltage between the light-sensitive material and a development electrode by a bias voltage source and wiring (not shown). The bias voltage is applied so that it is slightly lower than the surface potential of the unexposed regions, while the development electrode is charged to positive and the light-sensitive material is charged to negative. When the bias voltage applied is too low, a sufficient density of the toner image cannot be obtained.

The liquid developer adhering to the surface of light-sensitive material is subsequently washed off by a rinsing means 14R provided in the liquid developing unit set 14 and the rinse solution adhering to the surface of light-sensitive material is removed by a squeeze means. Then, the light-sensitive material is dried by passing under a suction/exhaust unit 15. Meanwhile a primary receptor 20 is kept away from the surface of light-sensitive material.

The toner image formed on the transfer layer 12 is then transferred from the light-sensitive element 11 onto the primary receptor 20. Specifically, the transfer layer is pre-heated in the desired range of temperature by a heating means 16, and the primary receptor 20 is also pre-heated in the desired range of temperature by a heating means 16 if desired, then the transfer layer is brought into close contact with the primary receptor, whereby the toner image is heat-transferred together with the transfer layer onto the primary receptor 20.

The toner image transferred together with the transfer layer 12 on the primary receptor 20 is then heat-transferred onto a receiving material 30 together with the transfer layer 20. Specifically, the primary receptor 20 is pre-heated in the desired range of temperature by the heating means 16, a receiving material 30 is also pre-heated in the desired range of temperature by a back-up roller for transfer 31, the primary receptor 20 bearing the transfer layer and toner image is brought into close contact with the receiving material 30 and then the receiving material 30 is cooled by a back-up roller for release 32, thereby heat-transferring the toner image together with the transfer layer to the receiving material. Thus a cycle of steps is terminated.

In the event of imparting the desired releasability onto the surface of light-sensitive element, by stopping the apparatus in the stage where the compound (S) has been applied thereon by the device for applying compound (S) 10, the next operation can start with the formation of transfer layer.

Figure 3:
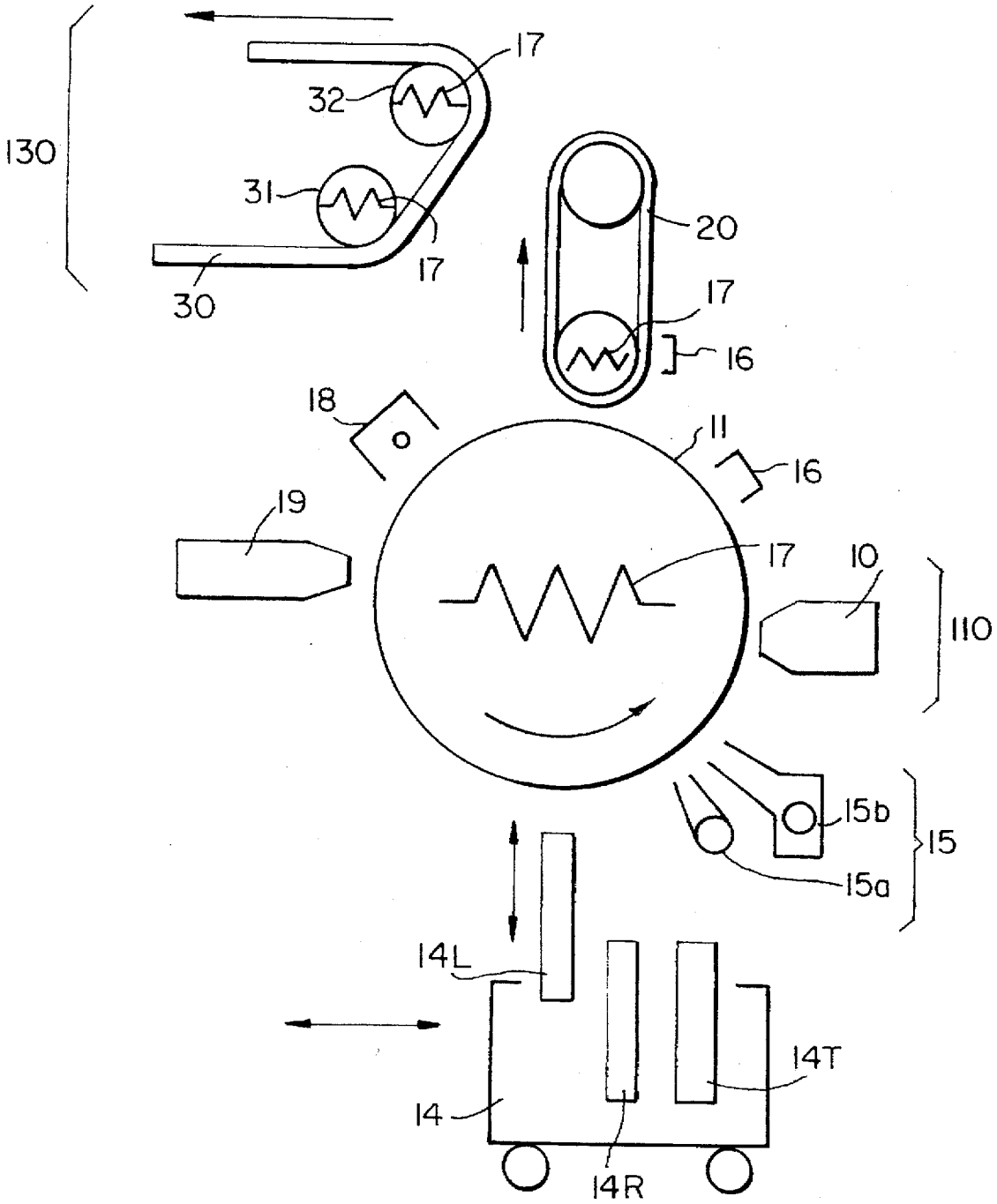
FIG. 3 is a schematic view of an apparatus for preparation of a printing plate precursor by an electrophotographic process suitable for performing the method according to the present invention in which a primary receptor of an endless belt type is used and an electrodeposition coating method is adopted for the formation of transfer layer.

FIG. 3 is a schematic view of another example of apparatus for preparation of a printing plate precursor according to the present invention wherein a primary receptor 20 of an endless belt type is employed. In the apparatus of FIG. 3, its construction is essentially similar to that of the apparatus shown in FIG. 2.

Further, in order to provide the transfer layer on the light-sensitive element, a device utilizing the hot-melt coating method or a device utilizing the transfer method from a release support can be used in place of the device utilizing the electrodeposition coating method described above as the device for providing transfer layer 13.

In case of using the hot-melt coating method, the resin (A) is coated on the surface of light-sensitive element provided on the peripheral surface of a drum by a hot-melt coater and is caused to pass under a suction/exhaust unit to be cooled to a predetermined temperature to form the transfer layer. Thereafter, the hot-melt coater is moved to a stand-by position.

A device for forming a transfer layer on the light-sensitive element using release paper is schematically shown in FIG. 4. In FIG. 4, release paper 24 having thereon the transfer layer 12 is heat-pressed on the light-sensitive element 11 by a heating roller **25*b*, thereby transferring the transfer layer 12 on the surface of light-sensitive element 11. The release paper 24 is cooled by a cooling roller 25*c* and recovered. The light-sensitive element is heated by a heating means 25*a* to improve transferability of the transfer layer 12** upon heat-press, if desired.

A providing part of transfer layer 120 in FIG. 4 is first employed to transfer a transfer layer 12 from release paper 24 to a light-sensitive element 11 and then used for transfer of the transfer layer to a receiving material as a transferring part to receiving material 130 shown in FIG. 2 or 3. Alternatively, both the providing part of transfer layer 120 for transfer the transfer layer 12 from release paper 24 to the light-sensitive element 11 and the transferring part to receiving material 130 for transfer the toner image together with the transfer layer to the receiving material are installed in the apparatus according to the present invention.

When the transfer layer of integrated layered type is employed in the present invention, it can be formed using two or more transfer layer-forming devices which may be the same or different from each other.

In accordance with the method of the present invention, a toner image is completely transferred together with a transfer layer onto a receiving material even when a thickness of the transfer layer is reduced and the transfer is conducted under a decreased temperature, a decreased pressure or an increased speed, and an oil-desensitizing treatment is performed under a mild condition, whereby a printing plate which provides prints having good qualities can be obtained.

Moreover, a conventional electrophotographic light-sensitive element can be employed in the method of the present invention by imparting the desired releasability on the surface thereof using the compound (S).

The present invention is illustrated in greater detail with reference to the following examples, but the present invention is not to be construed as being limited thereto.

Synthesis Examples of Resin Grain (AR):

SYNTHESIS EXAMPLE 1 OF RESIN GRAIN (AR):(AR-1)

A mixed solution of 16 g of Dispersion Stabilizing Resin (Q-1) having the structure shown below and 550 g of Isopar H was heated to a temperature of 50° C. under nitrogen gas stream while stirring.

Dispersion Stabilizing Resin (Q-1)

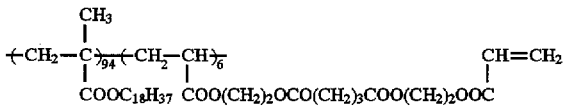

Mw $5\times10^4$

To the solution was dropwise added a mixed solution of 85.0 g of benzyl methacrylate, 15.0 g of acrylic acid, 2.0 g of methyl 3-mercaptopropionate and 1.2 g of 2,2'-azobis(2-cyclopropylpropionitrile) (abbreviated as ACPP) over a period of one hour, followed by stirring for one hour. To the reaction mixture was added 0.8 g of ACPP, followed by reacting for 2 hours. Further, 0.5 g of 2,2'-azobis (isobutyronitrile) (abbreviated as AIBN) was added thereto, the reaction temperature was adjusted to 80° C., and the reaction was continued for 3 hours. After cooling, the reaction mixture was passed through a nylon cloth of 200 mesh to obtain a white dispersion which was a latex of good monodispersity with a polymerization ratio of 97% and an average grain diameter of 0.17 μm. The grain diameter was measured by CAPA-500 manufactured by Horiba Ltd. (hereinafter the same).

A part of the white dispersion was centrifuged at a rotation of $1\times10^4$ r.p.m. for one hour and the resin grains precipitated were collected and dried. A weight average molecular weight (Mw) of the resin grain measured by a GPC method and calculated in terms of polystyrene (hereinafter the same) was $9.8\times10^3$. A glass transition point (Tg) thereof was 60° C.

SYNTHESIS EXAMPLE 2 OF RESIN GRAIN AR: (AR-2)

A mixed solution of 14 g of Dispersion Stabilizing Resin (Q-2) having the structure shown below, 10 g of Macromonomer (M-1) having the structure shown below, and 553 g of Isopar H was heated to a temperature of 55° C. under nitrogen gas stream while stirring.

Dispersion Stabilizing Resin (Q-2)

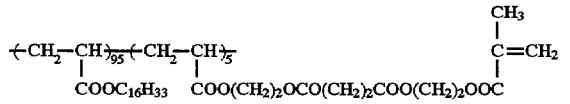

Mw $4\times10^4$

-continued

Macromonomer (M-1)

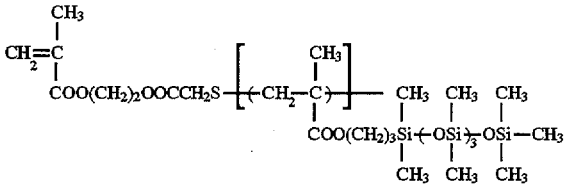

Mw $8\times10^3$

To the solution was added dropwise a mixed solution of 51.2 g of methyl methacrylate, 30 g of methyl acrylate, 12.5 g of acrylic acid and 1.3 g of methyl 3-mercaptopropionate, 1.2 g of ACPP over a period of one hour, followed by reacting for one hour. Then, 0.8 g of 2,2'-azobis (isovaleronitrile) (abbreviated as AIVN) was added thereto and the temperature was immediately adjusted to 75° C., and the reaction was continued for 2 hours. To the reaction mixture was further added 0.5 g of AIVN, followed by reacting for 2 hours. After cooling, the reaction mixture was passed through a nylon cloth of 200 mesh to obtain a white dispersion which was a latex of good monodispersity with a polymerization ratio of 98% and an average grain diameter of 0.18 μm. An Mw of the resin grain was $2\times10^4$ and a Tg thereof was 50° C.

SYNTHESIS EXAMPLES 3 TO 11 OF RESIN GRAIN (AR): (AR-3) TO (AR-11)

A mixed solution of 20 g of Dispersion Stabilizing Resin (Q-3) having the structure shown below and 480 g of Isopar G was heated to a temperature of 50° C. under nitrogen gas stream while stirring.

Dispersion Stabilizing Resin (Q-3)

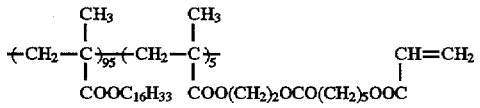

Mw $4.5\times10^4$

To the solution was added dropwise a mixed solution of each of the monomers shown in Table A below, 2.6 g of methyl 3-mercaptopropionate, 1.5 g of AIVN and 60 g of tetrahydrofuran over a period of one hour, followed by reacting for one hour. Then, 1.0 g of AIVN was added thereto and the temperature was adjusted to 70° C., and the reaction was continued for 2 hours. To the reaction mixture was further added 0.8 g of AIVN, followed by reacting for 3 hours. To the reaction mixture was added 60 g of isopar H, the tetrahydrofuran was distilled off under a reduced pressure of an aspirator at a temperature of 50° C. After cooling, the reaction mixture was passed through a nylon cloth of 200 mesh to obtain a white dispersion which was a latex of good monodispersity. An average grain diameter of each of the resin grains was in a range of from 0.15 to 0.30 μm. An Mw thereof was in a range of from $9\times10^3$ to $1.5\times10^4$ and a Tg thereof was in a range of from 35° C. to 80° C.

TABLE A

| Synthesis Example of Resin Grain (AR) | Resin Grain (AR) | Monomer Corresponding to Polymer Component (a) | | Monomer Corresponding to Polymer Component (b) | | Other Monomer | |
|---|---|---|---|---|---|---|---|
| 3 | AR-3 | 2-Carboxymethyl acrylate | 18 g | — | | Methyl methacrylate<br>Methyl acrylate | 60 g<br>22 g |
| 4 | AR-4 | Methacrylic acid | 5 g | 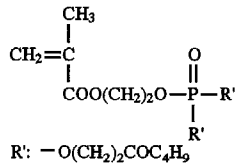 | 25 g (b-1) | Phenethyl methacrylate | 70 g |
| 5 | AR-5 | — | | 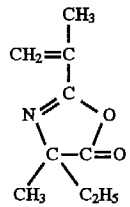 | 40 g (b-2) | Benzyl methacrylate | 60 g |
| 6 | AR-6 | — | | 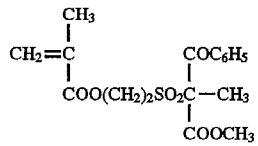 | 70 g (b-3) | Ethyl methacrylate | 30 g |
| 7 | AR-7 | 4-Vinylbenzene-sulfonic acid | 7 g | 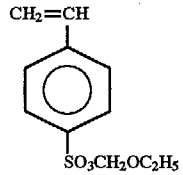 | 40 g (b-4) | Styrene<br>Vinyltoluene | 23 g<br>30 g |
| 8 | AR-8 | Itaconic anhydride | 5 g | 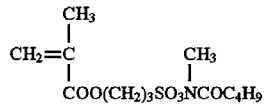 | 25 g (b-5) | Methyl methacrylate<br>Ethyl methacrylate | 50 g<br>20 g |

TABLE A-continued
| Synthesis Example of Resin Grain (AR) | Resin Grain (AR) | Monomer Corresponding to Polymer Component (a) | | Monomer Corresponding to Polymer Component (b) | | Other Monomer | |
|---|---|---|---|---|---|---|---|
| 9 | AR-9 | Acrylic acid | 8 g | 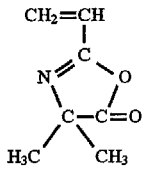 | 20 g (b-6) | 2-Methylphenyl methacrylate | 72 g |
| 10 | AR-10 | 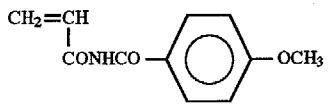 | 5 g | 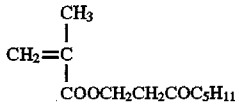 | 30 g (b-7) | Methyl methacrylate<br> 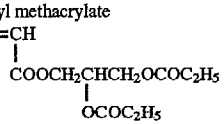 | 30 g<br>35 g |
| 11 | AR-11 | Acrylic acid | 13 g | — | | Methyl methacrylate<br>2-(Butoxy carbonyl)ethyl methacrylate | 52 g<br>35 g |

SYNTHESIS EXAMPLES 12 TO 17 OF RESIN GRAIN (AR): (AR-12) TO (AR-17)

Each of the resin grains was synthesized in the same manner as in Synthesis Example 2 of Resin Grain (AR) except for using 10 g of each of the macromonomers (Mw thereof being in a range of from $8\times10^3$ to $1\times10^4$) shown in Table B below in place of 10 g of Macromonomer (M-1). A polymerization ratio of each of the resin grains was in a range of from 98 to 99% and an average grain diameter thereof was in a range of from 0.15 to 0.25 μm with good monodispersity. An Mw of each of the resin grains was in a range of from $9\times10^3$ to $2\times10^4$ and a Tg thereof was in a range of from 40° C. to 70° C.

TABLE B

| Synthesis Example of Resin Grain (AR) | Resin Grain (AR) | Macromonomer |
|---|---|---|
| 12 | AR-12 | (M-2) 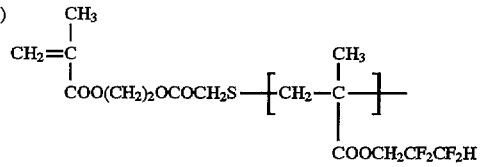 |
| 13 | AR-13 | (M-3) 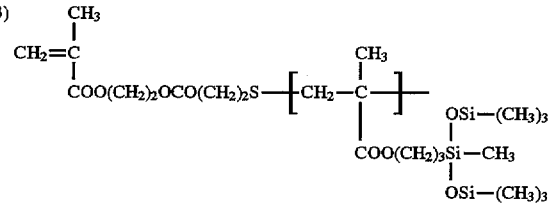 |
| 14 | AR-14 | (M-4) 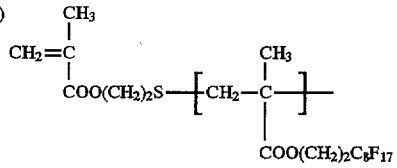 |
| 15 | AR-15 | (M-5) 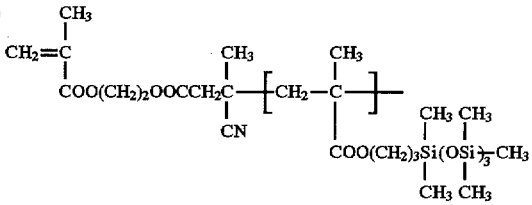 |
| 16 | AR-16 | (M-6) 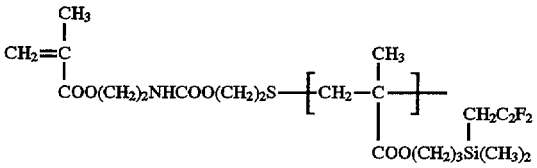 |
| 17 | AR-17 | (M-7) 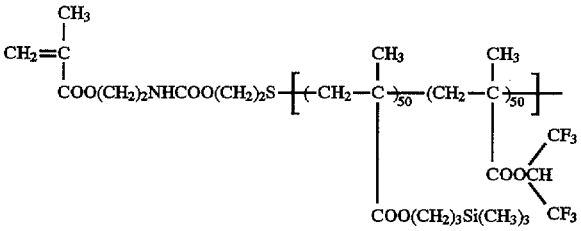 |

SYNTHESIS EXAMPLE 18 OF RESIN GRAIN (AR): (AR-18)

A mixed solution of 18 g of Dispersion Stabilizing Resin (Q-4) having the structure shown below and 560 g of Isopar H was heated to a temperature of 55° C. under nitrogen gas stream while stirring.

Dispersion Stabilizing Resin (Q-4)

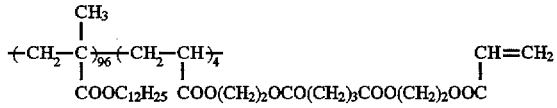

Mw $3\times10^4$

To the solution was dropwise added a mixed solution of 40 g of methyl methacrylate, 45 g of 2-propoxyethyl methacrylate, 15 g of acrylic acid, 1.3 g of methyl 3-mercaptopropionate and 0.8 g of AIVN over a period of one hour, followed by stirring for one hour. Then, 0.8 g of AIVN was added to the reaction mixture, the reaction was carried out for 2 hours and 0.5 g of AIBN was further added thereto and the reaction temperature was adjusted to 80° C., followed by reacting for 3 hours. After cooling, the reaction mixture was passed through a nylon cloth of 200 mesh to obtain a white dispersion which was a latex of good monodispersity having a polymerization ratio of 97% and an average grain diameter of 0.17 μm. An Mw of the resin grain was $6\times10^3$ and a Tg thereof was 25° C.

SYNTHESIS EXAMPLE 19 OF RESIN GRAIN (AR): (AR-19)

A mixed solution of 15 g of Dispersion Stabilizing Resin (Q-1) described above, 62 g of vinyl acetate, 30 g of vinyl valerate, 8 g of crotonic acid and 275 g of Isopar H was heated to a temperature of 80° C. under nitrogen gas stream with stirring. To the solution was added 1.6 g of AIVN, followed by reacting for 1.5 hours, 0.8 g of AIVN was added thereto, followed by reacting for 2 hours, and 0.5 g of AIBN was further added thereto, followed by reacting for 4 hours. Then, the temperature of the reaction mixture was raised to 100° C. and stirred for 2 hours to distil off the unreacted monomers. After cooling, the reaction mixture was passed through a nylon cloth of 200 mesh to obtain a white dispersion which was a monodispersed latex with a polymerization ratio of 93% and an average grain diameter of 0.25 μm. An Mw of the resin grain was $8\times10^4$ and a Tg thereof was 26° C.

SYNTHESIS EXAMPLE 20 OF RESIN GRAIN (AR): (AR-20)

A mixed solution of 20 g of Dispersion Stabilizing Resin (Q-5) having the structure shown below, 44.1 g of benzyl methacrylate, 40 g of 2-butoxyethyl methacrylate, 12 g of acrylic acid, 3.9 g of 3-mercaptopriopionic acid and 546 g of Isopar H was heated to a temperature of 60° C. under nitrogen gas stream while stirring.

Dispersion Stabilizing Resin (Q-5)

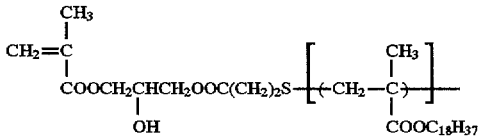

Mw $1.4\times10^4$

To the solution was added 1.0 g of AIVN, followed by reacting for 2 hours, 0.8 g of AIVN was added thereto, followed by reacting for 2 hours, and 0.5 g of AIBN was further added thereto, the temperature was adjusted to 80° C., followed by reacting for 3 hours. After cooling, the reaction mixture was passed through a nylon cloth of 200 mesh to obtain a white dispersion which was a monodispersed latex with a polymerization ratio of 99% and an average grain diameter of 0.22 μm. An Mw of the resin grain was $9\times10^3$ and a Tg thereof was 23° C.

SYNTHESIS EXAMPLE 21 OF RESIN GRAIN (AR): (AR-21)

A mixed solution of 18 g of Dispersion Stabilizing Resin (Q-6) having the structure shown below and 500 g of Isopar H was heated to a temperature of 50° C. under nitrogen gas stream with stirring.

Dispersion Stabilizing Resin (Q-6)

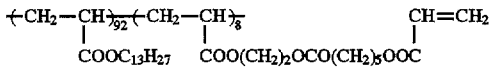

Mw $4.5\times10^4$

To the solution was added dropwise a mixed solution of 35 g of methyl methacrylate, 40 g of 2,3-dipropoxycarbonylpropyl methacrylate, 25 g of 2-sulfoethyl methacrylate, 5.2 g of methyl 3-mercaptopropionate, 1.5 g of AIVN and 120 g of tetrahydrofuran over a period of one hour, followed by further reacting for one hour. Then 1.0 g of AIVN was added to the reaction mixture, the temperature thereof was adjusted to 70° C., and the reaction was conducted for 2 hours. Further, 1.0 g of AIVN was added thereto, followed by reacting for 3 hours. To the reaction mixture was added 120 g of Isopar H, the tetrahydrofuran was distilled off under a reduced pressure of an aspirator at a temperature of 50° C. After cooling, the reaction mixture was passed through a nylon cloth of 200 mesh to obtain a white dispersion which was a latex of good monodispersity having a polymerization ratio of 98% and an average grain diameter of 0.18 μm. An Mw of the resin grain was $6\times10^3$ and a Tg thereof was 28° C.

SYNTHESIS EXAMPLE 22 OF RESIN GRAIN (AR): (AR-22)

A mixed solution of 20 g of Dispersion Stabilizing Resin (Q-7) having the structure shown below, 15 g of a dimethylsiloxane monofunctional macromonomer (FM-0721 manufactured by Chisso Corp.; Mw: $6\times10^3$), 50 g of methyl methacrylate, 35 g of 2-pentyloxyethyl methacrylate, 15 g of acrylic acid, 6 g of methyl 3-mercaptopropionate, and 547 g of Isopar G was heated to a temperature of 60° C. under nitrogen gas stream while stirring.

Dispersion Stabilizing Resin (Q-7)

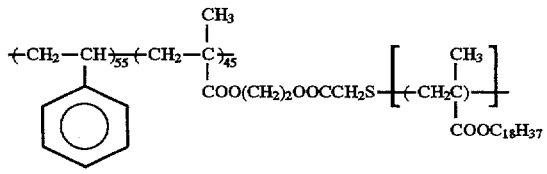

Mw $5\times10^4$ (Mw of graft portion: $1.0\times10^4$)

To the solution was added 2.0 g of AIVN, followed by reacting for 2 hours, 1.0 g of AIVN was added to the reaction mixture, and the reaction was carried out for 2 hours. Then, 1.0 g of AIVN was further added thereto, the temperature was immediately adjusted to 75° C., followed by reacting for 2 hours, and 0.8 g of AIVN was further added thereto, followed by reacting for 2 hours. After cooling, the reaction mixture was passed through a nylon cloth of 200 mesh to obtain a white dispersion which was a latex of good monodispersity having a polymerization ratio of 98% and an average grain diameter of 0.20 μm. An Mw of the resin grain was $6.5\times10^3$ and a Tg thereof was 20° C.

SYNTHESIS EXAMPLES 23 TO 32 OF RESIN GRAIN(AR): (AR-23) TO (AR-32)

A mixed solution of 25 g of Dispersion Stabilizing Resin (Q-8) having the structure shown below and 392 g of Isopar H was heated to a temperature of 50° C. under nitrogen gas stream while stirring.

Dispersion Stabilizing Resin (Q-8)

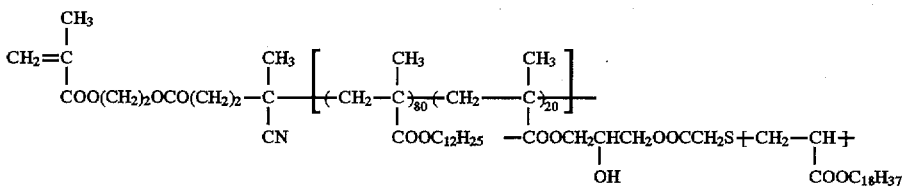

Mw $4\times10^4$ (Mw of graft portion: $8\times10^3$)

To the solution was dropwise added a mixed solution of each of the monomers shown in Table C below, 3.1 g of methyl 3-mercaptopropionate, 3 g of ACPP and 150 g of methyl ethyl ketone over a period of one hour, followed by reacting for one hour. To the reaction mixture was further added 1.0 g of ACPP, followed by reacting for 2 hours. Then, 1.0 g of AIVN was added thereto and the temperature was immediately adjusted to 75° C., and the reaction was continued for 2 hours. To the reaction mixture was further added 0.8 g of AIVN, followed by reacting for 2 hours. After cooling, the reaction mixture was passed through a nylon cloth of 200 mesh to obtain a white dispersion. A polymerization ratio of each of the white dispersions obtained was in a range of from 93 to 99% and an average grain diameter thereof was in a range of from 0.15 to 0.25 μm with narrow size distribution. An Mw of each of the resin grains was in a range of from $8\times10^3$ to $1\times10^4$ and a Tg thereof was in a range of from 10° C. to 35° C.

TABLE C

| Synthesis Example of Resin Grain (AR) | Resin Grain (AR) | Monomer Corresponding to Polymer Component (a) | | Monomer Corresponding to Polymer Component (b) | | Other Monomer | |
|---|---|---|---|---|---|---|---|
| 23 | AR-23 | Acrylic acid | 12.5 g | — | | Benzyl methacrylate<br>2-Methoxyethyl methacrylate | 55 g<br>32.5 g |
| 24 | AR-24 | 2-Phosphonoethyl methacrylate | 18 g | 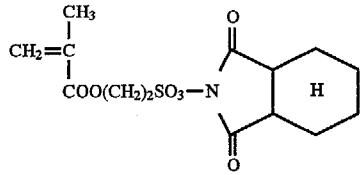 | 12.5 g (b-8) | Methyl methacrylate<br>Ethyl methacrylate | 35.5 g<br>34 g |
| 25 | AR-25 | 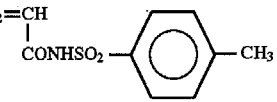 | 8 g | 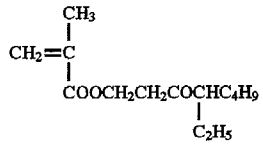 | 30 g (b-9) | Methyl methacrylate<br>Methyl acrylate | 35 g<br>27 g |
| 26 | AR-26 | Acrylic acid | 15 g | — | | Benzyl methacrylate<br> 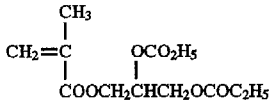 | 55 g<br>30 g |
| 27 | AR-27 | Acrylic acid<br>3-Sulfopropyl methacrylate | 8 g<br>8 g | — | | Methyl methacrylate<br>Diethylene glycol monomethyl ether monomethacrylate | 44 g<br>40 g |
| 28 | AR-28 | Acrolein | 10 g | 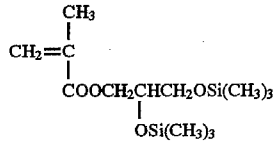 | 15 g (b-10) | Methyl methacrylate<br>Propyl acrylate | 35 g<br>40 g |

TABLE C-continued

| Synthesis Example of Resin Grain (AR) | Resin Grain (AR) | Monomer Corresponding to Polymer Component (a) | | Monomer Corresponding to Polymer Component (b) | | Other Monomer | |
|---|---|---|---|---|---|---|---|
| 29 | AR-29 | — | | 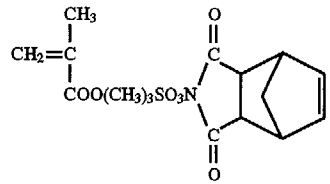 | 28 g (b-11) | 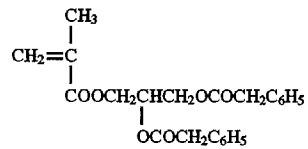 | 72 g |
| 30 | AR-30 | — | | 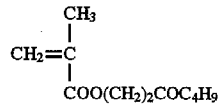 | 30 g (b-12) | Phenyl methacrylate<br>Methyl acrylate | 40 g<br>30 g |
| 31 | AR-31 | 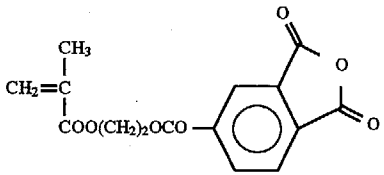 | 15 g | 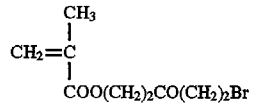 | 20 g (b-13) | Methyl methacrylate<br>2,3-Dibutoxy-carbonylpropyl methacrylate | 35 g<br>30 g |
| 32 | AR-32 | 4-Vinylbenzene-carboxylic acid | 15 g | — | | Vinyl acetate<br>4-Vinyltoluene | 65 g<br>20 g |

SYNTHESIS EXAMPLE 1 OF RESIN GRAIN (ARW): (ARW-1)

A mixed solution of the whole amount of dispersion of Resin Grain (AR-18) obtained by Synthesis Example 18 of Resin Grain (AR) (as seed) and 10 g of Dispersion Stabilizing Resin (Q-1) described above was heated to a temperature of 60° C. under nitrogen gas stream with stirring. To the mixture was added dropwise a mixture of 85 g of benzyl methacrylate, 15 g of acrylic acid, 2.0 g of methyl 3-mercaptopropionate, 0.8 g of AIVN and 200 g of Isopar H over a period of 2 hours, followed by further reacting for 2 hours. Then 0.8 g of AIVN was added to the reaction mixture, the temperature thereof was raised to 70° C., and the reaction was conducted for 2 hours. Further, 0.6 g of AIVN was added thereto, followed by reacting for 3 hours. After cooling, the reaction mixture was passed through a nylon cloth of 200 mesh to obtain a white dispersion which was a latex of good monodispersity having a polymerization ratio of 98% and an average grain diameter of 0.24 μm.

In order to investigate that the resin grain thus-obtained was composed of the two kinds of resins, the state of resin grain was observed using a scanning electron microscope.

Specifically, the dispersion of Resin Grain (ARW-1) was applied to a polyethylene terephthalate film so that the resin grains were present in a dispersive state on the film, followed by heating at a temperature of 50° C. or 80° C. for 5 minutes to prepare a sample. Each sample was observed using a scanning electron microscope (JSL-T330 Type manufactured by JEOL Co., Ltd.) of 20,000 magnifications. As a result, the resin grains were observed with the sample heated at 50° C. On the contrary, with the sample heated at 80° C. the resin grains had been melted by heating and were not observed.

The state of resin grain was observed in the same manner as described above with respect to resin grains formed from respective two kinds of resins (copolymers) constituting Resin Grain (ARW-1), i.e., Resin Grain (AR-18) and Resin Grain (AR-1) described above and a mixture of Resin Grains (AR-18) and (AR-1) in a weight ratio of 1:1. As a result, it was found that with Resin Grain (AR-18), the resin grains were not observed in the sample heated at 50° C., although the resin grains were observed in the sample before heating. On the other hand, with Resin Grain (AR-1), the resin grains were not observed in the sample heated at 80° C. Further, with the mixture of two kind of resin grains, disappearance of the resin grains was observed in the sample heated at 50° C. in comparison with the sample before heating.

From these results it was confirmed that Resin Grain (ARW-1)described above was not a mixture of two kinds of resin grains but contained two kinds of resins therein, and had a core/shell structure wherein the resin having a relatively high Tg formed shell portion and the resin having a relatively low Tg formed core portion.

SYNTHESIS EXAMPLES 2 TO 14 OF RESIN GRAIN (ARW): (ARW-2) TO (ARW-14)

Each of the resin grains (ARW-2) to (ARW-14) was synthesized in the same manner as in Synthesis Examples 1 of Resin Grain (ARW) except for using each of the monomers shown in Table D below in place of the monomers employed in Synthesis Example 1 of Resin Grain (ARW). A polymerization ratio of each of the resin grains was in a range of from 95 to 99% and an average grain diameter thereof was in a range of from 0.20 to 0.30 μm with good monodispersity.

TABLE D

| Synthesis Example of Resin Grain (ARW) | Resin Grain (ARW) | Monomers for Seed Grain | Weight Ratio | Monomers for Shell Portion | Weight Ratio |
|---|---|---|---|---|---|
| 2 | ARW-2 | Methyl methacrylate | 54 | Methyl methacrylate | 47 |
| | | Ethyl acrylate | 30 | 2-Propoxyethyl methacrylate | 40 |
| | | 2-Sulfoethyl methacrylate | 16 | Acrylic acid | 13 |
| 3 | ARW-3 | Methyl methacrylate | 37 | Vinyl acetate | 80 |
| | | Methyl acrylate | 45 | Acrolein | 20 |
| | | 2-Carboxyethyl acrylate | 18 | | |
| 4 | ARW-4 | Benzyl methacrylate | 86 | Methyl methacrylate | 52 |
| | | Acrylic acid | 14 | 2-(2-butoxyethoxy)ethyl methacrylate | 30 |
| | | | | 3-Sulfopropyl acrylate | 18 |
| 5 | ARW-5 | Vinyl acetate | 65 | Methyl methacrylate | 40 |
| | | Vinyl butyrate | 25 | Methyl acrylate | 30 |
| | | 2-Vinyl acetic acid | 10 | Monomer (b-1) | 30 |
| 6 | ARW-6 | Methyl methacrylate | 52 | 3-Phenylpropyl methacrylate | 84 |
| | | 2,3-Diacetyloxypropyl methacrylate | 35 | Acrylic acid | 16 |
| | | Acrylic acid | 13 | | |
| 7 | ARW-7 | Methyl methacrylate | 50 | 2-Phenoxyethyl methacrylate | 80 |
| | | 2-Butoxycarbonylethyl methacrylate | 30 | 2-Carboxyethyl methacrylate | 20 |
| | | 2-Phosphonoethyl methacrylate | 20 | | |
| 8 | ARW-8 | Ethyl methacrylate | 80 | Methyl methacrylate | 64 |
| | | | | 2-Methoxyethyl acrylate | 25 |
| | | | 20 | Acrylic acid | 11 |

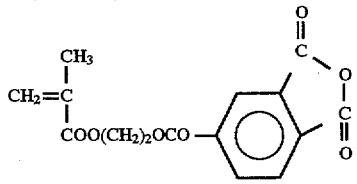

TABLE D-continued

| Synthesis Example of Resin Grain (ARW) | Resin Grain (ARW) | Monomers for Seed Grain | Weight Ratio | Monomers for Shell Portion | Weight Ratio |
|---|---|---|---|---|---|
| 9 | ARW-9 | Vinyl acetate | 90 | Benzyl methacrylate | 70 |
| | | Itaconic anhydride | 10 | Monomer (b-9) | 25 |
| | | | | Acrylic acid | 5 |
| 10 | ARW-10 | Methyl methacrylate | 45 | Benzyl methacrylate | 50 |
| | | Ethyl methacrylate | 40 | Monomer (b-8) | 50 |
| | | Acrylic acid | 15 | | |
| 11 | ARW-11 | Methyl methacrylate | 50 | Methyl methacrylate | 47 |
| | | Methyl acrylate | 20 | 2-Methoxycarbonylethyl methacrylate | 40 |
| | | Monomer (b-1) | 30 | | |
| | | | | Acrylic acid | 13 |
| 12 | ARW-12 | Methyl methacrylate | 52 | Methyl methacrylate | 40 |
| | | Monomer (b-11) | 40 | Monomer (b-12) | 60 |
| | | 2-Hydroxyethyl methacrylate | 8 | | |
| 13 | ARW-13 | Vinyl acetate | 85 | Ethyl methacrylate | 77 |
| | | $CH_2{=}CH$ \| $OCO(CH_2)_2COO(CH_2)_2COC_5H_{11}$ | 15 | Acrylate acid | 15 |
| | | | (b-14) | Macromonomer (M-3) | 8 |
| 14 | ARW-14 | Phenethyl methacrylate | 55 | Benzyl methacrylate | 75 |
| | | Methyl methacrylate | 25 | Macromonomer (M-7) | 5 |
| | | 3-Sulfopropyl methacrylate | 20 | Monomer (b-10) | 20 |

Synthesis Examples of Resin (P):

SYNTHESIS EXAMPLE 1 OF RESIN (P): (P-1)

A mixed solution of 80 g of methyl methacrylate, 20 g of a dimethylsiloxane macromonomer (FM-0725 manufactured by Chisso Corp.; Mw: $1\times10^4$), and 200 g of toluene was heated to a temperature of 75° C. under nitrogen gas stream. To the solution was added 1.0 g of AIBN, followed by reacting for 4 hours. To the mixture was further added 0.7 g of AIBN, and the reaction was continued for 4 hours. An Mw of the resulting copolymer was $5.8\times10^4$.

Resin (P-1)

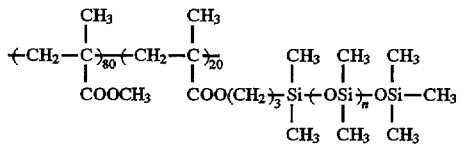

SYNTHESIS EXAMPLES 2 TO 9 OF RESIN (P): (P-2) (P-9)

Each of copolymers was synthesized in the same manner as in Synthesis Example 1 of Resin (P), except for replacing methyl methacrylate and the macromonomer (FM-0725) with each monomer corresponding to the polymer component shown in Table E below. An Mw of each of the resulting polymers was in a range of from $4.5\times10^4$ to $6\times10^4$.

TABLE E
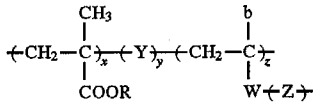
| Synthesis Example of Resin (P) | Resin (P) | −R | −Y− | −b | −W− | −Z− | x/y/z (weight ratio) |
|---|---|---|---|---|---|---|---|
| 2 | P-2 | $-C_2H_5$ | 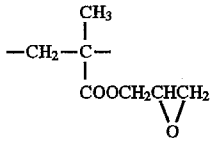 | $-CH_3$ | $-COO(CH_2)_2S-$ | 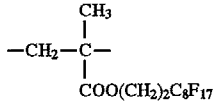 | 65/15/20 |
| 3 | P-3 | $-CH_3$ | 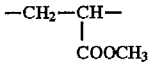 | $-H$ | 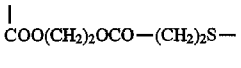 | 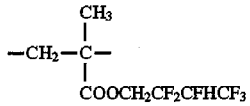 | 60/10/30 |
| 4 | P-4 | $-CH_3$ | 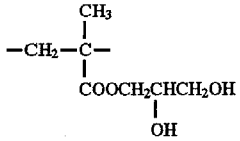 | $-CH_3$ | 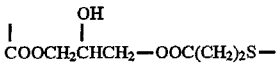 | 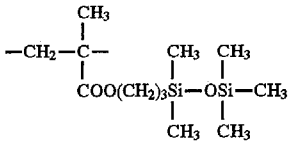 | 65/10/25 |
| 5 | P-5 | $-C_3H_7$ | 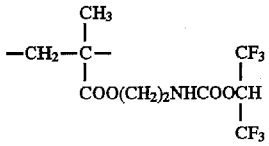 | $-CH_3$ | 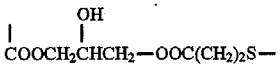 | 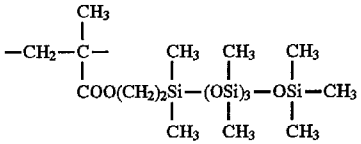 | 65/15/20 |
| 6 | P-6 | $-CH_3$ | 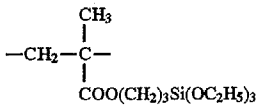 | $-CH_3$ | 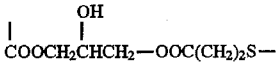 | 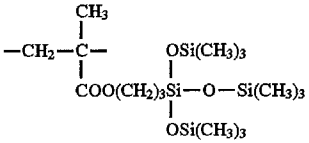 | 50/20/30 |

TABLE E-continued
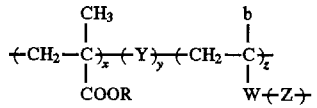
| Synthesis Example of Resin (P) | Resin (P) | −R | −Y− | −b | −W− | −Z− | x/y/z (weight ratio) |
|---|---|---|---|---|---|---|---|
| 7 | P-7 | $-C_2H_5$ | 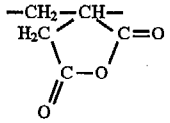 | −H | $-CONH(CH_2)_2S-$ | 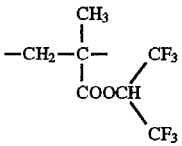 | 57/8/35 |
| 8 | P-8 | $-CH_3$ | $-CH_2-CH(CONH(CH_2)_6OH)-$ | −H | $COO(CH_2)_2OCO-CH_2S-$ | $-CH_2-CH(CONHC_{17}F_{35})-$ | 70/15/15 |
| 9 | P-9 | $-C_2H_5$ | 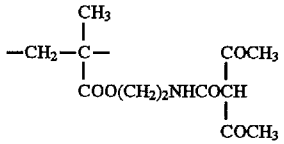 | $-CH_3$ | $COO(CH_2)_2OCO-CH_2S-$ | $-CH_2-C(CH_3)(COO(CH_2)_3SO_2NHC_{12}F_{25})-$ | 70/10/20 |

SYNTHESIS EXAMPLE 10 OF RESIN (P): (P-10)

A mixed solution of 60 g of 2,2,3,4,4,4-hexafluorobutyl methacrylate, 40 g of a methyl methacrylate macromonomer (AA-6 manufactured by Toagosei Chemical Industry Co., Ltd.; Mw: $1\times10^4$), and 200 g of benzotrifluoride was heated to a temperature of 75° C. under nitrogen gas stream. To the solution was added 1.0 g of AIBN, followed by reacting for 4 hours. To the mixture was further added 0.5 g of AIBN, and the reaction was continued for 4 hours. An Mw of the copolymer thus-obtained was $6.5\times10^4$.

Resin (P-10)

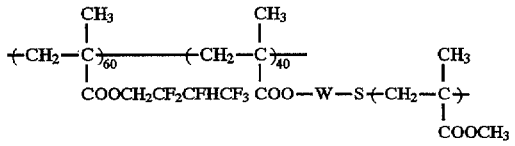

—W—: an organic residue (unknown)

SYNTHESIS EXAMPLES 11 TO 12 OF RESIN (P): (P-11) TO (P-12)

Each of copolymers was synthesized in the same manner as in Synthesis Example 10 of Resin (P), except for replacing the monomer and the macromonomer used in Synthesis Example 10 of Resin (P) with each monomer corresponding to the polymer component and each macromonomer corresponding to the polymer component both shown in Table F below. An Mw of each of the resulting copolymers was in a range of from $4.5\times10^4$ to $6.5\times10^4$.

TABLE F

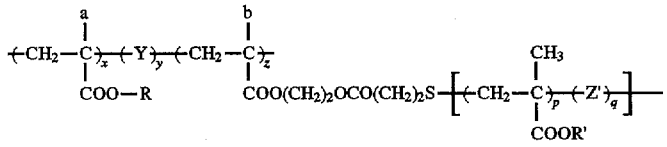

| Synthesis Example of Resin (P) | Resin (P) | —a | —R | —Y— | —b |
|---|---|---|---|---|---|
| 11 | P-11 | $-CH_3$ | $-(CH_2)_2C_nF_{2n+1}$ n = 8~10 | — | $-CH_3$ |
| 12 | P-12 | $-CH_3$ | $-(CH_2)_2CF_2CFHCF_3$ | $-CH_2-C(CH_3)(COO(CH_2)_3Si(CF_3)_3-C_2H_5)-$ | —H |

| Synthesis Example of Resin (P) | —R' | —Z'— | x/y/z (weight ratio) | p/q (weight ratio) |
|---|---|---|---|---|
| 11 | $-CH_3$ | $-CH_2-C(CH_3)(COOCH_2CHCH_2)-$ (O) | 70/0/30 | 70/30 |
| 12 | $-CH_3$ | $-CH_2-C(CH_3)(COO(CH_2)_3Si(OCH_3)_2)-CH_3$ | 30/30/40 | 70/30 |

SYNTHESIS EXAMPLE 13 OF RESIN (P): (P-13)

A mixed solution of 67 g of methyl methacrylate, 22 g of methyl acrylate, 1 g of methacrylic acid, and 200 g of toluene was heated to a temperature of 80° C. under nitrogen gas stream. To the solution was added 10 g of polymer Azobis initiator (PI-1)having the structure shown below, followed by reacting for 8 hours. After completion of the reaction, the reaction mixture was poured into 1.5 l of methanol, and the precipitate thus-deposited was collected and dried to obtain 75 g of a copolymer having an Mw of $3\times10^4$.

Polymer Initiator (PI-1)

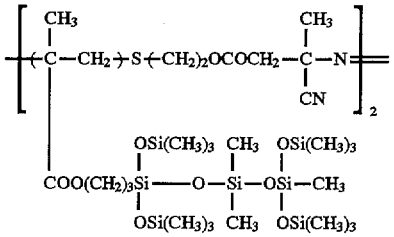

Polymer (P-13)

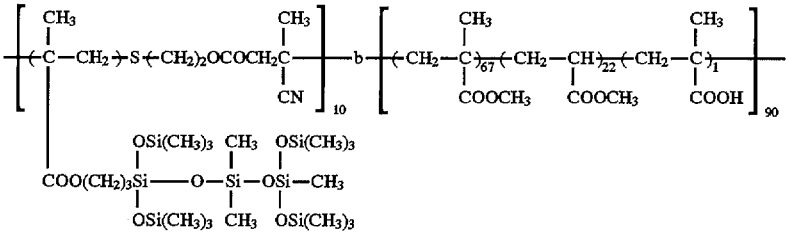

—b—: a bond between blocks (hereinafter the same)

SYNTHESIS EXAMPLE 14 OF RESIN (P): (P-14)

A mixture of 50 g of ethyl methacrylate, 10 g of glycidyl methacrylate, and 4.8 g of benzyl N,N-diethyldithiocarbamate was sealed into a container under nitrogen gas stream and heated to a temperature of 50° C. The mixture was irradiated with light from a high-pressure mercury lamp of 400 W at a distance of 10 cm through a glass filter for 6 hours to conduct photopolymerization. The reaction mixture was dissolved in 100 g of tetrahydrofuran, and 40 g of Monomer (m-1) shown below was added thereto. After displacing the atmosphere with nitrogen, the mixture was again irradiated with light for 10 hours. The reaction mixture obtained was reprecipitated in 1 l of methanol, and the precipitate was collected and dried to obtain 73 g of a polymer having an Mw of $4.8\times10^4$.

Monomer (m-1)

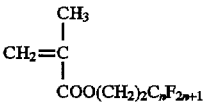

(n: an integer of from 8 to 10)

-continued

Resin (P-14)

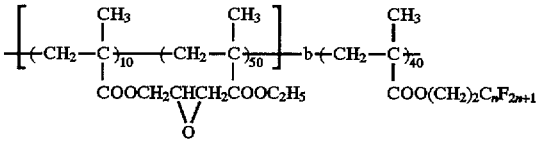

(n: an integer of from 8 to 10)

SYNTHESIS EXAMPLES 15 TO 18 OF RESIN (P): (P-15) TO (P-18)

Each of copolymers shown in Table G below was prepared in the same manner as in Synthesis Example 14 of Resin (P). An Mw of each of the resulting polymers was in a range of from $3.5\times10^4$ to $6\times10^4$.

TABLE G

| Synthesis Example of Resin (P) | Resin (P) | A–B Type Block Copolymer |
|---|---|---|
| 15 | P-15 | 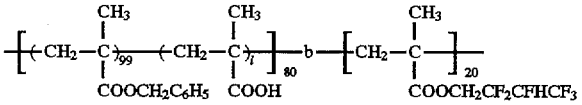 |

TABLE G-continued

| Synthesis Example of Resin (P) | Resin (P) | A–B Type Block Copolymer |
|---|---|---|
| 16 | P-16 | 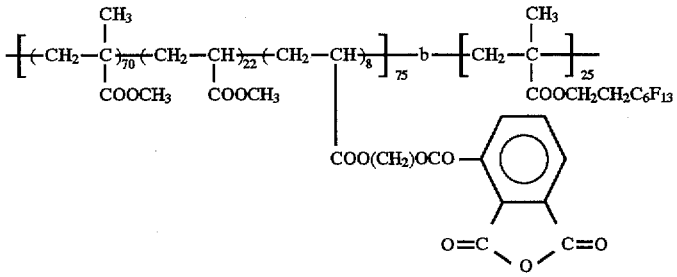 |
| 17 | P-17 | 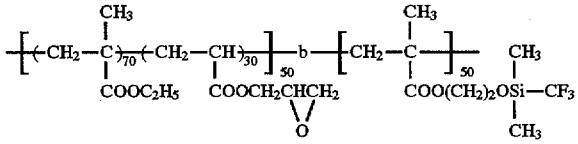 |
| 18 | P-18 | 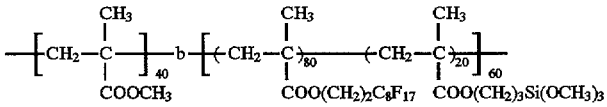 |

SYNTHESIS EXAMPLE 19 OF RESIN (P): (P-19)

A copolymer having an Mw of $4.5\times10^4$ was prepared in the same manner as in Synthesis Example 14 of Resin (P), except for replacing benzyl N,N-diethyldithiocarbamate with 18 g of Initiator (I-1)having the structure shown below.

Initiator (I-1)

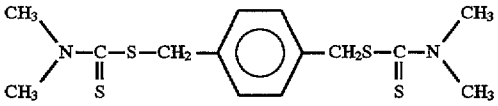

Resin (P-19)

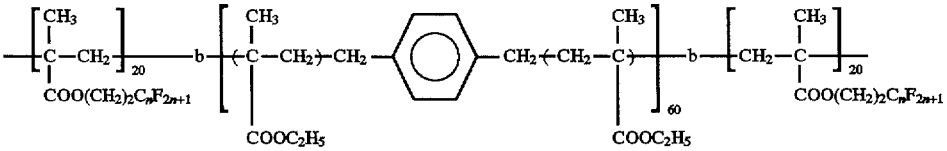

(n: an integer of from 8 to 10)

SYNTHESIS EXAMPLE 20 OF RESIN (P): (P-20)

A mixed solution of 68 g of methyl methacrylate, 22 g of methyl acrylate, 10 g of glycidyl methacrylate, 17.5 g of Initiator (I-2) having the structure shown below, and 150 g of tetrahydrofuran was heated to a temperature of 50° C. under nitrogen gas stream. The solution was irradiated with light from a high-pressure mercury lamp of 400 W at a distance of 10 cm through a glass filter for 10 hours to conduct photopolymerization. The reaction mixture obtained was reprecipitated in 1 l of methanol, and the precipitate was collected and dried to obtain 72 g of a polymer having an Mw of $4.0\times10^4$.

A mixed solution of 70 g of the resulting polymer, 30 g of Monomer (m-2) having the structure shown below and 100 g of tetrahydrofuran was heated to a temperature of 50° C. under nitrogen gas stream and irradiated with light under the same conditions as above for 13 hours. The reaction mixture was reprecipitated in 1.5 l of methanol, and the precipitate was collected and dried to obtain 78 g of a copolymer having an Mw of $6\times10^4$.

Initiator (I-2)

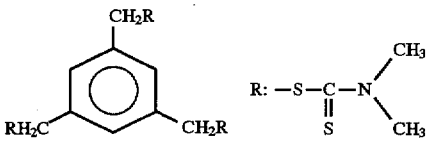

Monomer (m-2)

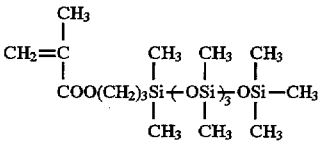

Resin (P-20)

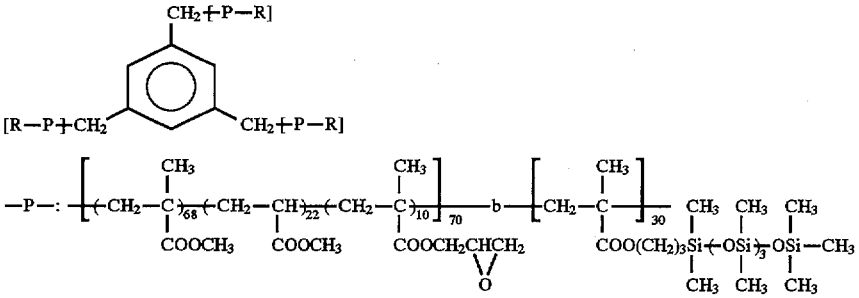

SYNTHESIS EXAMPLES 21 TO 25 OF RESIN (P): (P-21) TO (P-25)

In the same manner as in Synthesis Example 20 of Resin (P), except for replacing 17.5 g of Initiator (I-2) with 0.031 mol of each of Initiators (I) shown in Table H below, each of the copolymers shown in Table H was obtained. A yield thereof was in a range of from 70 to 80 g and an Mw thereof was in a range of from $4\times10^4$ to $6\times10^4$.

TABLE H
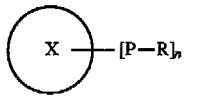
n: an integer
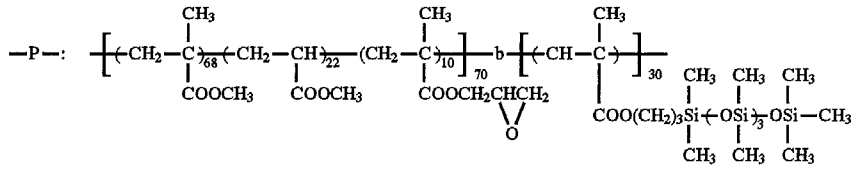
| Synthesis Example of Resin (P) | Resin (P) | Initiator (I) | —R | X |
|---|---|---|---|---|
| 21 | P-21 | 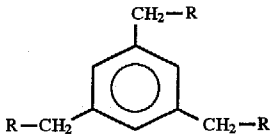 (I-3) | 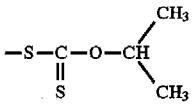 | 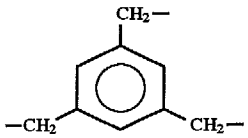 |
| 22 | P-22 | 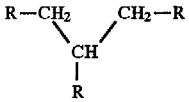 (I-4) | 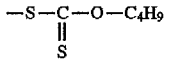 | 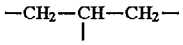 |
| 23 | P-23 | 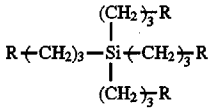 (I-5) | 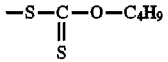 | 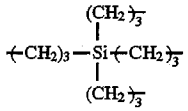 |

TABLE H-continued
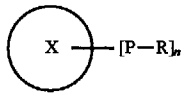
n: an integer
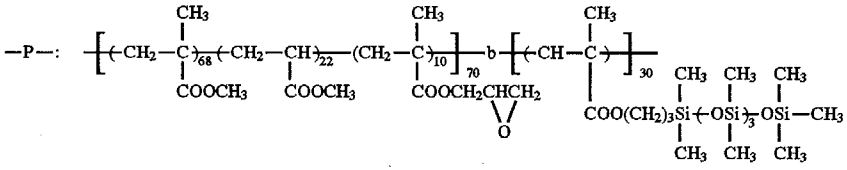
| Synthesis Example of Resin (P) | Resin (P) | Initiator (I) | —R | 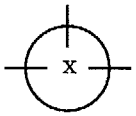 |
|---|---|---|---|---|
| 24 | P-24 | 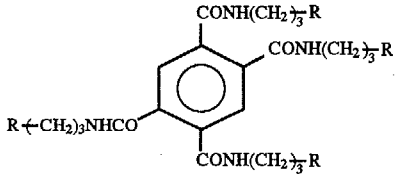 (I-6) | 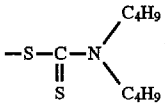 | 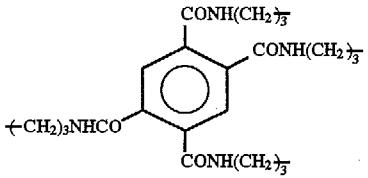 |
| 25 | P-25 | 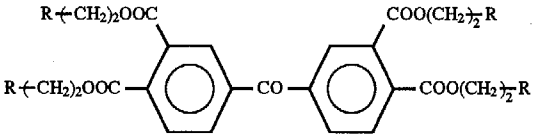 (I-7) | 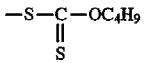 | 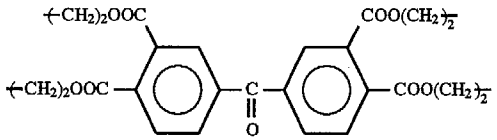 |

Synthesis Examples of Resin Grain (PL):

SYNTHESIS EXAMPLE 1 OF RESIN GRAIN (PL): (PL-1)

A mixed solution of 40 g of Monomer (LM-1) having the structure shown below, 2 g of ethylene glycol dimethacrylate, 4.0 g of Dispersion Stabilizing Resin (LP-1) having the structure shown below, and 180 g of methyl ethyl ketone was heated to a temperature of 60° C. with stirring under nitrogen gas stream. To the solution was added 0.3 g of AIVN, followed by reacting for 3 hours. To the reaction mixture was further added 0.1 g of AIVN, and the reaction was continued for 4 hours. After cooling, the reaction mixture was passed through a nylon cloth of 200 mesh to obtain a white dispersion. The average grain diameter of the latex was 0.25 μm.

Monomer (LM-1)

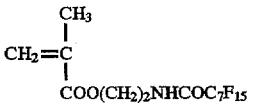

Dispersion Stabilizing Resin (LP-1)

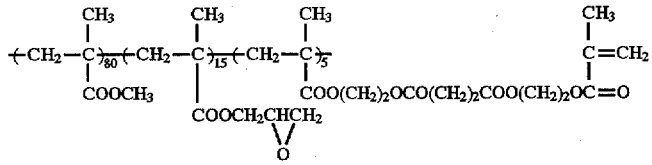

Mw $3\times10^4$

SYNTHESIS EXAMPLE 2 OF RESIN GRAIN (PL): (PL-2)

A mixed solution of 5 g of Dispersion Stabilizing Resin (LP-2) having the structure shown below and 140 g of methyl ethyl ketone was heated to a temperature of 60° C. under nitrogen gas stream while stirring. To the solution was added dropwise a mixed solution of 40 g of Monomer (LM-2) having the structure shown below, 1.5 g of ethylene glycol diacrylate, 0.2 g of AIVN, and 40 g of methyl ethyl ketone over a period of one hour. After the addition, the reaction was continued for 2 hours. To the reaction mixture was further added 0.1 g of AIVN, followed by reacting for 3 hours to obtain a white dispersion. After cooling, the dispersion was passed through a nylon cloth of 200 mesh. The average grain diameter of the dispersed resin grains was 0.35 μm.

Monomer (LM-2)

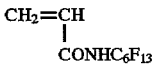

Dispersion Stabilizing Resin (LP-2)

-continued

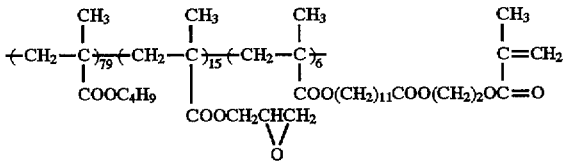

Mw $4\times10^4$

SYNTHESIS EXAMPLES 3 TO 6 OF RESIN GRAIN (PL): (PL-3) TO (PL-6)

Each of resin grains was synthesized in the same manner as in Synthesis Example 1 of Resin Grain (PL), except for replacing Monomer (LM-1), ethylene glycol dimethacrylate and methyl ethyl ketone with each of the compounds shown in Table I below, respectively. An average grain diameter of each of the resulting resin grains was in a range of from 0.15 to 0.30 μm.

TABLE I

| Synthesis Example of Resin Grain (PL) | Resin Grain (PL) | Monomer (LM) | Polyfunctional Monomer for Crosslinking | Amount | Reaction Solvent |
|---|---|---|---|---|---|
| 3 | PL-3 | $CH_2=C(CH_3)-COO(CH_2)_2SO_2NHC_{10}F_{21}$ (LM-3) | Ethylene glycol dimethacrylate | 2.5 g | Methyl ethyl ketone |
| 4 | PL-4 | 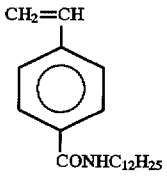 (LM-4) | Divinylbenzene | 3 g | Methyl ethyl ketone |
| 5 | PL-5 | $CH_2=CH-CONHC_{12}F_{25}$ (LM-5) | — | | Methyl ethyl ketone |
| 6 | PL-6 | $CH_2=CH-COO(CH_2)_2CONHC_8F_{17}$ (LM-6) | Trimethylolpropane trimethacrylate | 2.5 g | Methyl ethyl ketone |

EXAMPLE 1

A mixture of 2 g of X-form metal-free phthalocyanine (manufactured by Dainippon Ink and Chemicals, Inc.), 14.4 g of Binder Resin (B-1) having the structure shown below, 3.6 g of Binder Resin (B-2) having the structure shown below, 0.15 g of Compound (A) having the structure shown below, and 80 g of tetrahydrofuran was put into a 500 ml-volume glass container together with glass beads and dispersed in a paint shaker (manufactured by Toyo Seiki Seisakusho Co.) for 60 minutes. The glass beads were separated by filtration to prepare a dispersion for a light-sensitive layer.

Binder Resin (B-1)

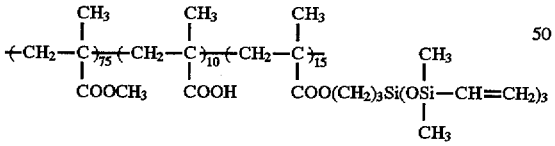

Mw $6\times10^4$ (weight ratio)

Binder Resin (B-2)

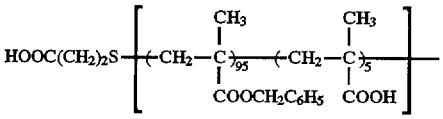

Mw $8\times10^3$

Compound (A)

-continued

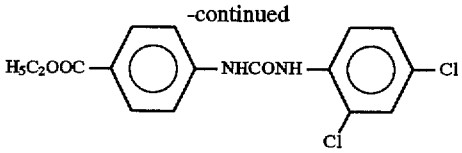

The resulting dispersion was coated on an aluminium plate having a thickness of 0.2 mm, which had been subjected to degrease treatment, by a wire bar, set to touch, and heated in a circulating oven at 110° C. for 20 seconds to form a light-sensitive layer having a thickness of 8 μm.

Then, a surface layer for imparting releasability having a thickness of 1.5 μm was provided on the light-sensitive layer.

Formation of Surface Layer for Imparting Releasability

A coating composition comprising 10 g of silicone resin having the structure shown below, 1 g of crosslinking agent having the structure shown below, 0.2 g of crosslinking controller having the structure shown below, 0.1 g of platinum as a catalyst for crosslinking and 100 g of n-hexane was coated by a wire round rod, set to touch, and heated at 120° C. for 10 minutes to form the surface layer having a thickness of 1.5 μm. The adhesive strength of the surface of the resulting light-sensitive element measured according to JIS Z 0237-1980 "Testing methods of pressure sensitive adhesive tapes and sheets" was not more than 1 g·f.

Silicone Resin

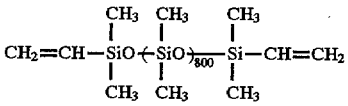

(presumptive structure)

-continued

Crosslinking Agent

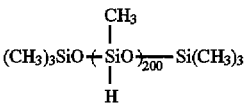

(presumptive structure)

Crosslinking Controller $CH \equiv C-Si(OCH_3)_3$

The light-sensitive element having the surface of releasability was installed in an apparatus as shown in FIG. 2 as a light-sensitive element 11. On the other hand, a drum wound with a blanket for offset printing (9600-A manufactured by Meiji Rubber & Co., Ltd.) having the adhesive strength of 80 g·f and a thickness of 1.6 mm was installed as primary receptor 20. A device for providing transfer layer 13 was omitted and instead, an electrodeposition unit 14T was installed in a liquid developing unit set 14 as shown in FIG. 3.

On the light-sensitive element was provided a transfer layer by the electrodeposition coating method using the electrodeposition unit 14T.

Specifically, on the surface of light-sensitive element which was rotated at a circumferential speed of 10 mm/sec, Dispersion of Resin (A) (L-1) shown below was supplied using a slit electrodeposition device, while putting the light-sensitive element to earth and applying an electric voltage of 280 V to an electrode of the slit electrodeposition device, whereby the resin grains were electrodeposited. The dispersion medium was removed by air-squeezing using a suction/exhaust unit, and the resin grains were fused by an infrared line heater as a heating means at temperature of 80° C. to form a film, whereby the transfer layer composed of a thermoplastic resin was prepared on the light-sensitive element. A thickness of the transfer layer was 4.0 μm.

| Dispersion of Resin (A) (L-1) | |
|---|---|
| Resin Grain (AR-1) | 5 g (solid basis) |
| Resin Grain (AR-21) | 5 g (solid basis) |
| Charge Control Agent (D-1) (octadecyl vinyl ether/N-tert-octyl maleic monoamide (1/1 by molar ratio) copolymer) | 0.03 g |
| Silicone oil (KF-96 manufactured by Shin-Etsu Silicone K.K.) | 5 g |
| Isopar H | up to make 1 liter |

A toner image was then formed on the transfer layer provided on the light-sensitive element by an electrophotographic process. Specifically, the light-sensitive element 11 was charged to +450 V with a corona charger 18 in dark and image-exposed to light using a semiconductor laser having an oscillation wavelength of 788 nm as an exposure device 19 at an irradiation dose on the surface of the light-sensitive element of 30 erg/cm$^2$ based on digital image data of an information which had been obtained by reading an original by a color scanner, conducting several corrections relating to color reproduction peculiar to color separation system and stored in a hard disc.

Thereafter, the exposed light-sensitive element was subjected to reversal development using Liquid Developer (LD-1) prepared in the manner as described below in a developing machine while applying a bias voltage of +400 V to a development electrode to thereby electrodeposit toner particles on the exposed areas. The light-sensitive element was then rinsed in a bath of Isopar H alone to remove stains on the non-image areas.

Preparation of Liquid Developer (LD-1)

1) Synthesis of Toner Particles:

A mixed solution of 65 g of methyl methacrylate, having the structure shown below, and 680 g of Isopar H was heated to 65° C. under nitrogen gas stream with stirring. To the solution was added 1.2 g of 2,2'-azobis(isovaleronitrile) (AIVN), followed by reacting for 2 hours. To the reaction mixture was further added 0.5 g of AIVN, and the reaction was continued for 2 hours. To the reaction mixture was further added 0.5 g of AIVN, and the reaction was continued for 2 hours. The temperature was raised up to 90° C., and the mixture was stirred under a reduced pressure of 30 mm Hg for 1 hour to remove any unreacted monomers. After cooling to room temperature, the reaction mixture was filtered through a nylon cloth of 200 mesh to obtain a white dispersion. The reaction rate of the monomers was 95%, and the resulting dispersion had an average grain diameter of resin grain of 0.25 μm (grain diameter being measured by CAPA-500 manufactured by Horiba, Ltd.) and good monodispersity.

Dispersion Polymer

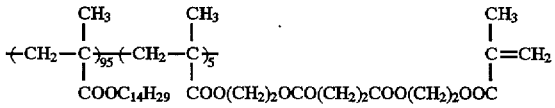

Mw $8 \times 10^4$

2) Preparation of Colored Particles:

Ten grams of a tetradecyl methacrylate/methacrylic acid copolymer (95/5 ratio by weight), 10 g of nigrosine, and 30 g of Isopar G were put in a paint shaker (manufactured by Toyo Seiki Seisakusho Co.) together with glass beads and dispersed for 4 hours to prepare a fine dispersion of nigrosine.

3) Preparation of Liquid Developer:

A mixture of 45 g of the above-prepared toner particle dispersion, 25 g of the above-prepared nigrosine dispersion, 0.2 g of a hexadecene/maleic acid monooctadecylamide (1/1 ratio by mole) copolymer, and 15 g of branched octadecyl alcohol (FOC-1800 manufactured by Nissan Chemical Industries, Ltd.) was diluted with 1 l of Isopar G to prepare Liquid Developer (LD-1) for electrophotography.

The light-sensitive element was then subjected to fixing by means of a heat roll whereby the toner image thus-formed was fixed.

The drum of light-sensitive element 11, the surface temperature of which had been adjusted at 65° C., and the drum of primary receptor 20 whose surface temperature had been adjusted at 90° C. were brought into contact with each other under the condition of a nip pressure of 4 kgf/cm$^2$ and a drum circumferential speed of 5 mm/sec, whereby the toner image was wholly transferred together with the transfer layer onto the primary receptor.

Then, an aluminium substrate used for the production of FUJI PS-Plate FPD (manufactured by Fuji Photo Film Co., Ltd.) was introduced as a receiving material 30 on a back-up roller for transfer 31 adjusted at 130° C. and a back-up roller for release 32 adjusted at 10° C. and the aluminum substrate was brought into contact with the primary receptor of drum type, the surface temperature of which had been adjusted at 90° C., under a nip pressure of 4 kgf/cm$^2$ and at a drum circumferential speed of 50 mm/sec. The toner images were wholly transferred onto the aluminum substrate and thus clear images of good image quality were obtained.

Then, the aluminum substrate having thereon the transfer layer and toner image, i.e., printing plate precursor, was subjected to an oil-desensitizing treatment (i.e., removal of the transfer layer) to prepare a printing plate and its printing performance was evaluated. Specifically, the printing plate precursor was immersed in Oil-Desensitizing Solution (E-1) having the composition shown below at 35° C. for one minute with mild rubbing with a fur brush to remove the transfer layer in the non-image area, thoroughly washed with water, and gummed to prepare an offset printing plate.

Oil-Desensitizing Solution (E-1):

A solution prepared by diluting PS plate processing solution (DP-4 manufactured by Fuji Photo Film Co., Ltd.) 50-fold with distilled water (pH: 12.5)

The printing plate thus obtained was observed visually using an optical microscope of 200 magnifications. It was found that the non-image areas had no residual transfer layer, and the image areas suffered no defects in high definition regions (i.e., cutting of fine lines and fine letters).

The printing plate was subjected to printing on neutral paper with various offset printing color inks using an offset printing machine (Oliver 94 Model manufactured by Sakurai Seisakusho K.K.), and an aqueous solution (pH: 7.0) prepared by diluting dampening water for PS plate (SG-23 manufactured by Tokyo Ink K.K.) 130-fold with distilled water, as dampening water. As a result, more than 60,000 prints with clear images free from background stains were obtained irrespective of the kind of color ink.

Moreover, when the printing plate according to the present invention was exchanged for an ordinary PS plate and printing was continued under ordinary conditions, no trouble arose. It was thus confirmed that the printing plate according to the present invention can share a printing machine with other offset printing plates such as PS plates.

As described above, the offset printing plate obtained according to the present invention exhibits excellent performance in that an image formed by a scanning exposure system using semiconductor laser beam has excellent image reproducibility and the image of the plate can be reproduced on prints with satisfactory quality, in that the plate exhibits sufficient color ink receptivity without substantial ink-dependency to enable to perform full color printing with high printing durability, and in that it can share a printing machine in printing with other offset printing plates without any trouble.

For comparison, the following procedures were conducted.

Comparative Example 1

The same procedure as in Example 1 was performed except that the transfer layer was not provided on the light-sensitive element to form a toner image on an aluminum substrate of FPD. The transfer of toner image was not completely conducted and the residue of toner was observed on the light-sensitive element and primary receptor. Thus, cuttings of toner image were recognized in the duplicated image formed on the aluminum substrate.

Comparative Example 2

The same procedure as in Example 1 was performed except that the transfer of toner image and transfer layer was conducted directly from the light-sensitive element onto an aluminum substrate of FPD without the intermediation of primary receptor. The transfer of toner image was not sufficient. Then, the transfer was conducted under different conditions of temperature of 110° C. (the surface temperature of the light-sensitive element), a pressure of 5 kgf/cm$^2$ and a speed of 5 mm/sec. As a result, a good duplicated image equivalent to Example 1 was obtained.

It can be seen from these results that the method of the present invention makes possible the moderation of transfer condition and increase in transfer speed.

EXAMPLE 2

An amorphous silicon electrophotographic light-sensitive element (manufactured by KYOSERA Corp.) was installed in an apparatus as shown in FIG. 3 as a light-sensitive element. The adhesive strength of the surface of light-sensitive element was 220 g·f.

Impartation of releasability to the light-sensitive element was conducted by dipping the light-sensitive element in a solution of the compound (S) according to the present invention (dip method) in the apparatus. Specifically, the light-sensitive element rotated at a circumferential speed of 10 mm/sec was brought into contact with a bath containing a solution prepared by dissolving 1.0 g of Compound (S-1) shown below in one liter of Isopar G (manufactured by Esso Standard Oil Co.) for 7 seconds and dried using air-squeezing. The adhesive strength of the surface of light-sensitive element thus-treated was 3 g·f and the light-sensitive element exhibited good releasability.

Compound (S-1)

Silicone surface active agent (SILWet FZ-2171 manufactured by Nippon Unicar Co., Ltd.)

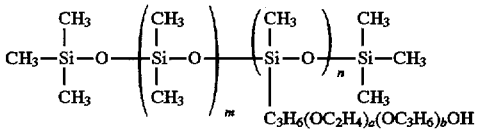

(presumptive structure)

On the surface of light-sensitive element whose surface temperature was adjusted at 50° C. and which was rotated at a circumferential speed of 10 mm/sec, Dispersion of Resin (A) (L-2) containing positively charged resin grains shown below was supplied using a slit electrodeposition device, while putting the light-sensitive element to earth and applying an electric voltage of 130 V to an electrode of the slit electrodeposition device to cause the grains to electrodeposite and fix. A thickness of the resulting transfer layer was 2.5 μm.

| Dispersion of Resin (A) (L-2) | |
|---|---|
| Resin Grain (ARW-1) | 10 g (solid basis) |
| Charge Control Agent (D-2) (1-hexadecane/N-decylmaleic monoamide (1/1 by mole) copolymer) | 0.002 g |
| Branched tetradecyl alcohol (FOC-1400 manufactured by Nissan Chemical Industries, Ltd.) | 5 g |
| Isopar G | up to make 1.0 liter |

The light-sensitive element while maintaining its surface temperature at 50° C. was charged to +700 V with a corona discharge in dark and exposed to light using a semiconductor laser having an oscillation wavelength of 780 nm on the basis of digital image data of an information which had been obtained by reading an original by a color scanner, conducting several corrections relating to color reproduction peculiar to color separation system and stored in a hard disc. The potential in the exposed area was +220 V while it was +600 V in the unexposed area.

The exposed light-sensitive material was pre-bathed with Isopar G (manufactured by Esso Standard Oil Co.) by a pre-bathing means installed in a developing unit and then subjected to reversal development using Liquid Developer (LD-2) having the composition shown below while applying a bias voltage of 500 V to a development electrode to thereby electrodeposit the toner particles on the non-exposed areas. The light-sensitive material was then rinsed in a bath of Isopar G alone to remove stains on the non-image areas and dried by a suction/exhaust unit.

Liquid Developer (LD-2)

A copolymer of octadecyl methacrylate and methyl methacrylate (9/1 ratio by mole) as a coating resin and carbon black (#40 manufactured by Mitsubishi Kasei Corp.) were thoroughly mixed in a weight ratio of 2:1 and kneaded by a three-roll mill heated at 140° C. A mixture of 12 g of the resulting kneading product, 4 g of a copolymer of styrene and butadiene (Sorprene 1205 manufactured by Asahi Kasei Kogyo K.K.) and 76 g of Isopar G was dispersed in a Dyno-mill. The toner concentrate obtained was diluted with Isopar G so that the concentration of solid material was 6 g per liter, and $1\times10^{-4}$ mol per liter of sodium dioctylsulfosuccinate was added thereto to prepare Liquid Developer (LD-2).

On the other hand, a primary receptor was prepared by applying a mixture of 100 g of isoprene rubber, 7 g of Resin (P-2) and 0.001 g of phthalic anhydride to the surface of blanket for offset printing (9600-A) described in Example 1 and heated at 140° C. for hours to form a cured layer having a thickness of 10 μm. The adhesive strength of the surface of the resulting primary receptor was 80 g·f.

After heating the primary receptor 20 at its surface temperature of 100° C., the light-sensitive element 11 bearing the transfer layer and toner image thereon was brought into contact with the primary receptor under the condition of a nip pressure of 4 kgf/cm$^2$ and a drum circumferential speed of 80 mm/sec, whereby the toner images were wholly transferred together with the transfer layer onto the primary receptor 20.

Then, an aluminum substrate for FPD was introduced as a receiving material 30 on back-up roller for transfer 31 adjusted at 130° C. and back-up roller for release 32 adjusted at 10° C. and the aluminum substrate was brought into contact with the primary receptor, the surface temperature of which had been adjusted at 60° C. by temperature controller 17, under a nip pressure of 5 kgf/cm$^2$ and at a drum circumferential speed of 50 mm/sec. The toner image was wholly transferred onto the aluminum substrate and thus clear images of good image quality were obtained.

For comparison, the same procedure as above was performed except that the transfer layer was not formed on the light-sensitive element to form a toner image on an aluminum substrate. In the resulting image on aluminum substrate, cuttings of toner image and unevenness in image density were observed. Further, as a result of visual evaluation of the image using a magnifying glass of 20 magnifications, cuttings of fine image, for example, fine lines and fine letters were recognized. Also, the residue of toner image was found on the surface of light-sensitive element.

These results indicate that cleaning of the surface of light-sensitive element is necessary for removing the residual toner when the light-sensitive element is repeatedly employed. Consequently, a device for the cleaning must be provided and a problem in that the surface of light-sensitive element is damaged due to the cleaning arises.

The printing plate precursor thus-obtained was further heated using a device (RICOH FUSER Model 592 manufactured by Ricoh Co., Ltd.) to fix sufficiently the toner image portion. The printing plate precursor was observed visually using an optical microscope of 200 magnifications. It was found that the non-image areas had no stain and the image areas suffered no defects in high definition regions (i.e., cutting of fine lines and fine letters). Specifically, the toner image was easily transferred together with the transfer layer onto a receiving material by the heat-transfer process as described above and the toner image was not adversely affected by the heat treatment after the transfer.

The printing plate precursor was immersed in Oil-Desensitizing Solution (E-2) having the composition shown below at 35° C. for 20 seconds with moderate rubbing of the surface of precursor to remove the transfer layer in the non-image area, thoroughly washed with water and gummed to obtain a lithographic printing plate.

| Oil-Desensitizing Solution (E-2) | |
|---|---|
| Sodium sulfite | 85 g |
| N,N-Dimethylethanolamine | 15 g |
| Sodium hydroxide | to adjust pH to 12.0 |
| Distilled water | up to make 1 liter |

The printing plate thus prepared was observed visually using an optical microscope of 200 magnifications with respect to the removal of transfer layer in the non-image areas and the occurrence of cutting of toner image. As a result, it can be seen that the aptitude of oil-desensitizing treatment was good and the transfer layer was completely removed without the formation of background stain. Further, resisting property of image areas was good and cutting of toner image was not observed even in highly accurate image portions, for example, fine letters, fine lines and dots for half tone areas of continuous gradation.

The printing plate was subjected to printing on neutral paper with various offset printing color inks using an offset printing machine (Oliver 94 Model manufactured by Sakurai Seisakusho K.K.), and an aqueous solution (pH: 7.0) prepared by diluting dampening water for PS plate (SG-23 manufactured by Tokyo Ink K.K.) 130-fold with distilled water, as dampening water. As a result, more than 60,000 prints with clear images free from background stains were obtained irrespective of the kind of color inks.

As described above, for the purpose of maintaining sufficient adhesion of toner image to a receiving material and increasing mechanical strength of toner image at the time of printing, a means for improving adhesion of toner image to a receiving material can be performed after the heat-transfer of toner image together with the transfer layer depending on the kind of liquid developer used for the formation of toner image.

Also, similar results to the above were obtained by a flash fixing method or a heat roll fixing method as the means for improving adhesion of toner image.

EXAMPLE 3

Impartation of releasability to the surface of light-sensitive element by the adherence or adsorption of compound (S) in the apparatus conducting an electrophotographic process on the surface of light-sensitive element was performed in the following manner in place of the dip method described in Example 2 above.

(1) For imparting releasability to the light-sensitive element, in an applying part of compound (S) 110 of the apparatus as in Example 2, a metering roll having a silicone rubber layer on the surface thereof was brought into contact with a bath containing an oil of Compound (S-2) having the structure shown below on one side and with the light-sensitive element on the other side and they were rotated at a circumferential speed of 15 mm/sec for 20 seconds. As a result, the adhesive strength of the surface of light-sensitive element was 5 g·f.

Compound (S-2)

Carboxy-modified silicone oil (TSF 4770 manufactured by Toshiba Silicone Co., Ltd.)

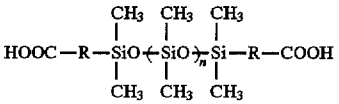

Further, a transfer roll having a styrene-butadiene rubber layer on the surface thereof was placed between the metering roll dipped in the silicone oil bath of Compound (S-2) and the light-sensitive element, and the treatment was conducted in the same manner as above. Good releasability of the surface of light-sensitive element similar to the above was obtained.

Figure 5:
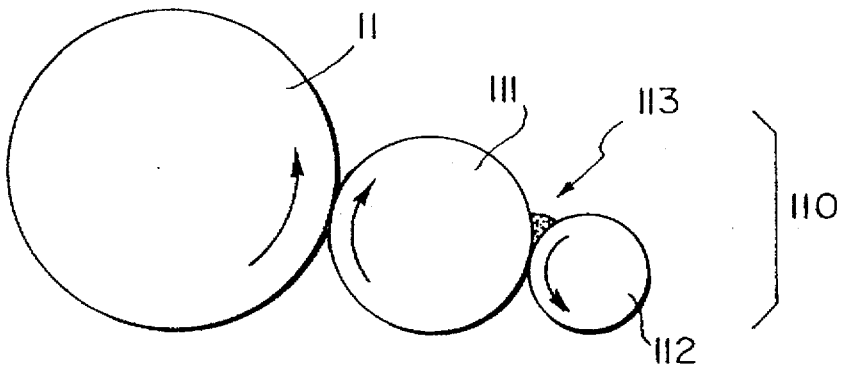
FIG. 5 is a schematic view of a device for applying a compound (S) on the surface of electrophotographic light-sensitive element.

Moreover, in the above-described method of using the metering roll and transfer roll as the applying part of compound (S) 110, Compound (S-2) 113 was supplied between the metering roll 112 and the transfer roll 111 as shown in FIG. 5 and the treatment was conducted in the same manner as above. Again, good result similar to the above was obtained.

(2) An AW-treated felt (material: wool having a thickness of 15 mm and a width of 20 mm) impregnated uniformly with 2 g of Compound (S-3), i.e., dimethyl silicone oil (KF-96L-2.0 manufactured by Shin-Etsu Silicone Co., Ltd.) was pressed under a pressure of 200 g·f/cm$^2$ on the surface of light-sensitive element and the light-sensitive element was rotated at a circumferential speed of 20 mm/sec for 30 seconds. The adhesive strength of the surface of light-sensitive element thus-treated was 5 g·f.

(3) A rubber roller having a heating means integrated therein and covered with cloth impregnated with Compound (S-4), i.e., fluorine-containing surface active agent (Sarflon S-114 manufactured by Asahi Glass Co., Ltd.) was heated to a surface temperature of 60° C., then brought into contact with the light-sensitive element and they were rotated at a circumferential speed of 20 mm/sec for 30 seconds. The adhesive strength of the surface of light-sensitive element thus-treated was 12 g·f.

(4) A silicone rubber roller comprising a metal axis covered with silicone rubber (manufactured by Kinyosha K.K.) was pressed on the light-sensitive element at a nip pressure of 500 g·f/cm$^2$ and rotated at a circumferential speed of 15 mm/sec for 10 seconds. The adhesive strength of the surface of light-sensitive element thus-treated was 10 g·f.

Using the light-sensitive elements treated by these methods for the impartation of releasability to the surface thereof, the formation of transfer layer, formation of toner image, transfer of toner image onto a receiving material through a primary receptor, preparation of printing plate and printing were conducted in the same manner in Example 2. Good results similar to those in Example 2 were obtained.

EXAMPLE 4

An amorphous silicon electrophotographic light-sensitive element same as used in Example 2 was installed in an apparatus as shown in FIG. 3. Impartation of releasability and formation of transfer layer on the light-sensitive element were simultaneously conducted by the electrodeposition coating method. Specifically, a first transfer layer having a thickness of 2.0 μm was formed on the light-sensitive element in the same manner as in Example 2 using Dispersion of Resin (A) (L-3) shown below.

| Dispersion of Resin (A) (L-3) | |
|---|---|
| Resin Grain (ARW-6) | 20 g (solid basis) |
| 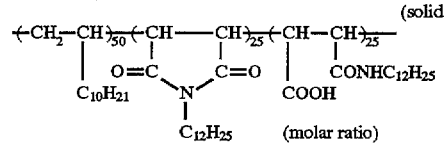 | |
| Compound (S-5) | 0.8 g |
| 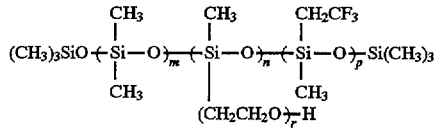 | |
| Isopar | up to make 1 liter |

On the first transfer layer was formed a second transfer layer having a thickness of 2.0 μm using Dispersion of Resin (A) (L-4) shown below by the electrodeposition coating method thereby providing a transfer of stratified structure.

| Dispersion of Resin (A) (L-4) | |
|---|---|
| Resin Grain (ARW-9) | 10 g (solid basis) |
| Charge Control Agent (D-3) | 0.022 g |
| Isopar G | up to make 1 liter |

The formation of toner image by an electrophotographic process and transfer onto a primary receptor were conducted in the same manner as in Example 2. Then, a printing plate precursor was prepared using a sheet of Straight Master (manufactured by Mitsubishi Paper Mills, Ltd.) as a final receiving material in the same manner as in Example 2.

The toner image transferred on the Straight Master was clear and had a good image quality without the formation of background stain. The residue of transfer layer and toner image was not observed at all on the light-sensitive element.

Moreover, the condition of each transfer step was changed to low temperature and increased speed as shown below and the procedure was repeated.

| Transfer to Primary Receptor | |
|---|---|
| Temperature of surface of light-sensitive element | 50° C. |
| Temperature of surface of primary receptor | 80° C. |
| Transfer speed | 150 mm/sec |
| Transfer to Receiving Material | |
| Temperature of surface of primary receptor | 80° C. |
| Transfer speed | 100 mm/sec |

The printing plate precursor obtained had a good image quality similar to that obtained above and degradation of image portion and fog in the non-image area were not observed. Further, the residue of toner image and transfer layer was not found on the light-sensitive element and primary receptor at all. These results indicates that the transferability of transfer layer is further improved by suitably selecting the composition of the transfer layer in the method of the present invention.

For comparison, the same procedure was repeated except for using a dispersion for electrodeposition prepared by eliminating Compound (S-5) from Dispersion of Resin (A) (L-3). The image obtained on a printing plate precursor was uneven due to inferior transfer, and the severe residue of transfer layer and toner image was observed on the light-sensitive element.

The printing plate precursor was immersed in Oil-Desensitizing Solution (E-3) having the composition shown below at 35° C. for 15 seconds with moderate rubbing of the surface of plate with a fur brush to remove the transfer layer in the non-image area, thoroughly washed with water, and gummed to obtain a lithographic printing plate.

| Oil-Desensitizing Solution (E-3) | |
|---|---|
| 2-Mercaptopropionic acid | 80 g |
| N,N-Dimethylethanolamine | 20 g |
| Glycerin | 10 g |
| Sodium hydroxide | to adjust pH to 12.4 |
| Distilled water | up to make 1 liter |

The printing plate thus prepared was observed visually using an optical microscope of 200 magnifications. It was found that the non-image area had no residual transfer layer, and the image area suffered no defects in high definition regions (i.e., cutting of fine lines and fine letters).

The printing plate was subjected to printing in the same manner as in Example 1. As a result, more than 1,000 prints with clear images free from background stains were obtained irrespective of the kind of color ink.

EXAMPLE 5

A mixture of 1 g of X-form metal-free phthalocyanine (manufactured by Dainippon Ink and Chemicals, Inc.), 8 g of Binder Resin (B-3) having the structure shown below, 0.15 g of Compound (B) having the structure shown below, and 80 g of tetrahydrofuran was put into a 500 ml-volume glass container together with glass beads and dispersed in a paint shaker (manufactured by Toyo Seiki Seisakusho Co.) for 60 minutes. To the dispersion were added 2 g of Resin (P-2), 0.03 g of phthalic anhydride and 0.002 g of o-chlorophenol, followed by further dispersing for 2 minutes. The glass beads were separated by filtration to prepare a dispersion for a light-sensitive layer.

Binder Resin (B-3)

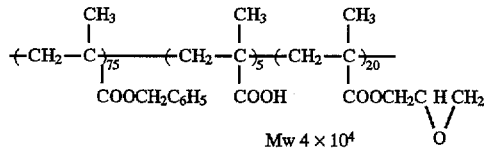

Compound (B)

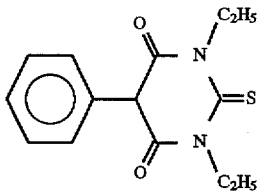

The resulting dispersion was coated on an aluminum plate having a thickness of 0.2 mm, which had been subjected to degrease treatment, by a wire bar, set to touch, and heated in a circulating oven at 110° C. for 20 seconds, and then further heated at 140° C. for one hour to form a light-sensitive layer having a thickness of 8 μm. The adhesion strength of the surface of the resulting electrophotographic light-sensitive element was 3 g·f.

For comparison, an electrophotographic light-sensitive element was prepared in the same manner as described above except for eliminating 2 g of Resin (P-2) and using 10 g of Binder Resin (B-3). The adhesive strength of the surface thereof was 420 g·f and did not exhibit releasability at all.

The light-sensitive element having the surface of releasability was installed in an apparatus as shown in FIG. 2 as a light-sensitive element 11 to form a transfer layer thereon. Specifically, on the surface of light-sensitive element, whose surface temperature was adjusted to 60° C. and which was rotated at a circumferential speed of 10 mm/sec, Dispersion of Resin (A) (L-5) containing positively charged resin grains shown below was supplied using a slit electrodeposition device, while putting the light-sensitive element to earth and applying an electric voltage of 250 V to an electrode of the slit electrodeposition device to cause the resin grains to electrodeposite and fix, whereby a transfer layer having a thickness of 4.5 μm was formed.

| Dispersion of Resin (A) (L-5) | |
|---|---|
| Resin Grain (AR-2) | 12 g (solid basis) |
| Resin Grain (AR-24) | 8 g (solid basis) |
| Charge Control Agent (D-4) (octadecyl vinyl ether/N-hexadecyl maleic monoamide (1/1 by molar ratio) copolymer) | 0.35 g |
| Charge Adjuvant (AD-1) (dodecyl methacrylate/methacrylic acid (94/6 by weight ratio) | 0.1 g |
| Isopar G | up to make 1 liter |

Using the resulting light-sensitive element having the transfer layer provided thereon, the formation of toner image, transfer onto a primary receptor, transfer onto a receiving material, preparation of a printing plate and printing were conducted in the same manner as in Example 1. As a result, more than 60,000 prints with clear images free from background stains similar to those in Example 1 were obtained.

EXAMPLE 6

The formation of transfer layer on light-sensitive element was performed by the transfer method from release paper using a device as shown in FIG. 4 instead of the electrodeposition coating method as described in Example 2. Specifically, on Separate Shi (manufactured by Oji Paper Co., Ltd.) as release paper 24, was coated a mixture of Resin (A-1) described below and Resin (A-2) described below in a weight ratio of 2:3 to prepare a transfer layer having a thickness of 3.5 μm. The resulting paper was brought into contact with the light-sensitive element same as described in Example 2 under the condition of a pressure between rollers of 3 kgf/cm$^2$, a surface temperature of 60° C. and a transportation speed of 80 mm/sec, whereby the transfer layer 12 having a thickness of 3.5 μm was formed on the light-sensitive element 11.

Resin (A-1)

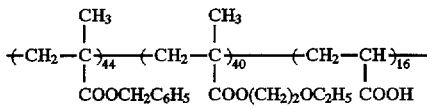

Mw $1\times10^4$, Tg 35° C.

Resin (A-2)

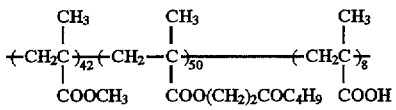

Mw $6\times10^4$, Tg 23° C.

Using the light-sensitive element having the transfer layer thus prepared, a printing plate was formed, followed by conducting printing in the same manner as in Example 2. The image quality of prints obtained and printing durability were good as those in Example 2.

EXAMPLES 7 TO 28

Each printing plate was prepared and offset printing was conducted using each of the resulting printing plates in the same manner as in Example 1 except for using a total of 10 g of the resin grains shown in Table J below in place of a total of 10 g of Resin Grains (AR-1) and (AR-21) in a weight ratio of 1:1 employed in the electrodeposition coating method for the formation of transfer layer of Example 1.

TABLE J

| Example | Resin Grain for Transfer Layer | Weight Ratio | Thickness of Transfer Layer (μm) |
|---|---|---|---|
| 7 | AR-4/AR-21 | 2/3 | 4.5 |
| 8 | AR-5/AR-22 | 1/1 | 4.0 |
| 9 | AR-6/AR-26 | 1/1 | 4.0 |
| 10 | AR-7/AR-27 | 1/1 | 4.0 |
| 11 | AR-8/AR-32 | 7/3 | 5.0 |
| 12 | AR-9/AR-31 | 1/1 | 4.0 |
| 13 | AR-10/AR-22 | 3/2 | 4.0 |
| 14 | AR-12/AR-30 | 1/4 | 4.0 |
| 15 | AR-13/AR-22 | 3/7 | 4.0 |
| 16 | ARW-1 | — | 3.0 |
| 17 | ARW-6 | — | 2.5 |
| 18 | AR-23/ARW-3 | 2/3 | 3.0 |
| 19 | AR-14/ARW-10 | 35/65 | 3.0 |
| 20 | AR-11/ARW-13 | 3/7 | 3.0 |

TABLE J-continued

| Example | Resin Grain for Transfer Layer | Weight Ratio | Thickness of Transfer Layer (μm) |
|---|---|---|---|
| 21 | ARW-14 | — | 3.0 |
| 22 | AR-29/ARW-5 | 1/1 | 2.5 |
| 23 | ARW-11 | — | 2.0 |
| 24 | ARW-12 | — | 2.0 |
| 25 | ARW-7 | — | 2.0 |
| 26 | AR-16/ARW-2 | 1/4 | 3.0 |
| 27 | ARW-8 | — | 3.0 |
| 28 | ARW-4 | — | 2.5 |

The image quality of prints obtained and printing durability of each printing plate were good as those in Example 1.

EXAMPLE 29

An amorphous silicon electrophotographic light-sensitive element (manufactured by Kyocera Corp.) was treated with Compound (S-6) shown below to modify its surface. The adhesive strength of the surface thereof was 2 g·f and the light-sensitive element exhibited good releasability.

Compound (S-6)

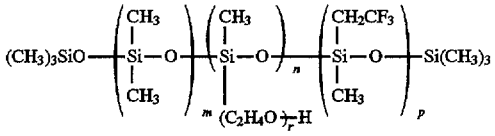

The light-sensitive element was installed in an apparatus and a transfer layer was formed thereon by the hot-melt coating method. Specifically, the light-sensitive element was passed under an infrared line heater to adjust surface temperature thereof measured by a radiation thermometer at about 60° C. A mixture of Resin (A-3) shown below and Resin (A-4) shown below in a weight ratio of 5/1 was coated as a resin (A) for transfer layer on the surface of light-sensitive element at a rate of 20 mm/sec by a hot-melt coater adjusted at 100° C. as a device for providing transfer layer and cooled by blowing cool air from a suction/exhaust unit to form a transfer layer having a thickness of 3.0 μm.

Resin (A-3)

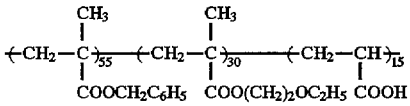

Mw $9\times10^3$, Tg: 40° C.

Resin (A-4)

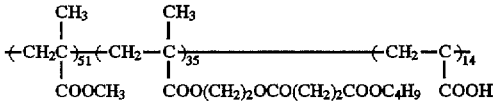

Mw $8\times10^3$, Tg: 30° C.

A toner image was formed on the light-sensitive element by an electrophotographic process in the same manner as in Example 2.

On the other hand, a primary receptor was prepared in the following manner. On a hollow roller, a sheet of natural rubber having a rubber hardness of 75 degree and a thickness of 4 mm (manufactured by Kokugo Co., Ltd.) was fixed, and a layer of methoxymethyl-modified nylon resin (Diamide MX-100 manufactured by Daicel Co., Ltd.) having a thickness of 2 μm was provided thereon. To the surface thereof was applied the composition shown below and heated at 120° C. for 2 hours to form the cured uppermost layer having a thickness of 1 μm. The adhesive strength of the surface of the resulting primary receptor was 120 g·f.

Composition for Uppermost Layer

Resin (a)

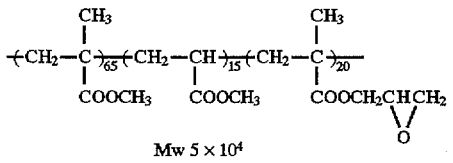

10 g

Mw $5\times10^4$

Resin (b)

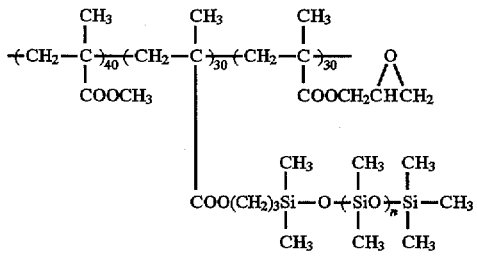

0.1 g

Mw $6\times10^4$ (Mw of dimethylsiloxane portion: $5\times10^3$)

| | |
|---|---|
| Phthalic anhydride | 0.2 g |
| o-Chlorophenol | 0.02 g |
| Tetrahydrofuran | 70 g |

The primary receptor, whose surface temperature had been adjusted at 80° C. was brought into contact with the light-sensitive element having the transfer layer and toner image thereon, whose surface temperature had been maintained at 60° C. and subjected to heating and pressing under the condition of a nip pressure of 3.5 kgf/cm$^2$ and a drum circumferential speed of 80 mm/sec, whereby the toner image was transferred together with the transfer layer on the primary receptor.

Then, an aluminum substrate of FPD was introduced as a receiving material between the primary receptor, the surface temperature of which had been adjusted at 80° C., and a back-up roller for transfer adjusted at 100° C. and a back-up roller for release adjusted at 20° C., and subjected to heating and pressing under a nip pressure of 4.5 kgf/cm$^2$ and at a drum circumferential speed of 100 mm/sec. The toner image was wholly transferred together with the transfer layer from the primary receptor onto the aluminum substrate.

The printing plate precursor thus-obtained was further heated using a device (RICOH FUSER Model 592 manufactured by Ricoh Co., Ltd.) to sufficiently fix the toner image portion. The printing plate precursor was visually observed using an optical microscope of 200 magnifications. It was found that the non-image areas had no stain and the image areas suffered no defects (such as cutting of fine lines and fine letters) in high definition regions.

The printing plate precursor was immersed in Oil-Desensitizing Solution (E-4) having the composition shown below at 30° C. for 30 seconds with moderate rubbing of the surface thereof to remove the transfer layer in the non-image area, thoroughly washed with water and gummed to obtain a lithographic printing plate.

Oil-Desensitizing Solution (E-4)

| | |
|---|---|
| PS plate processing solution (DP-4 manufactured by Fuji Photo Film Co., Ltd.) | 100 g |
| N,N-Dimethylethanolamine | 60 g |
| Distilled water | up to make 1 liter (pH: 12.4) |

The printing plate was subjected to printing on neutral paper with various offset printing color inks using an offset printing machine (Oliver 94 Model manufactured by Sakurai Seisakusho K.K.), and an aqueous solution (pH: 7.0) prepared by diluting dampening water for PS plate (SG-23 manufactured by Tokyo Ink K.K.) 130-fold with distilled water, as dampening water. As a result, more than 60,000 prints with clear images free from background stains were obtained irrespective of the kind of color ink.

EXAMPLES 30 TO 33

Each printing plate was prepared and offset printing was conducted using each of the resulting printing plates in the same manner as in Example 29 except for using each of the resins (A) shown in Table K below in place of Resins (A-3) and (A-4) employed in the hot-melt coating method for the formation of transfer layer of Example 29.

Good results similar to those in Example 29 were obtained.

TABLE K

| Example | Resin (A) | |
|---|---|---|
| 30 | 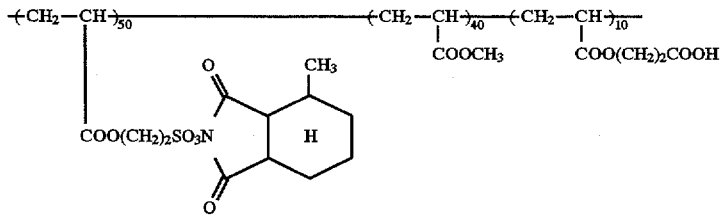 (A-5) | Mw $3\times10^4$, Tg 30° C. |

TABLE K-continued

| Example | Resin (A) |
|---|---|
| 31 | 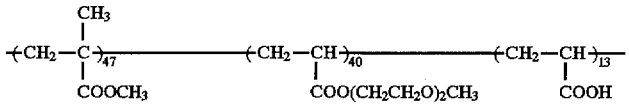 (A-6) Mw $3\times10^4$, Tg 28° C. |
| 32 | 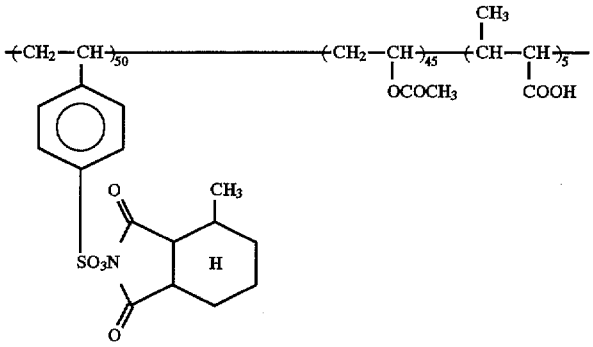 (A-7) Mw $2\times10^4$, Tg 25° C. |
| 33 | 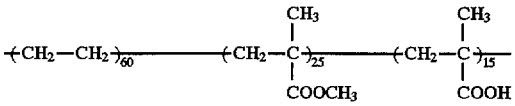 (A-8) Mw $4\times10^4$, Tg 30° C. |

EXAMPLES 34 TO 37

Each printing plate was prepared and offset printing was conducted using each of the resulting printing plates in the same manner as in Example 6 except for using paper prepared by coating each of the resins (A) shown in Table L below on release paper (San Release manufactured by Sanyo Kokusaku Pulp Co., Ltd.) to form a transfer layer having a thickness of 4 μm in place of the paper having the transfer layer on Separate Shi employed in Example 6.

With each printing plate, more than 60,000 prints with clear images free from background stains were obtained irrespective of the kind of color ink.

TABLE L

| Example | Resin (A) |
|---|---|
| 34 | 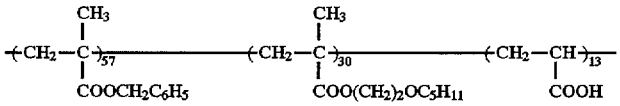 (A-9) Mw $9\times10^3$, Tg 30° C. |
| | A mixture of Resin (A-9) and Resin (A-10) in weight ratio of 2:3 |
| 35 | 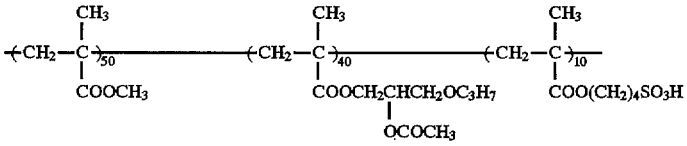 (A-10) Mw $8\times10^3$, Tg 20° C. |
| | A mixture of Resin (A-8) and Resin (A-11) in weight ratio of 1:1 |

TABLE L-continued

| Example | Resin (A) |
|---|---|
| 36 | 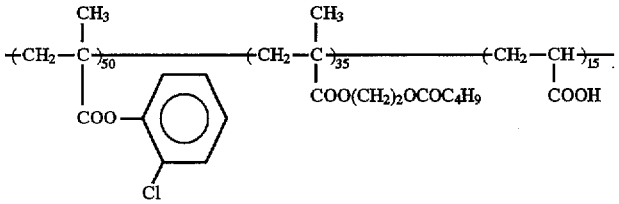 (A-11) Mw $8.5 \times 10^3$, Tg 15° C. |
| 37 | 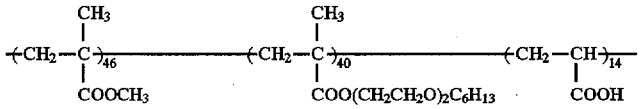 (A-12) Mw $1 \times 10^4$, Tg 33° C. |

EXAMPLES 38 TO 45

Each printing plate was prepared and offset printing was conducted using each of the resulting printing plates in the same manner as in Example 5, except for using each of the resins (P) and/or resin grains (PL) shown in Table M below for a light-sensitive layer in place of 2 g of Resin (P-2) employed in Example 5.

The image quality of prints obtained and printing durability of each printing plate were good similar to those in Example 5.

TABLE M

| Example | Resin (P) and/or Resin Grain (PL) | Amount (g) |
|---|---|---|
| 38 | P-11 | 2 |
| 39 | P-17 | 3 |
| 40 | P-21 | 2 |
| 41 | P-22 | 2.4 |
| 42 | P-23 | 1.5 |
| 43 | P-24 | 1.5 |
| | PL-3 | 1.0 |
| 44 | PL-1 | 1.2 |
| | P-18 | 1.8 |
| 45 | P-25 | 2 |
| | PL-6 | 2 |

EXAMPLES 46 TO 55

Each printing plate was prepared and offset printing was conducted using each of the resulting printing plates in the same manner as in Example 5 except for using each of the compounds shown in Table N below in place of Resin (P-2), phthalic anhydride and o-chlorophenol employed in Example 5.

The image quality of prints obtained and printing durability of each printing plate were good as those in Example 5.

TABLE N

| Example | Resin (P) or Resin Grain (PL) | Amount (g) | Compound for Crosslinking | Amount (g) |
|---|---|---|---|---|
| 46 | P-1 | 1.8 | Phthalic anhydride | 0.2 |
| | | | Zirconium acetylacetone | 0.01 |
| 47 | P-20 | 3.2 | Gluconic acid | 0.3 |
| | | | p-Cyanophenol | 0.002 |
| 48 | P-5 | 2 | N-Methylaminopropanol | 0.25 |
| | | | Dibutyltin dilaurate | 0.001 |
| 49 | P-16 | 2.4 | N,N'-Dimethylpropanediamine | 0.3 |
| 50 | P-16 | 1.5 | Propylene glycol | 0.2 |
| | | | Tetrakis(2-ethylhexane-diolato)titanium | 0.008 |
| 51 | PL-6 | 3 | — | — |
| 52 | PL-2 | 4 | N,N-Dimethylpropanediamine | 0.25 |
| 53 | P-18 | 4 | Propyltriethoxysilane | 0.01 |
| 54 | PL-6 | 5.5 | N,N-Diethylbutanediamine | 0.3 |
| 55 | P-15 | 1 | Ethylene diglycidyl ether | 0.2 |
| | | | o-Chlorophenol | 0.001 |

EXAMPLE 56

A mixture of 100 g of photoconductive zinc oxide, 19 g of Binder Resin (B-4) having the structure shown below, 3 g of Binder Resin (B-5) having the structure shown below, 3 g of Resin (P-1), 0.01 g of uranine, 0.02 g of Rose Bengal, 0.01 g of bromophenol blue, 0.15 g of maleic anhydride and 150 g of toluene was dispersed by a homogenizer (manufactured by Nippon Seiki K.K.) at a rotation of $1\times10^4$ r.p.m. for 10 minutes. To the dispersion were added 0.02 g of phthalic anhydride and 0.001 g of o-chlorophenol, and the mixture was dispersed by a homogenizer at a rotation of $1\times10^3$ r.p.m. for 1 minute.

Binder Resin (B-4)

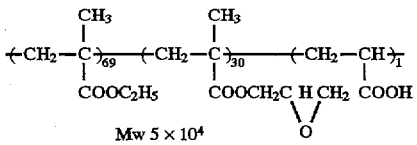

Mw $5 \times 10^4$

-continued

Binder Resin (B-5)

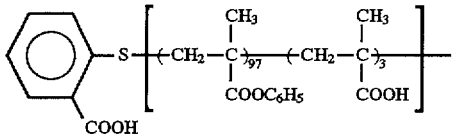

Mw $8\times10^3$

The resulting dispersion was coated on base paper for a paper master having a thickness of 0.2 mm, which had been subjected to electrically conductive treatment and solvent-resistant treatment, by a wire bar at a coverage of 20 g/m$^2$, set to touch and heated in a circulating oven at 120° C. for one hour. The adhesive strength of the surface of the thus-obtained electrophotographic light-sensitive element was 4 g·f.

On the light-sensitive element was provided a transfer layer by the electrodeposition coating method in the following manner.

Using Dispersion of Resin (A) (L-6) shown below, resin grains were electrodeposited while applying an electric voltage of −150 V to the light-sensitive element to form the transfer layer having a thickness of 2 μm.

| Dispersion of Resin (A) (L-6) | |
|---|---|
| Resin Grain (ARW-4) | 20 g (solid basis) |
| Charge Control Agent (D-2) | 0.038 g |
| Branched Tetradecyl Alcohol (FOC-1400 manufactured by Nissan Chemical Industries, Ltd.) | 8 g |
| Isopar G | up to make 1 liter |

The resulting light-sensitive element having the transfer layer provided thereon was charged to a surface potential of −600 V in dark, flash exposed imagewise using a halogen lamp of 400 W for 7 seconds, and subjected to development using Liquid Developer (LD-1) while applying a bias voltage of 100 V to a developing unit. Then, the element was rinsed in a bath of Isopar G, and the toner image was fixed by a heat roll.

The light-sensitive element bearing the toner image was brought into contact with a primary receptor as in Example 1 to transfer the toner image together with the transfer layer, which were then brought into contact with a sheet of OK Master (manufactured by Nippon Seihaku Co., Ltd.) as a receiving material, whereby the toner image was transferred together with the transfer layer to the OK Master.

As a result of visual evaluation of the image transferred on the OK Master, it was found that the transferred image was almost same as the duplicated image on the light-sensitive element before transfer and degradation of image was not observed. Also, on the surface of the primary receptor after the transfer, the residue of the toner image and transfer layer was not observed at all. These results indicated that the transfer had been completely performed.

For comparison, an electrophotographic light-sensitive element was prepared in the same manner as described above except for eliminating 3 g of Resin (P-1). The adhesive strength of the surface thereof was more than 400 gf. Using the electrophotographic light-sensitive element for comparison, the formation of transfer layer, electrophotographic process and heat-transfer of transfer layer were conducted in the same manner as described above. It was found, however, that release at the interface between the surface of light-sensitive element and the transfer layer was not recognized at all.

Then, the sheet of OK Master having thereon the transfer layer and toner image, i.e., printing plate precursor was subjected to an oil-desensitizing treatment to prepare a printing plate and its printing performance was evaluated. Specifically, the printing plate precursor was immersed in Oil-Desensitizing Solution (E-5) having the composition shown below at 25° C. for 30 seconds with moderate rubbing with a brush to remove the transfer layer in the non-image area and thoroughly washed with water to obtain a printing plate.

| Oil-Desensitizing Solution (E-5) | |
|---|---|
| Mercaptoethanesulfonic acid | 10 g |
| Neosoap (manufacutured by Matsumoto Yushi K.K.) | 5 g |
| N,N-Dimethylacetamide | 10 g |
| Distilled water | up to make 1 l |
| Sodium hydroxide | to adjust to pH 12.0 |

The printing plate thus prepared was observed visually using an optical microscope of 200 magnifications. It was found that the non-image area had no residual transfer layer, and the image area suffered no defects in high definition regions (i.e., cutting of fine lines and fine letters).

The printing plate was subjected to printing on neutral paper with various offset printing color inks using an offset printing machine (Ryobi 3200 MCD Model manufactured by Ryobi Ltd.), and an aqueous solution (pH: 7.0) prepared by diluting dampening water for PS plate (SG-23 manufactured by Tokyo Ink K.K.) 130-fold with distilled water, as dampening water. As a result, more than 10,000 prints with clear images free from background stains were obtained irrespective of the kind of color ink.

In a conventional system wherein an electrophotographic light-sensitive element utilizing zinc oxide is oil-desensitized with an oil-desensitizing solution containing a chelating agent as the main component under an acidic condition to prepare a lithographic printing plate, printing durability of the plate is in a range of several hundred prints without the occurrence of background stain in the non-image area when neutral paper are used for printing or when offset printing color inks other than black ink are employed. Contrary to the conventional system, the method for preparation of a printing plate by an electrophotographic process according to the present invention can provide a printing plate having excellent printing performance in spite of using a zinc oxide-containing light-sensitive element.

EXAMPLE 57

5 g of 4,4'-bis(diethylamino)-2,2'-dimethyltriphenylmethane as an organic photoconductive substance, 4 g of Binder Resin (B-6) having the structure shown below, 0.4 g of Resin (P-12), 40 mg of Dye (D) having the structure shown below, and 0.2 g of Anilide Compound (C) having the structure shown below as a chemical sensitizer were dissolved in a mixed solvent of 30 ml of methylene chloride and 30 ml of ethylene chloride to prepare a solution for light-sensitive layer.

Binder Resin (B-6)

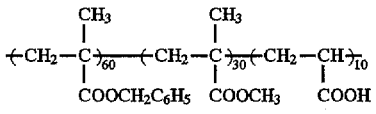

Mw × $10^4$

Dye (D)

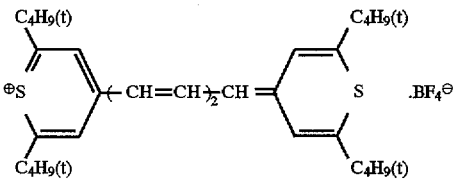

Anilide Compound (C)

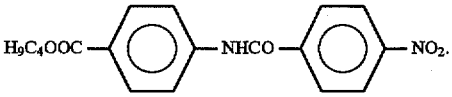

The resulting solution for light-sensitive layer was coated on a conductive transparent substrate composed of a 100 μm thick polyethylene terephthalate film having a deposited layer of indium oxide thereon (surface resistivity: $10^3\Omega$) by a wire round rod to prepare a light-sensitive element having an organic light-sensitive layer having a thickness of about 4 μm. The adhesive strength of the surface of light-sensitive element was 8 g·f.

The procedure same as in Example 1 was repeated except for using the resulting light-sensitive element in place of the light-sensitive element employed in Example 1 to prepare a printing plate. Using the printing plate, printing was conducted in the same manner as in Example 1. The prints obtained had clear images without the formation of background stain and printing durability of the printing plate was good similar to Example 1.

EXAMPLE 58

A mixture of 5 g of a bisazo pigment having the structure shown below, 95 g of tetrahydrofuran and 5 g of a polyester resin (Vylon 200 manufactured by Toyobo Co., Ltd.) was thoroughly pulverized in a ball mill. The mixture was added to 520 g of tetrahydrofuran with stirring. The resulting dispersion was coated on a conductive transparent substrate used in Example 57 by a wire round rod to prepare a charge generating layer having a thickness of about 0.7 μm.

A mixed solution of 20 g of a hydrazone compound having the structure shown below, 20 g of a polycarbonate resin (Lexan 121 manufactured by General Electric Co., Ltd.) and 160 g of tetrahydrofuran was coated on the above-described charge generating layer by a wire round rod, dried at 60° C. for 30 seconds and then heated at 100° C. for 20 seconds to form a charge transporting layer having a thickness of about 18 μm whereby an electrophotographic light-sensitive layer of a double-layered structure was prepared.

Hydrazone Compound

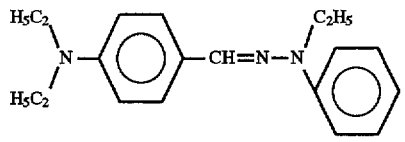

A mixed solution of 13 g of Resin (P-22), 0.2 g of phthalic anhydride, 0.002 g of o-chlorophenol and 100 g of toluene was coated on the light-sensitive layer by a wire round rod, set to touch and heated at 120° C. for one hour to prepare a surface layer for imparting releasability having a thickness of 1 μm. The adhesive strength of the surface of the resulting light-sensitive element was 5 g·f.

The resulting light-sensitive element was charged to a surface potential of −500 V in dark and exposed imagewise using a helium-neon laser of 633 nm at an irradiation dose on the surface of the light-sensitive element of 30 erg/$cm^2$, followed by conducting the same procedure as in Example 1 to prepare a printing plate. As a result of offset printing using the resulting printing plate in the same manner as in Example 1, the printing plate exhibited the good performance similar to that in Example 1.

EXAMPLES 59 TO 64

Each printing plate was prepared and offset printing was conducted using the resulting printing plate in the same manner as in Example 2 except for employing each of the compounds (S) shown in Table O below in place of 1.0 g/l of Compound (S-1) employed in Example 2.

The results obtained were similar to those in Example 2. Specifically, the releasability was effectively imparted on the surface of light-sensitive element using each of the compounds (S).

Bisazo Pigment

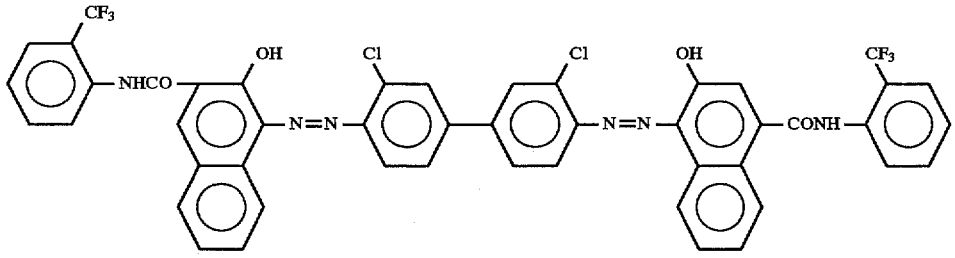

TABLE O

| Example | Compound (S) containing Fluorine Atom and/or Silicon Atom | Amount (g/l) |
|---|---|---|
| 59 | (S-7) Higher fatty acid-modified silicone (TSF 411 manufactured by Toshiba Silicone Co., Ltd.) 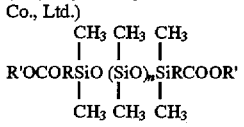 (presumptive structure) | 1 |
| 60 | (S-8) Carboxy-modified silicone (X-22-3701E manufactured by Shin-Etsu Silicone Co., Ltd.) 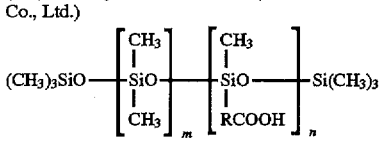 (presumptive structure) | 0.5 |
| 61 | (S-9) Carbinol-modified silicone (X-22-176B manufactured by Shin-Etsu Silicone Co., Ltd.) 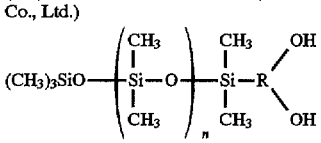 (presumptive structure) | 1 |
| 62 | (S-10) Mertcapto-modified silicone (X-22-167B manufactured by Shin-Etsu Silicone Co., Ltd.) 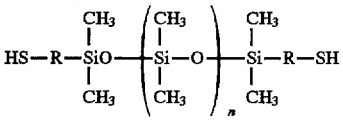 (presumptive structure) | 2 |
| 63 | (S-11) 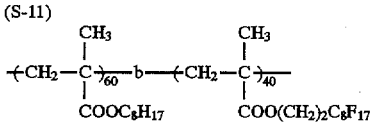 Mw $6\times10^3$ | 1.5 |
| 64 | (S-12) 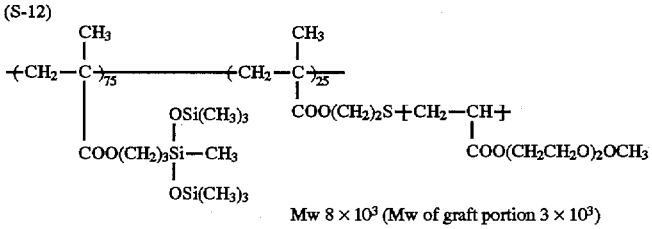 Mw $8\times10^3$ (Mw of graft portion $3\times10^3$) | 2 |

EXAMPLES 65 TO 76

An offset printing plate was prepared by subjecting some of the image receiving materials bearing the toner images together with the transfer layers (i.e., printing plate precursors) prepared in Examples 1 to 64 to the following oil-desensitizing treatment. Specifically, to 0.2 moles of each of the nucleophilic compounds shown in Table P below, 30 g of each of the organic compounds shown in Table P below, and 2 g of Newcol B4SN (manufactured by Nippon Nyukazai K.K.) was added distilled water to make one liter, and the solution was adjusted to a pH of 12.5. Each printing plate precursor was immersed in the resulting treating solution at a temperature of 35° C. for 20 seconds with moderate rubbing to remove the transfer layer in the non-image area.

Printing was carried out using the resulting printing plate under the same conditions as in Example 1. Each plate exhibited good characteristics similar to those in Example 1.

TABLE P

| Example | Basis Example for Printing Plate Precursor | Nucleophilic Compound | Organic Compound |
|---|---|---|---|
| 65 | Example 7 | Sodium sulfite | N,N-Dimethylformamide |
| 66 | Example 8 | Monoethanolamine | Sulfolane |
| 67 | Example 9 | Diethanolamine | Polyethylene glycol |
| 68 | Example 10 | Thiomalic acid | Ethylene glycol dimethyl ether |
| 69 | Example 11 | Thiosalicylic acid | Benzyl alcohol |
| 70 | Example 12 | Taurine | Ethylene glycol monomethyl ether |
| 71 | Example 13 | 4-Sulfobenzenesulfinic acid | Glycerin |
| 72 | Example 14 | Thioglycolic acid | Tetramethylurea |
| 73 | Example 15 | 2-Mercaptoethylphosphonic acid | Dioxane |
| 74 | Example 18 | Cysteine | N-Methylacetamide |
| 75 | Example 23 | Sodium thiosulfate | Polypropylene glycol |
| 76 | Example 27 | Ammonium sulfite | N,N-Dimethylacetamide |

While the invention has been described in detail and with reference to specific embodiments thereof, it will be apparent to one skilled in the art that various changes and modifications can be made therein without departing from the spirit and scope thereof.

What is claimed is:

1. A method for preparation of a printing plate by an electrophotographic process comprising providing a peelable transfer layer mainly containing a resin (A) capable of being removed upon a chemical reaction treatment on an electrophotographic light-sensitive element, forming a toner image on the transfer layer by an electrophotographic process, transferring the toner image together with the transfer layer onto a primary receptor, transferring the toner image together with the transfer layer from the primary receptor onto a receiving material having a surface capable of providing a hydrophilic surface suitable for lithographic printing at the time of printing, and removing the transfer layer on the receiving material in a non-image area by the chemical reaction treatment.

2. A method for preparation of a printing plate by an electrophotographic process as claimed in claim 1, wherein a surface of the electrophotographic light-sensitive element has an adhesive strength of not more than 100 gram-force.

3. A method for preparation of a printing plate by an electrophotographic process as claimed in claim 2, wherein a surface of the primary receptor has an adhesive strength lager than the adhesive strength of the surface of light-sensitive element.

4. A method for preparation of a printing plate by an electrophotographic process as claimed in claim 2, wherein the electrophotographic light-sensitive element comprises amorphous silicon as a photoconductive substance.

5. A method for preparation of a printing plate by an electrophotographic process as claimed in claim 2, wherein the electrophotographic light-sensitive element contains a polymer having a polymer component containing at least one of a silicon atom and a fluorine atom in the region near to the surface thereof.

6. A method for preparation of a printing plate by an electrophotographic process as claimed in claim 5, wherein the polymer is a block copolymer comprising at least one polymer segment ($\alpha$) containing at least 50% by weight of a fluorine atom and/or silicon atom-containing polymer component and at least one polymer segment ($\beta$) containing 0 to 20% by weight of a fluorine atom and/or silicon atom-containing polymer component, the polymer segments ($\alpha$) and ($\beta$) being bonded in the form of blocks.

7. A method for preparation of a printing plate by an electrophotographic process as claimed in claim 6, wherein the polymer further contains a polymer component containing a photo- and/or heat-curable group.

8. A method for preparation of a printing plate by an electrophotographic process as claimed in claim 5, wherein the polymer further contains a polymer component containing a photo- and/or heat-curable group.

9. A method for preparation of a printing plate by an electrophotographic process as claimed in claim 5, wherein the electrophotographic light-sensitive element further contains a photo- and/or heat-curable resin.

10. A method for preparation of a printing plate by an electrophotographic process as claimed in claim 2, wherein the electrophotographic light-sensitive element is an electrophotographic light-sensitive element to the surface of which a compound (S) which contains a fluorine atom and/or a silicon atom has been applied.

11. A method for preparation of a printing plate by an electrophotographic process as claimed in claim 1, wherein the electrophotographic process comprises a scanning exposure system using a laser beam based on digital information and a development system using a liquid developer.

12. A method for preparation of a printing plate by an electrophotographic process as claimed in claim 1, wherein the transfer layer is peelable from the light-sensitive element at a temperature of not more than 180° C. or at a pressure of not more than 30 Kgf/cm$^2$.

13. A method for preparation of a printing plate by an electrophotographic process as claimed in claim 1, wherein the resin (A) has a glass transition point of not more than 140° C. or a softening point of not more than 180° C.

14. A method for preparation of a printing plate by an electrophotographic process as claimed in claim 1, wherein the resin (A) contains at least one polymer component selected from polymer component (a) containing at least one group selected from a —$CO_2H$ group, a —CHO group, —$SO_3H$ group, a —$SO_2H$ group, a —P(=O)(OH)$R^1$ group (wherein $R^1$ represents a —OH group, a hydrocarbon group or a —$OR^2$ group (wherein $R^2$ represents a hydrocarbon group)), a phenolic hydroxy group, a cyclic acid anhydride-containing group, a —$CONHCOR^3$ group (wherein $R^3$ represents a hydrocarbon group) and a —$CONHSO_2R^3$ group and polymer component (b) containing at least one functional group capable of forming at least one group selected from a —$CO_2H$ group, a —CHO group, a —$SO_3H$ group, a —$SO_2H$ group, a —P(=O)(OH)$R^1$ group and a —OH group upon a chemical reaction.

15. A method for preparation of a printing plate by an electrophotographic process as claimed in claim 14, wherein the resin (A) further contains a polymer component corresponding to the repeating unit represented by the following general formula (U):

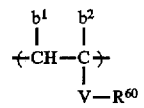

(U)

wherein V represents —COO—, —OCO—, —O—, —CO—, $—C_6H_4—$, $-(CH_2)_n COO—$ or $-(CH_2)_n OCO—$; n represents an integer of from 1 to 4; $R^{60}$ represents a hydrocarbon group having from 1 to 22 carbon atoms; and $b^1$ and $b^2$, which may be the same or different, each represents a hydrogen atom, a fluorine atom, a chlorine atom, a bromine atom, a cyano group, a trifluoromethyl group, a hydrocarbon group having from 1 to 7 carbon atoms or $—COOZ^{11}$ (wherein $Z^{11}$ represents a hydrocarbon group having from 1 to 7 carbon atoms).

16. A method for preparation of a printing plate by an electrophotographic process as claimed in claim 14, wherein the resin (A) further contains a polymer component (f) containing a moiety having at least one of a fluorine atom and a silicon atom.

17. A method for preparation of a printing plate by an electrophotographic process as claimed in claim 16, wherein the polymer component (f) is present as a block in the resin (A).

18. A method for preparation of a printing plate by an electrophotographic process as claimed in claim 1, wherein the transfer layer mainly contains a resin (AH) having a glass transition point of from 10° C. to 140° C. or a softening point of from 35° C. to 180° C. and a resin (AL) having a glass transition point of not more than 45° C. or a softening point of not more than 60° C. in which a difference in the glass transition point or softening point between the resin (AH) and the resin (AL) is at least 2° C.

19. A method for preparation of a printing plate by an electrophotographic process as claimed in claim 1, wherein the transfer layer is composed of a first layer which is positioned on the light-sensitive element and which contains a resin (AH) having a glass transition point of from 10° C. to 140° C. or a softening point of from 35° C. to 180° C. and a second layer provided thereon containing a resin (AL) having a glass transition point of not more than 45° C. or a softening point of not more than 60° C. in which a difference in the glass transition point or softening point between the resin (AH) and the resin (AL) is at least 2° C.

20. A method for preparation of a printing plate by an electrophotographic process as claimed in claim 1, wherein the transfer layer is provided by a hot-melt coating method.

21. A method for preparation of a printing plate by an electrophotographic process as claimed in claim 1, wherein the transfer layer is provided by an electrodeposition coating method.

22. A method for preparation of a printing plate by an electrophotographic process as claimed in claim 21, wherein the electrodeposition coating method is carried out using grains comprising the resin (A) supplied as a dispersion thereof in an electrically insulating solvent having an electric resistance of not less than $10^8$ Ω·cm and a dielectric constant of not more than 3.5.

23. A method for preparation of a printing plate by an electrophotographic process as claimed in claim 22, wherein the grains contains a resin (AH) having a glass transition point of from 10° C. to 140° C. or a softening point of from 35° C. to 180° C. and a resin (AL) having a glass transition point of not more than 45° C. or a softening point of not more than 60° C. in which a difference in the glass transition point or softening point between the resin (AH) and the resin (AL) is at least 2° C.

24. A method for preparation of a printing plate by an electrophotographic process as claimed in claim 23, wherein the grains have a core/shell structure.

25. A method for preparation of a printing plate by an electrophotographic process as claimed in claim 22, wherein the dispersion of resin grains further contains a compound (S) which containing a fluorine atom and/or a silicon atom.

26. A method for preparation of a printing plate by an electrophotographic process as claimed in claim 21, wherein the electrodeposition coating method is carried out using grains comprising the resin (A) which are supplied between the electrophotographic light-sensitive element and an electrode placed in face of the light-sensitive element, and migrated by electrophoresis according to a potential gradient applied from an external power source to cause the grains to adhere to or electrodeposit on the electrophotographic light-sensitive element, thereby forming a film.

27. A method for preparation of a printing plate by an electrophotographic process as claimed in claim 1, wherein the transfer layer is provided by a transfer method from a releasable support.

28. A method for preparation of a printing plate by an electrophotographic process as claimed in claim 1, wherein before the provision of transfer layer, a compound (S) containing a fluorine atom and/or a silicon atom is applied to a surface of the electrophotographic light-sensitive element.

* * * * *